US012594462B2

(12) United States Patent
Burke

(10) Patent No.: US 12,594,462 B2
(45) Date of Patent: Apr. 7, 2026

(54) SYSTEM AND METHOD FOR TRACKING SPORTS PLAYERS TO GENERATE AND APPLY RECEIVER TRACKING METRICS

(71) Applicant: Disney Enterprises, Inc., Burbank, CA (US)

(72) Inventor: Brian J. Burke, Burbank, CA (US)

(73) Assignee: DISNEY ENTERPRISES, INC., Burbank, CA (US)

( * ) Notice: Subject to any disclaimer, the term of this patent is extended or adjusted under 35 U.S.C. 154(b) by 262 days.

(21) Appl. No.: 18/499,082

(22) Filed: Oct. 31, 2023

(65) Prior Publication Data

US 2025/0099810 A1 Mar. 27, 2025

Related U.S. Application Data

(60) Provisional application No. 63/585,816, filed on Sep. 27, 2023.

(51) Int. Cl.
*A63B 24/00* (2006.01)
*A63B 71/06* (2006.01)

(52) U.S. Cl.
CPC ..... *A63B 24/0062* (2013.01); *A63B 71/06* (2013.01)

(58) Field of Classification Search
CPC ..... A63B 24/0062; A63B 71/06
See application file for complete search history.

(56) References Cited

U.S. PATENT DOCUMENTS

| | | | | |
|---|---|---|---|---|
| 7,671,802 | B2 | 3/2010 | Walsh et al. | |
| 8,670,847 | B2 | 3/2014 | Sloan et al. | |
| 10,398,988 | B2 | 9/2019 | Sloan | |
| 10,744,415 | B2 | 8/2020 | Sloan et al. | |
| 10,940,395 | B2 | 3/2021 | Sloan et al. | |
| 2021/0073010 | A1* | 3/2021 | Dengler | G06T 11/00 |
| 2022/0335720 | A1* | 10/2022 | Chang | H04N 5/2224 |

OTHER PUBLICATIONS

Burke, Brian J., "DeepQB: Deep Learning with Player Tracking to Quantify Quarterback Decision-Making & Performance", pp. 1-13, https://global-uploads.webflowcom/5f1af76ed86d6771ad48324b/5f6d394ebce99d0d6cdb767c_DeepQB.pdf.

(Continued)

*Primary Examiner* — Jeffrey K Wong
(74) *Attorney, Agent, or Firm* — McCormick, Paulding & Huber PLLC

(57) ABSTRACT

A system and method for tracking sports players to generate and apply receiver tracking metrics includes determining a catch/no-catch probability for a given pass route for a specific receiver using the player tracking data using a neural network model, determining a completion expected catch/no-catch estimation for a given pass route for a typical receiver using a classifier model and pass route data, calculating RTM sub-components of the receiver tracking metrics using the catch/no-catch probability and the completion expected catch/no-catch estimation, calculating corresponding weightings for each of the RTM sub-components, and calculating RTM scores by combining the RTM sub-components and weightings, the RTM scores including at least one of: open score, catch score, YAC score, and overall RTM score. In some embodiments, RTMs may be used to enhance or improve an end software application.

38 Claims, 43 Drawing Sheets

(56) References Cited

OTHER PUBLICATIONS

The Next Gen Stats Analytics Team, "Next Gen Stats: Introduction to Completion Probability", published Sep. 21, 2018, https://www.nfl.com/news/next-gen-stats-introduction-to-completion-probability-0ap3000000964655.

Hochstedler, Jeremy, "Finding the Open Receiver: A Quantitative Geospatial Analysis of Quarterback Decision- Making", Telemetry Sports & Massachusetts Institute of Technology, pp. 1-10.

Horton, Michael, "Learning Feature Representations from Football Tracking", https://global-uploads.webflowcom/5f1af76ed86d6771ad48324b/5f6a64f08df2d11380c92bc8_horton_feature_representation.pdf.

Naik, Banoth, et al., "A Comprehensive Review of Computer Vision in Sports: Open Issues, Future Trends and Research Directions", Applied Sciences, vol. 12, 2022, pp. 1-49.

Wilson, Jason, " How Madden 22's AI makes better use of NFL Next Gen Stats", https://venturebeat.com/games/how-madden-21s-ai-makes-better-use-of-nfl-next-gen-stats.

"Computer Vision in Sports—Use Cases in 2023", https://viso.ai/applications/visual-ai-in-sports/#:~:text=A%20computer%20vision%20system%20can,the%20quality%20of%20the%20reps., pp. 1-21.

* cited by examiner

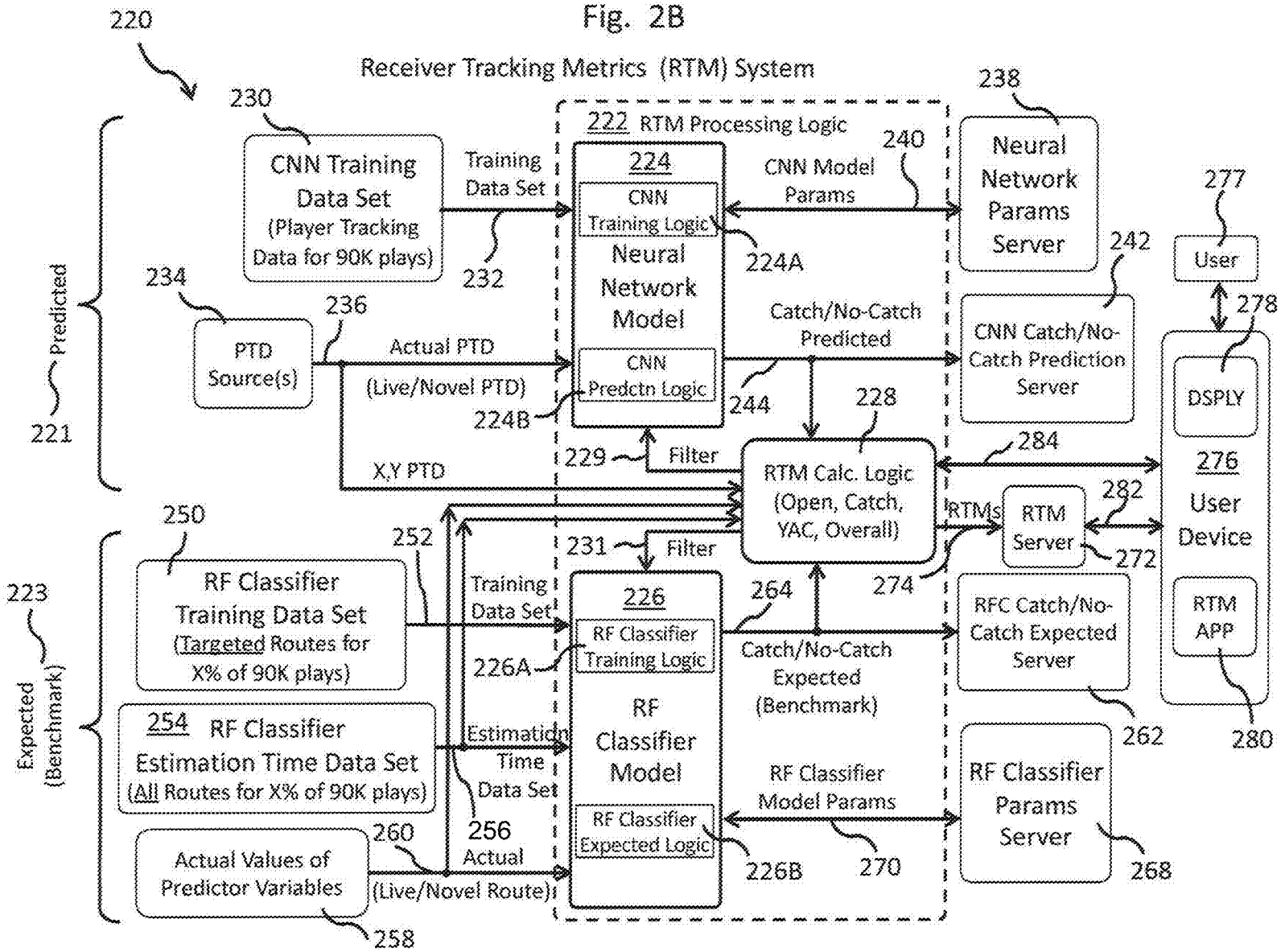
Fig. 2B
Receiver Tracking Metrics (RTM) System
220
222 RTM Processing Logic
224 CNN Training Logic
Neural Network Model
CNN Predctn Logic
224A
224B
226 RF Classifier Training Logic
RF Classifier Model
RF Classifier Expected Logic
226A
226B
Filter
229
231
232 Training Data Set
234 PTD Source(s)
236 Actual PTD (Live/Novel PTD)
X,Y PTD
230 CNN Training Data Set (Player Tracking Data for 90K plays)
238 Neural Network Params Server
240 CNN Model Params
242 CNN Catch/No-Catch Prediction Server
244 Catch/No-Catch Predicted
228 RTM Calc. Logic (Open, Catch, YAC, Overall)
274 RTMs
284
282
272 RTM Server
262 RFC Catch/No-Catch Expected Server
264 Catch/No-Catch Expected (Benchmark)
268 RF Classifier Params Server
270 RF Classifier Model Params
277 User
278 DSPLY
276 User Device
280 RTM APP
221 Predicted
223 Expected (Benchmark)
250 RF Classifier Training Data Set (Targeted Routes for X% of 90K plays)
252 Training Data Set
254 RF Classifier Estimation Time Data Set (All Routes for X% of 90K plays)
256 Estimation Time Data Set
258 Actual Values of Predictor Variables
260 Actual (Live/Novel Route)

540

Fig. 5C

Sub-Component Calculation & Snapshot-Time Table

| No. | Comp./Sub-Comp. Name | Calculation | PTD Data Snapshot Time | Routes Used (Targeted/All) |
|---|---|---|---|---|
| 1 | Openness at Release (OAR) | Predicted - Expected | 0.2 sec before pass release | All Routes |
| 2 | Openness at Arrival (OAA) | Predicted - Expected (Adjusted for QB/Accuracy) | Arrival time (time of catch) | All Routes |
| 3 | Openness vs Man-Only Def at Release (OVMR) | Predicted - Expected (filtered for Man only) | 0.2 sec before pass release | All Routes |
| 4 | Openness vs Man-Only Def at Arrival (OVMA) | Predicted - Expected (filtered for Man only) (Adjusted for QB/Accuracy) | Arrival time (time of catch) | All Routes |
| 5 | Double Team Adjustment (DTA) | Actual - Expected (Def w/in Radius) (Fig. 5D) | n/a | All Routes |
| 6 | Catch Over Predicted (COP) | Actual - Predicted (Adjusted for QB/Accuracy) | Arrival time (time of catch) | Targeted Only |
| 7 | Catch Over Expected (COE) | Actual - Expected (Adjusted for QB/Accuracy) | n/a | Targeted Only |
| 8 | YAC Over Predicted (YOP) | Actual - Predicted (Adjusted for QB/Accuracy) | Arrival time (time of catch) | n/a (catch made) |

Double Team Adjustment Logic

Calculate Weights (W1-W8) for each Sub-Component

Calculate 3 RTM Scores

Calculate Overall RTM Score

Fig. 5H

580

Sample aggregate weights grouped by RTM score

| Position | Open Score Weight (W1-W5) | Catch Score Weight (W6-W7) | YAC Score Weight (W8) |
|---|---|---|---|
| WR & TE | about 0.5 (e.g., 50%) | > 0.25 (e.g., 26%) | <0.25 (e.g., 24%) |
| RB | <0.25 | >0.25 | about 0.5 (typ > Open or Catch weights) |

Fig. 5I

Weights W1-W8 calculation for WRs/TEs 586 589 590 588 587 585 587A 587B 587C 587D 587E

| | | | | | | | | | | | | | | |
|---|---|---|---|---|---|---|---|---|---|---|---|---|---|---|
| | | | | | | | Cor of ypg/yprr/ypt w/RTM Total: ---> | | | 0.690 | 0.714 | 0.468 | 2.609 | <-- Mix |
| | | W1 | W2 | W7 | W6 | W8 | W3 | W4 | W5 | Mix = (0*ypg + 3*yprr + 1*ypt) | | | | |
| 1 | Weights: | 0.18 | 0.039138111 | 0.309474897 | 0.04545672 | 0.284146413 | 0.049973706 | 0.031984948 | 0.059826119 | | | | | |
| Season | Player ID | mean_open_oe_rel | mean_adj_open_oe | mean_adj_catch_oe | mean_adj_catch_op | mean_yac_op | mean_open_oe_rel_man | mean_open_adj_oe_man | mean_double_oe | yds_per_game | YPRR | YPT | Position | RTM Total |
| 2019 | 1 | 1.99576226 | -0.362612699 | 0.436888966 | 0.668271997 | 4.136942514 | 2.182436426 | -0.304265134 | -0.636161829 | 58.7 | 2.79 | 12.53 | WR | 1.747 |
| 2017 | 2 | 2.727887832 | -0.246469016 | 2.043431024 | 2.058150409 | 1.10974971 | 2.795921465 | -0.215654327 | 0.506755675 | 111.0 | 3.24 | 10.28 | WR | 1.686 |
| 2018 | 3 | 1.848913303 | 0.941300645 | 2.822545223 | 2.633158105 | 0.979703884 | 1.559061087 | 1.327319934 | 1.773819794 | 89.6 | 2.93 | 10.01 | WR | 1.868 |
| 2019 | 4 | 2.147048032 | 1.256778289 | 2.118611519 | 1.830242489 | 0.542914553 | 3.006889981 | 1.366562625 | 1.566379535 | 104.8 | 3.17 | 9.68 | WR | 1.616 |
| 2020 | 5 | 0.819579726 | 0.922048844 | 2.06778243 | 1.748387486 | 1.820451651 | 1.522874257 | 1.389477027 | -0.005554755 | 87.5 | 3.00 | 11.76 | WR | 1.541 |
| 2017 | 6 | 2.155741969 | -1.077444115 | 1.634064364 | 2.238676091 | 0.350961417 | 2.804194118 | -0.312566947 | 1.848083851 | 91.9 | 2.56 | 8.40 | WR | 1.294 |
| 2020 | 7 | 2.001201822 | 0.864921909 | 2.487401101 | 2.289702084 | 0.372013812 | 1.473134868 | 0.982971781 | 1.215772645 | 95.0 | 2.79 | 9.92 | WR | 1.551 |
| 2020 | 8 | 1.099561877 | -0.598491311 | 0.914888322 | 1.532611709 | 2.471064631 | 1.288125931 | -0.062048846 | 0.510352928 | 77.1 | 2.87 | 10.32 | WR | 1.322 |
| 2018 | 9 | 0.941358084 | 0.862025287 | 1.51839883 | 1.571458082 | 1.75368212 | 1.57625431 | 0.787020463 | -0.108167681 | 67.9 | 2.17 | 9.95 | WR | 1.340 |
| 2021 | 10 | 1.403206588 | 1.650021098 | 2.156552598 | 1.485869985 | 1.323845416 | 0.693108052 | 0.963764412 | 0.637540073 | 115.5 | 3.50 | 11.55 | WR | 1.532 |
| 2020 | 11 | 2.378631799 | 0.992530474 | 1.434769707 | 0.983764422 | -0.561536898 | 3.855238968 | 1.720494909 | 0.968107418 | 93.4 | 3.13 | 10.03 | WR | 1.102 |
| 2017 | 12 | 1.900615936 | 0.590012061 | 1.653474679 | 1.604580155 | -0.068051264 | 2.564834415 | 0.618651377 | 1.278716825 | 81.2 | 2.90 | 9.25 | WR | 1.155 |
| 2019 | 13 | 1.916597565 | 0.376634685 | 1.805298057 | 1.378406734 | 0.527313583 | 1.69824399 | -0.393073375 | 0.797186193 | 70.7 | 2.94 | 12.02 | WR | 1.251 |
| 2020 | 14 | 2.666156298 | 1.765880685 | 1.168444518 | 0.563118856 | -1.022993658 | 3.505202504 | 1.118253629 | 0.881796736 | 52.1 | 2.69 | 9.23 | WR | 0.909 |
| 2021 | 15 | -0.052175128 | -0.277998189 | 0.933370281 | 1.343422429 | 3.312408378 | 0.125445521 | -0.203670634 | 0.480259763 | 86.8 | 2.66 | 12.15 | WR | 1.299 |
| 2021 | 16 | 0.376048705 | 1.426624703 | 1.64040013 | 1.325451946 | 2.352198682 | -0.268473889 | 0.580689327 | -0.136106437 | 48.7 | 2.24 | 12.71 | WR | 1.357 |
| 2021 | 17 | 1.49854905 | 0.302129938 | 1.414243985 | 1.794305855 | 0.03550322 | 1.560715934 | 0.039047018 | 2.439940037 | 79.8 | 2.35 | 9.11 | TE | 1.036 |
| 2021 | 18 | 0.876092438 | -0.208794299 | 1.172785496 | 1.217628148 | 1.349299051 | 1.128374758 | 0.87258189 | 2.514182626 | 59.4 | 2.59 | 10.40 | TE | 1.186 |
| * * * | | | | | | | | | | | | | | |

Fig. 5J

Weights W1-W8 calculation for RBs 592 596 593 594 597 595 597A 597B 597C 597D 597E

| | | | | | | | | | | | | | | |
|---|---|---|---|---|---|---|---|---|---|---|---|---|---|---|
| | | | | | | | Cor of ypg/yprr/ypt w/RTM Total:---> | | | 0.271 | 0.438 | 0.485 | 1.408 | <-- Mix |
| | | W1 | W2 | W7 | W6 | W8 | W3 | W4 | W5 | Mix = (0*ypg + 1*yprr + 2*ypt) | | | | |
| 0.991107 | Weights: | 0.164225412 | 0.011509395 | 0.26150821 | 0 | 0.457316542 | 0.011327658 | 0.079173616 | 0.00604608 | | | | | |
| Season | Player ID | mean_open_oe_rel | mean_adj_open_oe | mean_adj_catch_oe | mean_adj_catch_op | mean_yac_op | mean_open_oe_rel_man | mean_open_adj_oe_man | mean_double_oe | yds_per_game | YPRR | YPT | Position | RTM Total |
| 2019 | 21 | 0.958962361 | 0.76309905 | 1.566376817 | 1.296604135 | 1.94474789 | 1.653172713 | 0.539081321 | -0.38895687 | 61.2 | 3.34 | 12.71 | RB | 1.524 |
| 2021 | 22 | 1.035846344 | 1.751221198 | 3.245506708 | 2.654864679 | 0.337859574 | 0.354640096 | 0.30491578 | 1.695832599 | 49.0 | 3.50 | 10.39 | RB | 1.232 |
| 2019 | 23 | 0.075427502 | -0.850407686 | 0.330855475 | 0.535066579 | 2.134832944 | 0.289281014 | 0.467523769 | 0.080703421 | 33.0 | 2.17 | 13.54 | RB | 1.106 |
| 2021 | 24 | 0.698926494 | -0.749111049 | 0.870308653 | 1.411609237 | 1.766556971 | 0.796604809 | -1.066259162 | 0.220297051 | 34.3 | 2.65 | 9.96 | RB | 1.068 |
| 2021 | 25 | -1.790435363 | 0.483806606 | 1.97005329 | 1.760790619 | 1.204039776 | -0.302299023 | 3.363552806 | -0.27330666 | 17.4 | 1.94 | 10.10 | RB | 1.039 |
| 2020 | 26 | 0.49652204 | 0.674440271 | 1.254791167 | 1.483886489 | 0.861536466 | -0.042956522 | 2.188254563 | -0.27495886 | 38.8 | 2.37 | 12.93 | RB | 0.983 |
| 2019 | 27 | 0.182977039 | -1.127534 | 1.707488532 | 1.783581675 | 0.938780861 | 0.208953819 | -0.144483726 | 2.077444335 | 30.8 | 2.23 | 10.28 | RB | 0.896 |
| 2017 | 28 | 0.192500749 | 1.42083377 | 2.451559406 | 1.472538181 | 0.26224859 | -0.298295381 | 1.125589378 | -0.6028501 | 20.4 | 1.44 | 8.38 | RB | 0.891 |
| 2021 | 29 | 1.839656376 | 1.344640999 | 0.232823684 | -0.426183981 | 0.883191378 | 0.756227232 | 1.261442714 | -0.54882843 | 21.0 | 2.38 | 9.60 | RB | 0.887 |
| 2017 | 30 | 0.052662708 | -0.365050605 | 1.692258603 | 2.016074429 | 1.06509011 | -0.250265302 | -0.89857281 | 0.801938886 | 27.0 | 1.82 | 8.35 | RB | 0.865 |
| 2021 | 31 | -0.084135926 | 0.64157884 | -1.758439808 | -1.729826857 | 2.839863506 | 0.166950374 | 0.189293992 | 0.050016066 | 24.8 | 1.67 | 7.75 | RB | 0.850 |
| 2020 | 32 | 3.405569251 | 2.493416251 | 0.911149994 | -0.411458484 | -0.321459402 | 3.145488344 | 1.665053857 | -0.1208544 | 26.3 | 2.54 | 8.56 | RB | 0.846 |
| 2017 | 33 | -0.870724293 | -1.902930538 | -0.059727659 | 0.612565957 | 2.253608303 | 0.087197297 | -0.18162929 | 0.258366438 | 51.0 | 2.70 | 12.14 | RB | 0.838 |
| 2018 | 34 | -0.494717818 | 1.411623732 | 0.350721702 | 0.059221565 | 1.591041872 | 0.279119526 | 0.987865026 | -0.13763646 | 17.3 | 1.28 | 8.12 | RB | 0.835 |
| 2018 | 35 | 0.705591534 | 0.590654187 | 2.167945783 | 1.684575738 | -0.090221929 | 0.95566443 | 0.254892655 | 1.938549627 | 52.8 | 2.27 | 8.20 | RB | 0.691 |
| 2021 | 36 | 0.020718791 | 0.116697255 | 1.319866883 | 1.082125015 | 0.65411622 | -1.002827273 | 0.179670671 | -0.6494151 | 34.4 | 2.11 | 8.59 | RB | 0.648 |
| * * * | | | | | | | | | | | | | | |

640

Fig. 6E

WRs and TEs Metrics 2022 Season (Min. 48 targets)
Receiving Stats and RTMs scores (0-99 scale)

| | | | RECEIVING STATS | | | | RECEIVER RATINGS | | | |
|---|---|---|---|---|---|---|---|---|---|---|
| Rank | PLAYER | POS. | YDS | ROUTES | TGTS | YDS/RT | OPEN | CATCH | YAC | OVERALL |
| 1 | Player 1 | WR | 1,642 | 592 | 161 | 2.8 | 92 | 61 | 62 | 88 |
| 2 | Player 2 | WR | 1,858 | 667 | 184 | 2.8 | 81 | 81 | 50 | 85 |
| 3 | Player 3 | WR | 1,072 | 542 | 122 | 2.0 | 95 | 79 | 29 | 84 |
| 4 | Player 4 | WR | 1,578 | 619 | 161 | 2.5 | 83 | 81 | 43 | 83 |
| 5 | Player 5 | WR | 882 | 581 | 144 | 1.5 | 99 | 56 | 43 | 81 |
| 6 | Player 6 | TE | 929 | 446 | 91 | 2.1 | 70 | 79 | 53 | 79 |
| 7 | Player 7 | WR | 1,124 | 546 | 110 | 2.1 | 81 | 62 | 54 | 77 |
| 7 | Player 8 | WR | 1,177 | 616 | 133 | 1.9 | 67 | 83 | 50 | 77 |
| 7 | Player 9 | WR | 1,042 | 403 | 111 | 2.6 | 82 | 69 | 45 | 77 |
| 10 | Player 10 | WR | 1,779 | 547 | 171 | 3.3 | 85 | 63 | 42 | 75 |
| 10 | Player 11 | TE | 1,595 | 616 | 163 | 2.6 | 78 | 65 | 50 | 75 |
| 12 | Player 12 | WR | 1,544 | 599 | 159 | 2.6 | 85 | 55 | 49 | 74 |
| 12 | Player 13 | WR | 1,393 | 618 | 137 | 2.3 | 63 | 76 | 56 | 74 |

Fig. 6F

650

WR Metrics 2017-21 Seasons (Min. 250 targets)
Receiving Stats and RTMs raw scores (after weightings but before scaling to 0-99)

| Rank | Wide Receiver | Targets | Rec Yds | YPRoute | YPTarget | Overall | Open | Catch | YAC |
|---|---|---|---|---|---|---|---|---|---|
| 1 | Player 1 | 323 | 3,282 | 3.3 | 10.2 | 1.69 | 0.76 | 0.25 | 0.68 |
| 2 | Player 2 | 597 | 5,365 | 3.2 | 9.0 | 1.57 | 0.70 | 0.80 | 0.07 |
| 3 | Player 3 | 726 | 6,307 | 2.7 | 8.7 | 1.32 | 0.64 | 0.55 | 0.12 |
| 4 | Player 4 | 292 | 3,016 | 3.3 | 10.3 | 1.31 | 0.67 | 0.38 | 0.26 |
| 5 | Player 5 | 736 | 6,291 | 2.9 | 8.5 | 1.13 | 0.67 | 0.49 | -0.03 |
| 6 | Player 6 | 267 | 2,765 | 3.0 | 10.4 | 1.13 | 0.18 | -0.11 | 1.06 |
| 7 | Player 7 | 382 | 3,485 | 2.6 | 9.1 | 1.04 | 0.51 | 0.15 | 0.38 |
| 8 | Player 8 | 781 | 6,697 | 3.1 | 8.6 | 1.02 | 0.68 | 0.39 | -0.06 |
| 9 | Player 9 | 619 | 5,976 | 3.3 | 9.7 | 1.00 | 0.36 | 0.39 | 0.25 |
| 10 | Player 10 | 483 | 4,119 | 2.8 | 8.5 | 0.97 | 0.53 | 0.35 | 0.09 |
| 11 | Player 11 | 307 | 2,734 | 2.0 | 8.9 | 0.93 | 0.22 | 0.34 | 0.37 |
| 12 | Player 12 | 510 | 4,869 | 2.5 | 9.5 | 0.87 | 0.12 | 0.46 | 0.29 |
| 13 | Player 13 | 719 | 6,997 | 3.0 | 9.7 | 0.85 | 0.35 | 0.29 | 0.21 |
| 14 | Player 14 | 513 | 5,156 | 2.5 | 10.1 | 0.83 | 0.28 | 0.81 | -0.26 |
| 15 | Player 15 | 652 | 6,126 | 2.9 | 9.4 | 0.80 | 0.06 | 0.42 | 0.33 |
| 16 | Player 16 | 375 | 3,295 | 2.3 | 8.8 | 0.80 | 0.52 | 0.38 | -0.10 |
| 17 | Player 17 | 660 | 6,152 | 2.4 | 9.3 | 0.73 | 0.50 | 0.33 | -0.10 |
| 18 | Player 18 | 253 | 2,547 | 2.5 | 10.1 | 0.71 | 0.34 | 0.32 | 0.05 |
| 19 | Player 19 | 578 | 5,069 | 2.3 | 8.8 | 0.69 | 0.29 | 0.33 | 0.07 |
| 20 | Player 20 | 363 | 3,131 | 2.4 | 8.6 | 0.61 | 0.25 | 0.20 | 0.17 |

652

652

652

Fig. 6G

660

Best RTMs (Overall, Open, Catch, YAC) from 2017-2021

660A

Best Overall Seasons Since 2017

| Player | Position | Team | Season | Overall Score | Open Score | Catch Score | YAC Score |
|---|---|---|---|---|---|---|---|
| PLAYER 1 | WR | TEAM A | 2017 | 98 | 92 | 88 | 56 |
| PLAYER 2 | WR | TEAM B | 2018 | 96 | 80 | 94 | 60 |
| PLAYER 3 | WR | TEAM C | 2019 | 94 | 93 | 77 | 57 |
| PLAYER 4 | WR | TEAM D | 2017 | 93 | 89 | 87 | 50 |
| PLAYER 5 | WR | TEAM E | 2019 | 92 | 80 | 53 | 97 |
| PLAYER 6 | WR | TEAM F | 2020 | 91 | 84 | 84 | 55 |
| PLAYER 7 | WR | TEAM G | 2020 | 89 | 78 | 75 | 69 |
| PLAYER 8 | WR | TEAM H | 2020 | 88 | 99 | 61 | 46 |
| PLAYER 9 | WR | TEAM I | 2021 | 85 | 76 | 75 | 64 |
| PLAYER 10 | WR | TEAM J | 2017 | 85 | 87 | 78 | 46 |

660B

Best Open-Score Seasons Since 2017

| Player | Position | Team | Season | Open Score | Catch Score | YAC Score | Overall Score |
|---|---|---|---|---|---|---|---|
| PLAYER 11 | WR | TEAM A | 2020 | 99 | 61 | 46 | 88 |
| PLAYER 12 | WR | TEAM B | 2021 | 99 | 33 | 53 | 76 |
| PLAYER 13 | WR | TEAM C | 2021 | 94 | 53 | 51 | 80 |
| PLAYER 14 | WR | TEAM D | 2019 | 93 | 77 | 57 | 94 |
| PLAYER 15 | WR | TEAM E | 2021 | 93 | 52 | 46 | 77 |

Best Catch-Score Seasons Since 2017

| Player | Position | Team | Season | Catch Score | YAC Score | Open Score | Overall Score |
|---|---|---|---|---|---|---|---|
| PLAYER 16 | WR | TEAM A | 2018 | 94 | 60 | 80 | 96 |
| PLAYER 17 | WR | TEAM B | 2019 | 91 | 75 | 45 | 78 |
| PLAYER 18 | WR | TEAM C | 2017 | 90 | 51 | 37 | 62 |
| PLAYER 19 | TE | TEAM D | 2017 | 90 | 48 | 53 | 71 |
| PLAYER 20 | WR | TEAM E | 2017 | 88 | 56 | 92 | 98 |

660C

Best YAC-Score Seasons Since 2017

660D

| Player | Position | Team | Season | YAC Score | Open Score | Catch Score | Overall Score |
|---|---|---|---|---|---|---|---|
| PLAYER 16 | WR | TEAM A | 2021 | 99 | 48 | 31 | 61 |
| PLAYER 17 | WR | TEAM B | 2019 | 97 | 80 | 53 | 92 |
| PLAYER 18 | WR | TEAM C | 2021 | 84 | 61 | 64 | 79 |
| PLAYER 19 | WR | TEAM D | 2020 | 76 | 72 | 63 | 82 |
| PLAYER 20 | TE | TEAM E | 2018 | 76 | 66 | 26 | 60 |

670

Fig. 6H

Top 10 WRs and TEs for RTMs for 2021-2022 Season

| Top 10 "Open" Score: (for 2021-22, including post-season, with minimum 80 targets) | Top 10 "Catch" Score: (for 2021-2022, including post-season, with minimum 70 targets) | Top 10 "YAC" Score: (for 2021-2022, including post-season, with minimum 80 targets) |
|---|---|---|
| 1. PLAYER 1: 94 | 1. PLAYER 1: 91 | 1. PLAYER 1: 94 |
| 2. PLAYER 2: 92 | 2. PLAYER 2: 85 | 2. PLAYER 2: 82 |
| 3. PLAYER 3: 91 | 3. PLAYER 3: 83 | 3. PLAYER 3: 69 |
| 4. PLAYER 4: 89 | 4. PLAYER 4: 81 | 4. PLAYER 4: 66 |
| 5. PLAYER 5: 87 | 5. PLAYER 5: 79 | 5. PLAYER 5: 65 |
| 6. PLAYER 6: 86 | 6. PLAYER 6: 78 | 6. PLAYER 6: 64 |
| 7. PLAYER 7: 85 | 7. PLAYER 7: 76 | T-7. PLAYER 7: 62 |
| 8. PLAYER 8: 84 | 8. PLAYER 8: 75 | T-7. PLAYER 8: 62 |
| 9. PLAYER 9: 81 | T-9. PLAYER 9: 74 | T-7. PLAYER 9: 62 |
| 10. PLAYER 10: 80 | T-9. PLAYER 10: 74 | T-7. PLAYER 10: 62 |

680

Fig. 6I

Overall Score

682

| Top 10 WRs and TEs In Overall Score | | | | | |
|---|---|---|---|---|---|
| For 2021-2022, including postseason - Minimum 80 Targets | | | | | |
| Rank | Player | Overall Score | Open Score | Catch Score | YAC Score |
| 1 | PLAYER 1 | 85 | 87 | 74 | 49 |
| 2 | PLAYER 2 | 84 | 76 | 75 | 62 |
| 3 | PLAYER 3 | 81 | 77 | 85 | 43 |
| 4 | PLAYER 4 | 80 | 92 | 60 | 46 |
| T-5 | PLAYER 5 | 79 | 94 | 48 | 55 |
| T-5 | PLAYER 6 | 79 | 67 | 59 | 82 |
| 7 | PLAYER 7 | 77 | 84 | 62 | 50 |
| T-8 | PLAYER 8 | 76 | 89 | 52 | 51 |
| T-8 | PLAYER 9 | 76 | 67 | 69 | 62 |
| T-10 | PLAYER 10 | 75 | 91 | 55 | 43 |
| T-10 | PLAYER 11 | 75 | 85 | 61 | 43 |

684

| Top 10 WRs and TEs In Career Overall Score | | | | | |
|---|---|---|---|---|---|
| For 2017-2022, including postseasons -Minimum 100 Targets | | | | | |
| Rank | Player | Overall Score | Open Score | Catch Score | YAC Score |
| 1 | PLAYER 1 | 88 | 83 | 81 | 53 |
| 2 | PLAYER 2 | 83 | 82 | 55 | 73 |
| T-3 | PLAYER 3 | 81 | 85 | 61 | 59 |
| T-3 | PLAYER 4 | 81 | 79 | 72 | 54 |
| T-5 | PLAYER 5 | 79 | 75 | 76 | 50 |
| T-5 | PLAYER 6 | 79 | 67 | 59 | 82 |
| 7 | PLAYER 7 | 75 | 75 | 66 | 54 |
| T-8 | PLAYER 8 | 71 | 80 | 56 | 49 |
| T-8 | PLAYER 9 | 71 | 78 | 61 | 46 |
| T-8 | PLAYER 10 | 71 | 73 | 65 | 47 |

686

| Top 10 RBs In Overall Score | | | | | |
|---|---|---|---|---|---|
| For 2021-2022, including postseasons - Minimum 45 Targets | | | | | |
| Rank | Player | Overall Score | Open Score | Catch Score | YAC Score |
| 1 | PLAYER 1 | 80 | 49 | 65 | 77 |
| 2 | PLAYER 2 | 76 | 46 | 67 | 74 |
| T-3 | PLAYER 3 | 69 | 56 | 6 | 95 |
| T-3 | PLAYER 4 | 69 | 55 | 79 | 54 |
| 5 | PLAYER 5 | 62 | 44 | 53 | 65 |
| T-6 | PLAYER 6 | 61 | 52 | 34 | 71 |
| T-6 | PLAYER 7 | 61 | 71 | 61 | 48 |
| 8 | PLAYER 8 | 57 | 59 | 49 | 55 |
| 9 | PLAYER 9 | 55 | 53 | 65 | 46 |
| 10 | PLAYER 10 | 53 | 60 | 36 | 58 |

688

| Top 10 WRs and TEs In Overall Score | | | | | |
|---|---|---|---|---|---|
| For 2022 only – Minimum 12 Targets | | | | | |
| Rank | Player | Overall Score | Open Score | Catch Score | YAC Score |
| T-1 | PLAYER 1 | 73 | 91 | 58 | 35 |
| T-1 | PLAYER 2 | 73 | 84 | 71 | 31 |
| 3 | PLAYER 3 | 72 | 80 | 44 | 63 |
| T-4 | PLAYER 4 | 71 | 81 | 53 | 50 |
| T-4 | PLAYER 5 | 71 | 62 | 65 | 63 |
| 6 | PLAYER 6 | 70 | 82 | 57 | 43 |
| 7 | PLAYER 7 | 69 | 74 | 56 | 52 |
| T-8 | PLAYER 8 | 68 | 82 | 54 | 42 |
| T-8 | PLAYER 9 | 68 | 76 | 52 | 52 |
| T-8 | PLAYER 10 | 68 | 70 | 64 | 46 |

Fig. 6J

Sample yr-to-yr Correlation/Stability of RTMs

Sample correlation from one year to the next for WRs with > 40 targets in each:

690

| Metric | Stability |
|---|---|
| Getting_Open | 0.61 |
| Catch/Contest | 0.38 |
| YAC Creation | 0.35 |
| Overall | 0.52 |

Metrics positively correlate yr-to-yr, confirming that RTMs capture real, systematic qualities in receivers

Fig. 7A

700

Random Forest (RF) Classifier Model – Variables and Results & Labels

| Predictor Variable/ Result | Description | Units | Number of Poss Values | Example |
|---|---|---|---|---|
| route_max_depth | maximum depth of route from line of scrimmage | yds | na | 13.75 |
| t_release | time of pass release since snap | sec | na | 3.4 |
| dist_to_boundary | y distance (lateral) to nearest sideline | yds | na | 7.76 |
| route_class | type of pass route run by receiver (post, drag, curl, etc.) | factor | 32 | Wheel |
| coverage | defensive coverage type (cover-2, man-1, etc.) | factor | 10 | Man-1 |
| pa | 1 if play action used on play, 0 otherwise | na | 2 | 0 |
| los | yard line of line of scrimmage (dist to scoring td) | yds | na | 73.33 |
| down | play down (1...4) | factor | 4 | 1 |
| togo | yards to gain for a 1st down conversion | yds | na | 10 |
| position | where the receiver lined up (wide, slot, tight, backfield) | factor | 4 | Slot |
| y (pass_comp) | (**Result**) 1 if pass was caught, 0 otherwise (only for Training - targeted pass plays) | none | 2 | 0 |
| **Other Labels in Data:** | | | | |
| Game ID | Game ID (Year/Game) | na | na | 2017090700 |
| Play ID | Play ID (play being run) | na | na | 68 |
| Player ID | Player ID (player being tracked) | na | na | 2533046 |
| Target ID | Target Player ID (player being targeted for a pass) | na | na | 2533046 |
| jersey | Player jersey number | na | na | 87 |

710

Fig. 7B

Random Forest Classifier Model - Pass Routes

| Pass Route Name | Description |
|---|---|
| Angle | Short diagonal outward, followed by a diagonal cut inward. Typically run by a RB |
| Comeback | Intermediate to deep vertical stop route. Receiver plants, stops, and turns outwardly back to QB |
| Corner | Deep vertical route that breaks diagonally outward |
| Corner Post | Double-move route. Deep vertical route where receiver fakes an out cut but breaks diagonally inward |
| Cross-deep | Deep horizontal route that crosses from one side of the formation to the other |
| Cross-medium | Same as cross deep but intermediate depth |
| Curl | Intermediate to deep vertical stop route. Receiver plants, stops, and turns inwardly back to QB |
| Deep Out | Deep route where receiver breaks horizontally away from QB |
| Dig | Deep in route where receiver breaks horizontally toward QB |
| Drag | Shallow horizontal route from one side of formation to the other |
| Fade-deep | Deep vertical route that gently drifts toward sideline |
| Fade-short | Short diagonal route outward from Line of Scrimmage. More vertical than horizontal |
| Flat | Short diagonal route outward from Line of Scrimmage. More horizontal than vertical |
| Go | Deep vertical route on outside of formation. Does not break inward or outward |
| Hitch | Short stop route. Receiver runs vertically for several yards. Stops and turns to accept pass. |
| In | Short square in-breaking route |
| Leak | Receiver (typically from a tight alignment) crosses very shallowly across formation then often turns vertically up field |
| Out & Up | Receiver fakes a short out move, then turns vertically up-field |
| Post | Deep vertical route that breaks diagonally inward |
| Post Corner | Deep vertical route where receiver fakes an in-breaking move and cuts diagonally outward |
| RB Check | RB checks to see if he needs to block a blitzer. If not leaks through the Line of Scrimmage and turns for a short pass |
| Screen | Route that is designed to be caught behind the line of scrimmage |
| Seam | A deep vertical route from the inside of the formation, typically splitting between defenders within the structure of the coverage |
| Short Out | Short square out-breaking route |
| Sit | Short diagonal inward stop route. Receiver stops in center of formation in front of QB |
| Slant | Short diagonal inward route. Receiver catches pass on the run (as opposed to sit) |
| Slice | Deep inward diagonal route. More vertical than horizontal |
| Sluggo | Receiver fakes a slant route than breaks vertically into a go route |
| Smash | Receiver fakes an outward hitch or short out, then abruptly cuts horizontally inward |
| Swing | RB route that floats horizontally to outside the pass rushers and blockers |
| Wheel | Route from interior alignment (RB or tight, sometimes slot). Rounded patter that begins horizontally but bends vertically |
| Whip | Receiver fakes an inward hitch or short in, then abruptly cuts horizontally outward |

720

Fig. 7C

Random Forest Classifier Model - Defensive Coverages

| Coverage Name | Description |
|---|---|
| Man-0 | Man-to-man pass coverage with no deep safeties |
| Man-1 | Man-to-man pass coverage with 1 deep safety |
| Man-2 | Man-to-man pass coverage with two deep safeties |
| Goalline Man | Man-to-man pass coverage inside 10 yards of the end zone |
| Cover-2 | Zone coverage with 2 deep safeties, and typically 5 underneath defenders |
| Tampa-2 | Zone coverage with 2 deep safeties plus a 3rd deep middle defender (usually the middle linebacker), and typically 4 underneath defenders |
| Cover-3 | Zone coverage with 3 deep defenders (1 safety plus 2 cornerbacks dropping deep), and typically 4 or 3 underneath defenders |
| Cover-4 | Zone coverage with 4 defenders responsible for deep routes, plus 3 underneath defenders |
| Goalline Zone | Zone coverage within 10 yards of the end zone |
| Prevent | Multiple very deep defenders in pass coverage that would allow shorter passes but eliminate risk of deep passes |

Fig. 7D

730

Random Forest Classifier Model (tabular pass route input data) - Targeted Routes – Training Data

| Game ID | Play ID | Player ID | Target ID | dist_to_ boundary | pass_ comp | t_release | position | jersey | down | togo | los | route_max_depth | route_ class | Coverage_type | pa | expected_pred |
|---|---|---|---|---|---|---|---|---|---|---|---|---|---|---|---|---|
| 2017090700 | 68 | 2533046 | 2533046 | 7.76 | 0 | 3.4 | TE | 83 | 1 | 10 | 73.33 | 13.75 | Wheel | M1 | 0 | 0.633965085 |
| 2017090700 | 94 | 2539265 | 2539265 | 16.1 | 1 | 3.5 | RB | 34 | 2 | 10 | 73.1 | 1.21 | Flat | M1 | 0 | 0.625935741 |
| 2017090700 | 160 | 2543498 | 2543498 | 11.54 | 1 | 2.5 | WR | 14 | 2 | 7 | 53.71 | 16.39 | Fade-deep | M1 | 0 | 0.401233138 |
| 2017090700 | 210 | 2649 | 2649 | 13.38 | 1 | 2.1 | WR | 80 | 2 | 5 | 30 | 5.95 | Short Out | M1 | 0 | 0.815286372 |
| 2017090700 | 309 | 497240 | 497240 | 18.26 | 0 | 3.5 | TE | 87 | 1 | 2 | 2.09 | 9.39 | Leak | GM | 0 | 0.574637236 |
| 2017090700 | 427 | 497240 | 497240 | 18.26 | 0 | 3 | TE | 87 | 1 | 10 | 31.94 | 19.46 | Seam | M1 | 0 | 0.398933775 |
| 2017090700 | 449 | 2543773 | 2543773 | 13.97 | 1 | 2.1 | RB | 28 | 2 | 10 | 32 | 2.53 | Hitch | M1 | 0 | 0.816407348 |
| 2017090700 | 494 | 497240 | 497240 | 11.46 | 0 | 2.5 | TE | 87 | 1 | 10 | 19.06 | 16.24 | Fade-deep | M1 | 0 | 0.411470169 |
| 2017090700 | 629 | 2649 | 2649 | 24.99 | 1 | 1.6 | WR | 80 | 3 | 6 | 15.05 | 4.69 | Slant | M1 | 0 | 0.714672754 |
| 2017090700 | 724 | 2556214 | 2556214 | 26.16 | 1 | 2.8 | WR | 10 | 1 | 10 | 77.5 | 0.97 | Drag | M1 | 0 | 0.721654863 |
| 2017090700 | 748 | 2541187 | 2541187 | 5.08 | 1 | 3.5 | TE | 84 | 1 | 10 | 63.45 | 1.22 | Flat | C3 | 0 | 0.776177499 |
| 2017090700 | 777 | 2557917 | 2557917 | 13.91 | 1 | 2.1 | RB | 27 | 2 | 2 | 55.52 | -1.16 | Flat | M0 | 0 | 0.765914362 |
| 2017090700 | 846 | 2556214 | 2556214 | 17.42 | 1 | 3.2 | WR | 10 | 1 | 10 | 38.43 | 10.3 | Angle | M1 | 0 | 0.714484497 |
| 2017090700 | 870 | 2552652 | 2552652 | 21.01 | 1 | 2.8 | WR | 17 | 1 | 10 | 27.46 | 2.7 | Drag | M1 | 0 | 0.723005446 |
| 2017090700 | 938 | 2541187 | 2541187 | 15.42 | 1 | 2.8 | TE | 84 | 3 | 7 | 7.4 | 9.12 | Post | GM | 0 | 0.528359692 |
| 2017090700 | 1025 | 2649 | 2649 | 17.78 | 1 | 3.5 | WR | 80 | 2 | 7 | 72.06 | 19.4 | Post | M1 | 0 | 0.599607782 |
| 2017090700 | 1049 | 2543498 | 2543498 | 23.58 | 1 | 2.9 | WR | 14 | 1 | 10 | 45.02 | 1.79 | Drag | M1 | 0 | 0.807099264 |
| 2017090700 | 1130 | 2539265 | 2539265 | 6.48 | 0 | 2.3 | RB | 34 | 1 | 5 | 12.09 | 13.51 | Corner | M1 | 0 | 0.311678458 |
| 2017090700 | 1274 | 2554630 | 2554630 | 21.24 | 0 | 3.5 | TE | 43 | 1 | 10 | 54.93 | 12.51 | Cross-deep | M1 | 0 | 0.366461859 |
| * * * | | | | | | | | | | | | | | | | |

Fig. 7E

740

Random Forest Classifier Model (tabular pass route input data) - ALL Routes

| | Game ID | Play ID | Player ID | Target ID | dist_to_boundary | pass_comp | t_release | position | jersey | down | togo | los | route_max_depth | route_class | coverage type | pa | expected_pred |
|---|---|---|---|---|---|---|---|---|---|---|---|---|---|---|---|---|---|
| Play ID - 68 | 2017090700 | 68 | 497240 | 2533046 | 22.06 | 0 | 3.4 | TE | 87 | 1 | 10 | 73.33 | 8.14 | Cross-medium | M1 | 0 | 0.638878009 |
| | 2017090700 | 68 | 2530515 | 2533046 | 22.01 | 0 | 3.4 | WR | 15 | 1 | 10 | 73.33 | 25.23 | Post | M1 | 0 | 0.430339754 |
| | 2017090700 | 68 | 2533046 | 2533046 | 7.76 | 0 | 3.4 | TE | 83 | 1 | 10 | 73.33 | 13.75 | Wheel | M1 | 0 | 0.633965085 |
| | 2017090700 | 68 | 2539265 | 2533046 | 10.57 | 0 | 3.4 | RB | 34 | 1 | 10 | 73.33 | 1.07 | Flat | M1 | 0 | 0.564541488 |
| | 2017090700 | 68 | 2543498 | 2533046 | 11.26 | 0 | 3.4 | WR | 14 | 1 | 10 | 73.33 | 21.69 | Seam | M1 | 0 | 0.367390606 |
| Play ID - 94 | 2017090700 | 94 | 2649 | 2539265 | 7.67 | 1 | 3.5 | WR | 80 | 2 | 10 | 73.1 | 16.17 | Wheel | M1 | 0 | 0.426132666 |
| | 2017090700 | 94 | 497240 | 2539265 | 3.74 | 1 | 3.5 | TE | 87 | 2 | 10 | 73.1 | 9.52 | Wheel | M1 | 0 | 0.472831797 |
| | 2017090700 | 94 | 2530515 | 2539265 | 21.37 | 1 | 3.5 | WR | 15 | 2 | 10 | 73.1 | 14.04 | Dig | M1 | 0 | 0.579661083 |
| | 2017090700 | 94 | 2539265 | 2539265 | 16.1 | 1 | 3.5 | RB | 34 | 2 | 10 | 73.1 | 1.21 | Flat | M1 | 0 | 0.625935741 |
| | 2017090700 | 94 | 2543498 | 2539265 | 11.97 | 1 | 3.5 | WR | 14 | 2 | 10 | 73.1 | 8.39 | Hitch | M1 | 0 | 0.592208487 |
| Play ID -160 | 2017090700 | 160 | 2649 | 2543498 | 25.06 | 1 | 2.5 | WR | 80 | 2 | 7 | 53.71 | 6.27 | Sit | M1 | 0 | 0.652751617 |
| | 2017090700 | 160 | 497240 | 2543498 | 20.07 | 1 | 2.5 | TE | 87 | 2 | 7 | 53.71 | 20.68 | Seam | M1 | 0 | 0.423583089 |
| | 2017090700 | 160 | 2530515 | 2543498 | 8.24 | 1 | 2.5 | WR | 15 | 2 | 7 | 53.71 | 6.15 | Hitch | M1 | 0 | 0.725259349 |
| | 2017090700 | 160 | 2543498 | 2543498 | 11.54 | 1 | 2.5 | WR | 14 | 2 | 7 | 53.71 | 16.39 | Fade-deep | M1 | 0 | 0.401233138 |
| | 2017090700 | 160 | 2543773 | 2543498 | 6.06 | 1 | 2.5 | RB | 28 | 2 | 7 | 53.71 | 4.79 | Hitch | M1 | 0 | 0.71810168 |
| Play ID -210 | 2017090700 | 210 | 2649 | 2649 | 13.38 | 1 | 2.1 | WR | 80 | 2 | 5 | 30 | 5.95 | Short Out | M1 | 0 | 0.815286372 |
| | 2017090700 | 210 | 497240 | 2649 | 15.93 | 1 | 2.1 | TE | 87 | 2 | 5 | 30 | -0.4 | Swing | M1 | 0 | 0.820728562 |
| | 2017090700 | 210 | 2530515 | 2649 | 11.03 | 1 | 2.1 | WR | 15 | 2 | 5 | 30 | 0.46 | Swing | M1 | 0 | 0.81210439 |
| | 2017090700 | 210 | 2543498 | 2649 | 4.7 | 1 | 2.1 | WR | 14 | 2 | 5 | 30 | 11.43 | Fade-deep | M1 | 0 | 0.379407651 |
| | * * * | | | | | | | | | | | | | | | | |

Fig. 8A

800

Convolutional Neural Network (CNN) Model – Variables (using PTD) and Result (Catch/No-Catch)

| Variable/ Result (y) | Description | Dimensions | Units |
|---|---|---|---|
| off_def_x | difference between each offense player's x location and each defense player's x location | 11x10 matrix | yds |
| off_def_y | difference between each offense player's y location and each defense player's y location | 11x10 matrix | yds |
| off_def_Vx | difference between each offense player's x velocity and each defense player's x velocity | 11x10 matrix | yds/sec |
| off_def_Vy | difference between each offense player's y velocity and each defense player's y velocity | 11x10 matrix | yds/sec |
| def_Vx_raw | each defender's x velocity | 11-element vector | yds/sec |
| def_Vy_raw | each defender's y velocity | 11-element vector | yds/sec |
| def_Vx | defender x velocity relative to the receiver's x velocity | 11-element vector | yds/sec |
| def_Vy | defender y velocity relative to the receiver's y velocity | 11-element vector | yds/sec |
| def_x | defender x location relative to the receiver's x location | 11-element vector | yds |
| def_y | defender y location relative to the receiver's y location | 11-element vector | yds |
| rec_x | receiver's x position | single value | yds |
| rec_y | receiver's y position | single value | yds |
| rec_Vx | receiver's x velocity | single value | yds/sec |
| rec_Vy | receiver's y velocity | single value | yds/sec |
| qb_s | quarterback's scalar velocity at release | single value | yds/sec |
| qb_rec_dist | scalar distance between quarterback and receiver | single value | yds |
| Y (pass_comp) | (**Result**) 1 if pass was caught, 0 otherwise (only for Training - targeted pass plays) | single value | none |

810

Fig. 8B

| 1 | off_def_x | | | | Sample Input PTD Training Data (11x10) | | | | | |
|---|---|---|---|---|---|---|---|---|---|---|
| D/O | 1 | 2 | 3 | 4 | 5 | 6 | 7 | 8 | 9 | 10 |
| 1 | 26.35 | 30.94 | 31.2 | 33.7 | 13.8 | 23.51 | 12.76 | 30.34 | 29.33 | 32.1 |
| 2 | -5.34 | -0.75 | -0.49 | 2.01 | -17.89 | -8.18 | -18.93 | -1.35 | -2.36 | 0.41 |
| 3 | 9.21 | 13.8 | 14.06 | 16.56 | -3.34 | 6.37 | -4.38 | 13.2 | 12.19 | 14.96 |
| 4 | 16.85 | 21.44 | 21.7 | 24.2 | 4.3 | 14.01 | 3.26 | 20.84 | 19.83 | 22.6 |
| 5 | -3.81 | 0.78 | 1.04 | 3.54 | -16.36 | -6.65 | -17.4 | 0.18 | -0.83 | 1.94 |
| 6 | -5.29 | -0.7 | -0.44 | 2.06 | -17.84 | -8.13 | -18.88 | -1.3 | -2.31 | 0.46 |
| 7 | 14.11 | 18.7 | 18.96 | 21.46 | 1.56 | 11.27 | 0.52 | 18.1 | 17.09 | 19.86 |
| 8 | 4.12 | 8.71 | 8.97 | 11.47 | -8.43 | 1.28 | -9.47 | 8.11 | 7.1 | 9.87 |
| 9 | 6.46 | 11.05 | 11.31 | 13.81 | -6.09 | 3.62 | -7.13 | 10.45 | 9.44 | 12.21 |
| 10 | 17.75 | 22.34 | 22.6 | 25.1 | 5.2 | 14.91 | 4.16 | 21.74 | 20.73 | 23.5 |
| 11 | -4.9 | -0.31 | -0.05 | 2.45 | -17.45 | -7.74 | -18.49 | -0.91 | -1.92 | 0.85 |

812

Fig. 8C

| 2 | off_def_y | | | | Sample Input PTD Training Data (11x10) | | | | | |
|---|---|---|---|---|---|---|---|---|---|---|
| D/O | 1 | 2 | 3 | 4 | 5 | 6 | 7 | 8 | 9 | 10 |
| 1 | 18.27 | 11.18 | 4.14 | 7.9 | 28.2 | 0.48 | -18.33 | 9.51 | 9.76 | 7.02 |
| 2 | 6.66 | -0.43 | -7.47 | -3.71 | 16.59 | -11.13 | -29.94 | -2.1 | -1.85 | -4.59 |
| 3 | 9.1 | 2.01 | -5.03 | -1.27 | 19.03 | -8.69 | -27.5 | 0.34 | 0.59 | -2.15 |
| 4 | 1.07 | -6.02 | -13.06 | -9.3 | 11 | -16.72 | -35.53 | -7.69 | -7.44 | -10.18 |
| 5 | 8.08 | 0.99 | -6.05 | -2.29 | 18.01 | -9.71 | -28.52 | -0.68 | -0.43 | -3.17 |
| 6 | 14.82 | 7.73 | 0.69 | 4.45 | 24.75 | -2.97 | -21.78 | 6.06 | 6.31 | 3.57 |
| 7 | 35.67 | 28.58 | 21.54 | 25.3 | 45.6 | 17.88 | -0.93 | 26.91 | 27.16 | 24.42 |
| 8 | -2.22 | -9.31 | -16.35 | -12.59 | 7.71 | -20.01 | -38.82 | -10.98 | -10.73 | -13.47 |
| 9 | 19.33 | 12.24 | 5.2 | 8.96 | 29.26 | 1.54 | -17.27 | 10.57 | 10.82 | 8.08 |
| 10 | -8.92 | -16.01 | -23.05 | -19.29 | 1.01 | -26.71 | -45.52 | -17.68 | -17.43 | -20.17 |
| 11 | 11.29 | 4.2 | -2.84 | 0.92 | 21.22 | -6.5 | -25.31 | 2.53 | 2.78 | 0.04 |

814

Fig. 8D

| 3 | off_def_Vx | | | | Sample Input PTD Training Data (11x10) | | | | | |
|---|---|---|---|---|---|---|---|---|---|---|
| D/O | 1 | 2 | 3 | 4 | 5 | 6 | 7 | 8 | 9 | 10 |
| 1 | 3.07 | 6.15 | 5.61 | 3.57 | -1.93 | 1.32 | -0.85 | 5.90 | 5.87 | 5.58 |
| 2 | -4.07 | -1.00 | -1.53 | -3.58 | -9.08 | -5.82 | -8.00 | -1.24 | -1.27 | -1.56 |
| 3 | 0.23 | 3.31 | 2.77 | 0.73 | -4.78 | -1.52 | -3.70 | 3.06 | 3.03 | 2.74 |
| 4 | 4.75 | 7.82 | 7.29 | 5.24 | -0.26 | 3.00 | 0.82 | 7.58 | 7.55 | 7.26 |
| 5 | -3.45 | -0.37 | -0.91 | -2.95 | -8.46 | -5.20 | -7.38 | -0.62 | -0.65 | -0.94 |
| 6 | -3.59 | -0.51 | -1.05 | -3.09 | -8.59 | -5.34 | -7.51 | -0.76 | -0.79 | -1.08 |
| 7 | 4.30 | 7.37 | 6.84 | 4.79 | -0.71 | 2.54 | 0.37 | 7.12 | 7.10 | 6.80 |
| 8 | 0.71 | 3.78 | 3.25 | 1.20 | -4.30 | -1.05 | -3.22 | 3.53 | 3.50 | 3.21 |
| 9 | -0.66 | 2.41 | 1.88 | -0.17 | -5.67 | -2.41 | -4.59 | 2.16 | 2.14 | 1.85 |
| 10 | 3.99 | 7.07 | 6.53 | 4.49 | -1.01 | 2.24 | 0.07 | 6.82 | 6.79 | 6.50 |
| 11 | -2.51 | 0.56 | 0.03 | -2.02 | -7.52 | -4.27 | -6.44 | 0.31 | 0.28 | -0.01 |

816

Fig. 8E

| 4 | off_def_Vy | | | | Sample Input PTD Training Data (11x10) | | | | | |
|---|---|---|---|---|---|---|---|---|---|---|
| D/O | 1 | 2 | 3 | 4 | 5 | 6 | 7 | 8 | 9 | 10 |
| 1 | 2.33 | -0.55 | -0.72 | -0.29 | 3.51 | -4.29 | -1.88 | 0.34 | 0.87 | 0.44 |
| 2 | 4.50 | 1.62 | 1.45 | 1.88 | 5.68 | -2.12 | 0.29 | 2.51 | 3.04 | 2.61 |
| 3 | 2.22 | -0.66 | -0.83 | -0.40 | 3.39 | -4.40 | -1.99 | 0.23 | 0.76 | 0.33 |
| 4 | 2.56 | -0.32 | -0.49 | -0.06 | 3.74 | -4.06 | -1.65 | 0.57 | 1.10 | 0.67 |
| 5 | 1.21 | -1.67 | -1.84 | -1.41 | 2.38 | -5.41 | -3.00 | -0.78 | -0.25 | -0.68 |
| 6 | 2.44 | -0.44 | -0.61 | -0.18 | 3.62 | -4.18 | -1.76 | 0.46 | 0.98 | 0.55 |
| 7 | 4.30 | 1.41 | 1.25 | 1.68 | 5.47 | -2.32 | 0.09 | 2.31 | 2.84 | 2.40 |
| 8 | 0.65 | -2.24 | -2.40 | -1.97 | 1.82 | -5.97 | -3.56 | -1.34 | -0.82 | -1.25 |
| 9 | 5.21 | 2.33 | 2.16 | 2.59 | 6.39 | -1.41 | 1.00 | 3.22 | 3.75 | 3.32 |
| 10 | -0.30 | -3.19 | -3.35 | -2.92 | 0.87 | -6.92 | -4.51 | -2.29 | -1.77 | -2.20 |
| 11 | 1.50 | -1.38 | -1.55 | -1.12 | 2.67 | -5.12 | -2.71 | -0.49 | 0.04 | -0.39 |

818

Fig. 8F

| 5 | def_Vx_raw | | | Sample Input PTD Training Data (11x10) | | | | | | |
|---|---|---|---|---|---|---|---|---|---|---|
| Def | | | | | | | | | | |
| 1 | -3.65 | -3.65 | -3.65 | -3.65 | -3.65 | -3.65 | -3.65 | -3.65 | -3.65 | -3.65 |
| 2 | -4.57 | -4.57 | -4.57 | -4.57 | -4.57 | -4.57 | -4.57 | -4.57 | -4.57 | -4.57 |
| 3 | 1.94 | 1.94 | 1.94 | 1.94 | 1.94 | 1.94 | 1.94 | 1.94 | 1.94 | 1.94 |
| 4 | 3.49 | 3.49 | 3.49 | 3.49 | 3.49 | 3.49 | 3.49 | 3.49 | 3.49 | 3.49 |
| 5 | -0.81 | -0.81 | -0.81 | -0.81 | -0.81 | -0.81 | -0.81 | -0.81 | -0.81 | -0.81 |
| 6 | -5.32 | -5.32 | -5.32 | -5.32 | -5.32 | -5.32 | -5.32 | -5.32 | -5.32 | -5.32 |
| 7 | 2.87 | 2.87 | 2.87 | 2.87 | 2.87 | 2.87 | 2.87 | 2.87 | 2.87 | 2.87 |
| 8 | 3.01 | 3.01 | 3.01 | 3.01 | 3.01 | 3.01 | 3.01 | 3.01 | 3.01 | 3.01 |
| 9 | -4.87 | -4.87 | -4.87 | -4.87 | -4.87 | -4.87 | -4.87 | -4.87 | -4.87 | -4.87 |
| 10 | -1.28 | -1.28 | -1.28 | -1.28 | -1.28 | -1.28 | -1.28 | -1.28 | -1.28 | -1.28 |
| 11 | 0.09 | 0.09 | 0.09 | 0.09 | 0.09 | 0.09 | 0.09 | 0.09 | 0.09 | 0.09 |

820

Fig. 8G

| 6 | def_Vy_raw | | | Sample Input PTD Training Data (11x10) | | | | | | |
|---|---|---|---|---|---|---|---|---|---|---|
| Def | | | | | | | | | | |
| 1 | 0.46 | 0.46 | 0.46 | 0.46 | 0.46 | 0.46 | 0.46 | 0.46 | 0.46 | 0.46 |
| 2 | 3.10 | 3.10 | 3.10 | 3.10 | 3.10 | 3.10 | 3.10 | 3.10 | 3.10 | 3.10 |
| 3 | 1.29 | 1.29 | 1.29 | 1.29 | 1.29 | 1.29 | 1.29 | 1.29 | 1.29 | 1.29 |
| 4 | -1.71 | -1.71 | -1.71 | -1.71 | -1.71 | -1.71 | -1.71 | -1.71 | -1.71 | -1.71 |
| 5 | 0.57 | 0.57 | 0.57 | 0.57 | 0.57 | 0.57 | 0.57 | 0.57 | 0.57 | 0.57 |
| 6 | 0.23 | 0.23 | 0.23 | 0.23 | 0.23 | 0.23 | 0.23 | 0.23 | 0.23 | 0.23 |
| 7 | 1.58 | 1.58 | 1.58 | 1.58 | 1.58 | 1.58 | 1.58 | 1.58 | 1.58 | 1.58 |
| 8 | 0.35 | 0.35 | 0.35 | 0.35 | 0.35 | 0.35 | 0.35 | 0.35 | 0.35 | 0.35 |
| 9 | -1.50 | -1.50 | -1.50 | -1.50 | -1.50 | -1.50 | -1.50 | -1.50 | -1.50 | -1.50 |
| 10 | 2.15 | 2.15 | 2.15 | 2.15 | 2.15 | 2.15 | 2.15 | 2.15 | 2.15 | 2.15 |
| 11 | -2.42 | -2.42 | -2.42 | -2.42 | -2.42 | -2.42 | -2.42 | -2.42 | -2.42 | -2.42 |

822

Fig. 8H

| 7 | def_Vx | | | Sample Input PTD Training Data (11x10) | | | | | | |
|---|---|---|---|---|---|---|---|---|---|---|
| Def | | | | | | | | | | |
| 1 | 2.97 | 2.97 | 2.97 | 2.97 | 2.97 | 2.97 | 2.97 | 2.97 | 2.97 | 2.97 |
| 2 | 2.05 | 2.05 | 2.05 | 2.05 | 2.05 | 2.05 | 2.05 | 2.05 | 2.05 | 2.05 |
| 3 | 8.56 | 8.56 | 8.56 | 8.56 | 8.56 | 8.56 | 8.56 | 8.56 | 8.56 | 8.56 |
| 4 | 10.12 | 10.12 | 10.12 | 10.12 | 10.12 | 10.12 | 10.12 | 10.12 | 10.12 | 10.12 |
| 5 | 5.82 | 5.82 | 5.82 | 5.82 | 5.82 | 5.82 | 5.82 | 5.82 | 5.82 | 5.82 |
| 6 | 1.30 | 1.30 | 1.30 | 1.30 | 1.30 | 1.30 | 1.30 | 1.30 | 1.30 | 1.30 |
| 7 | 9.50 | 9.50 | 9.50 | 9.50 | 9.50 | 9.50 | 9.50 | 9.50 | 9.50 | 9.50 |
| 8 | 9.63 | 9.63 | 9.63 | 9.63 | 9.63 | 9.63 | 9.63 | 9.63 | 9.63 | 9.63 |
| 9 | 1.75 | 1.75 | 1.75 | 1.75 | 1.75 | 1.75 | 1.75 | 1.75 | 1.75 | 1.75 |
| 10 | 5.34 | 5.34 | 5.34 | 5.34 | 5.34 | 5.34 | 5.34 | 5.34 | 5.34 | 5.34 |
| 11 | 6.71 | 6.71 | 6.71 | 6.71 | 6.71 | 6.71 | 6.71 | 6.71 | 6.71 | 6.71 |

824

Fig. 8I

| 8 | def_Vy | | | Sample Input PTD Training Data (11x10) | | | | | | |
|---|---|---|---|---|---|---|---|---|---|---|
| Def | | | | | | | | | | |
| 1 | 2.08 | 2.08 | 2.08 | 2.08 | 2.08 | 2.08 | 2.08 | 2.08 | 2.08 | 2.08 |
| 2 | 4.72 | 4.72 | 4.72 | 4.72 | 4.72 | 4.72 | 4.72 | 4.72 | 4.72 | 4.72 |
| 3 | 2.92 | 2.92 | 2.92 | 2.92 | 2.92 | 2.92 | 2.92 | 2.92 | 2.92 | 2.92 |
| 4 | -0.09 | -0.09 | -0.09 | -0.09 | -0.09 | -0.09 | -0.09 | -0.09 | -0.09 | -0.09 |
| 5 | 2.20 | 2.20 | 2.20 | 2.20 | 2.20 | 2.20 | 2.20 | 2.20 | 2.20 | 2.20 |
| 6 | 1.85 | 1.85 | 1.85 | 1.85 | 1.85 | 1.85 | 1.85 | 1.85 | 1.85 | 1.85 |
| 7 | 3.21 | 3.21 | 3.21 | 3.21 | 3.21 | 3.21 | 3.21 | 3.21 | 3.21 | 3.21 |
| 8 | 1.97 | 1.97 | 1.97 | 1.97 | 1.97 | 1.97 | 1.97 | 1.97 | 1.97 | 1.97 |
| 9 | 0.12 | 0.12 | 0.12 | 0.12 | 0.12 | 0.12 | 0.12 | 0.12 | 0.12 | 0.12 |
| 10 | 3.77 | 3.77 | 3.77 | 3.77 | 3.77 | 3.77 | 3.77 | 3.77 | 3.77 | 3.77 |
| 11 | -0.80 | -0.80 | -0.80 | -0.80 | -0.80 | -0.80 | -0.80 | -0.80 | -0.80 | -0.80 |

826

Fig. 8J

| 9 | def_x | | | | Sample Input PTD Training Data (11x10) | | | | | |
|---|---|---|---|---|---|---|---|---|---|---|
| Def | | | | | | | | | | |
| 1 | -10.25 | -10.25 | -10.25 | -10.25 | -10.25 | -10.25 | -10.25 | -10.25 | -10.25 | -10.25 |
| 2 | -1.65 | -1.65 | -1.65 | -1.65 | -1.65 | -1.65 | -1.65 | -1.65 | -1.65 | -1.65 |
| 3 | 21 | 21 | 21 | 21 | 21 | 21 | 21 | 21 | 21 | 21 |
| 4 | 21.44 | 21.44 | 21.44 | 21.44 | 21.44 | 21.44 | 21.44 | 21.44 | 21.44 | 21.44 |
| 5 | 6.89 | 6.89 | 6.89 | 6.89 | 6.89 | 6.89 | 6.89 | 6.89 | 6.89 | 6.89 |
| 6 | -0.75 | -0.75 | -0.75 | -0.75 | -0.75 | -0.75 | -0.75 | -0.75 | -0.75 | -0.75 |
| 7 | 19.91 | 19.91 | 19.91 | 19.91 | 19.91 | 19.91 | 19.91 | 19.91 | 19.91 | 19.91 |
| 8 | 21.39 | 21.39 | 21.39 | 21.39 | 21.39 | 21.39 | 21.39 | 21.39 | 21.39 | 21.39 |
| 9 | 1.99 | 1.99 | 1.99 | 1.99 | 1.99 | 1.99 | 1.99 | 1.99 | 1.99 | 1.99 |
| 10 | 11.98 | 11.98 | 11.98 | 11.98 | 11.98 | 11.98 | 11.98 | 11.98 | 11.98 | 11.98 |
| 11 | 9.64 | 9.64 | 9.64 | 9.64 | 9.64 | 9.64 | 9.64 | 9.64 | 9.64 | 9.64 |

828

Fig. 8K

| 10 | def_y | | | | Sample Input PTD Training Data (11x10) | | | | | |
|---|---|---|---|---|---|---|---|---|---|---|
| Def | | | | | | | | | | |
| 1 | -15.65 | -15.65 | -15.65 | -15.65 | -15.65 | -15.65 | -15.65 | -15.65 | -15.65 | -15.65 |
| 2 | 11.54 | 11.54 | 11.54 | 11.54 | 11.54 | 11.54 | 11.54 | 11.54 | 11.54 | 11.54 |
| 3 | -8.67 | -8.67 | -8.67 | -8.67 | -8.67 | -8.67 | -8.67 | -8.67 | -8.67 | -8.67 |
| 4 | -4.04 | -4.04 | -4.04 | -4.04 | -4.04 | -4.04 | -4.04 | -4.04 | -4.04 | -4.04 |
| 5 | -6.48 | -6.48 | -6.48 | -6.48 | -6.48 | -6.48 | -6.48 | -6.48 | -6.48 | -6.48 |
| 6 | 1.55 | 1.55 | 1.55 | 1.55 | 1.55 | 1.55 | 1.55 | 1.55 | 1.55 | 1.55 |
| 7 | -5.46 | -5.46 | -5.46 | -5.46 | -5.46 | -5.46 | -5.46 | -5.46 | -5.46 | -5.46 |
| 8 | -12.2 | -12.2 | -12.2 | -12.2 | -12.2 | -12.2 | -12.2 | -12.2 | -12.2 | -12.2 |
| 9 | -33.05 | -33.05 | -33.05 | -33.05 | -33.05 | -33.05 | -33.05 | -33.05 | -33.05 | -33.05 |
| 10 | 4.84 | 4.84 | 4.84 | 4.84 | 4.84 | 4.84 | 4.84 | 4.84 | 4.84 | 4.84 |
| 11 | -16.71 | -16.71 | -16.71 | -16.71 | -16.71 | -16.71 | -16.71 | -16.71 | -16.71 | -16.71 |

830

Fig. 8L

| 11 | rec_x | | | | Sample Input PTD Training Data (11x10) | | | | | |
|---|---|---|---|---|---|---|---|---|---|---|
| Rec | | | | | | | | | | |
| 1 | 5.717 | 5.717 | 5.717 | 5.717 | 5.717 | 5.717 | 5.717 | 5.717 | 5.717 | 5.717 |
| 2 | 5.717 | 5.717 | 5.717 | 5.717 | 5.717 | 5.717 | 5.717 | 5.717 | 5.717 | 5.717 |
| 3 | 5.717 | 5.717 | 5.717 | 5.717 | 5.717 | 5.717 | 5.717 | 5.717 | 5.717 | 5.717 |
| 4 | 5.717 | 5.717 | 5.717 | 5.717 | 5.717 | 5.717 | 5.717 | 5.717 | 5.717 | 5.717 |
| 5 | 5.717 | 5.717 | 5.717 | 5.717 | 5.717 | 5.717 | 5.717 | 5.717 | 5.717 | 5.717 |
| 6 | 5.717 | 5.717 | 5.717 | 5.717 | 5.717 | 5.717 | 5.717 | 5.717 | 5.717 | 5.717 |
| 7 | 5.717 | 5.717 | 5.717 | 5.717 | 5.717 | 5.717 | 5.717 | 5.717 | 5.717 | 5.717 |
| 8 | 5.717 | 5.717 | 5.717 | 5.717 | 5.717 | 5.717 | 5.717 | 5.717 | 5.717 | 5.717 |
| 9 | 5.717 | 5.717 | 5.717 | 5.717 | 5.717 | 5.717 | 5.717 | 5.717 | 5.717 | 5.717 |
| 10 | 5.717 | 5.717 | 5.717 | 5.717 | 5.717 | 5.717 | 5.717 | 5.717 | 5.717 | 5.717 |
| 11 | 5.717 | 5.717 | 5.717 | 5.717 | 5.717 | 5.717 | 5.717 | 5.717 | 5.717 | 5.717 |

832

Fig. 8M

| 12 | rec_y | | | | Sample Input PTD Training Data (11x10) | | | | | |
|---|---|---|---|---|---|---|---|---|---|---|
| Rec | | | | | | | | | | |
| 1 | 3.55 | 3.55 | 3.55 | 3.55 | 3.55 | 3.55 | 3.55 | 3.55 | 3.55 | 3.55 |
| 2 | 3.55 | 3.55 | 3.55 | 3.55 | 3.55 | 3.55 | 3.55 | 3.55 | 3.55 | 3.55 |
| 3 | 3.55 | 3.55 | 3.55 | 3.55 | 3.55 | 3.55 | 3.55 | 3.55 | 3.55 | 3.55 |
| 4 | 3.55 | 3.55 | 3.55 | 3.55 | 3.55 | 3.55 | 3.55 | 3.55 | 3.55 | 3.55 |
| 5 | 3.55 | 3.55 | 3.55 | 3.55 | 3.55 | 3.55 | 3.55 | 3.55 | 3.55 | 3.55 |
| 6 | 3.55 | 3.55 | 3.55 | 3.55 | 3.55 | 3.55 | 3.55 | 3.55 | 3.55 | 3.55 |
| 7 | 3.55 | 3.55 | 3.55 | 3.55 | 3.55 | 3.55 | 3.55 | 3.55 | 3.55 | 3.55 |
| 8 | 3.55 | 3.55 | 3.55 | 3.55 | 3.55 | 3.55 | 3.55 | 3.55 | 3.55 | 3.55 |
| 9 | 3.55 | 3.55 | 3.55 | 3.55 | 3.55 | 3.55 | 3.55 | 3.55 | 3.55 | 3.55 |
| 10 | 3.55 | 3.55 | 3.55 | 3.55 | 3.55 | 3.55 | 3.55 | 3.55 | 3.55 | 3.55 |
| 11 | 3.55 | 3.55 | 3.55 | 3.55 | 3.55 | 3.55 | 3.55 | 3.55 | 3.55 | 3.55 |

834

Fig. 8N

| 13 | rec_Vx | | | | Sample Input PTD Training Data (11x10) | | | | | |
|---|---|---|---|---|---|---|---|---|---|---|
| Rec | | | | | | | | | | |
| 1 | -6.62 | -6.62 | -6.62 | -6.62 | -6.62 | -6.62 | -6.62 | -6.62 | -6.62 | -6.62 |
| 2 | -6.62 | -6.62 | -6.62 | -6.62 | -6.62 | -6.62 | -6.62 | -6.62 | -6.62 | -6.62 |
| 3 | -6.62 | -6.62 | -6.62 | -6.62 | -6.62 | -6.62 | -6.62 | -6.62 | -6.62 | -6.62 |
| 4 | -6.62 | -6.62 | -6.62 | -6.62 | -6.62 | -6.62 | -6.62 | -6.62 | -6.62 | -6.62 |
| 5 | -6.62 | -6.62 | -6.62 | -6.62 | -6.62 | -6.62 | -6.62 | -6.62 | -6.62 | -6.62 |
| 6 | -6.62 | -6.62 | -6.62 | -6.62 | -6.62 | -6.62 | -6.62 | -6.62 | -6.62 | -6.62 |
| 7 | -6.62 | -6.62 | -6.62 | -6.62 | -6.62 | -6.62 | -6.62 | -6.62 | -6.62 | -6.62 |
| 8 | -6.62 | -6.62 | -6.62 | -6.62 | -6.62 | -6.62 | -6.62 | -6.62 | -6.62 | -6.62 |
| 9 | -6.62 | -6.62 | -6.62 | -6.62 | -6.62 | -6.62 | -6.62 | -6.62 | -6.62 | -6.62 |
| 10 | -6.62 | -6.62 | -6.62 | -6.62 | -6.62 | -6.62 | -6.62 | -6.62 | -6.62 | -6.62 |
| 11 | -6.62 | -6.62 | -6.62 | -6.62 | -6.62 | -6.62 | -6.62 | -6.62 | -6.62 | -6.62 |

836

Fig. 8O

| 14 | rec_Vy | | | | Sample Input PTD Training Data (11x10) | | | | | |
|---|---|---|---|---|---|---|---|---|---|---|
| Rec | | | | | | | | | | |
| 1 | -1.62 | -1.62 | -1.62 | -1.62 | -1.62 | -1.62 | -1.62 | -1.62 | -1.62 | -1.62 |
| 2 | -1.62 | -1.62 | -1.62 | -1.62 | -1.62 | -1.62 | -1.62 | -1.62 | -1.62 | -1.62 |
| 3 | -1.62 | -1.62 | -1.62 | -1.62 | -1.62 | -1.62 | -1.62 | -1.62 | -1.62 | -1.62 |
| 4 | -1.62 | -1.62 | -1.62 | -1.62 | -1.62 | -1.62 | -1.62 | -1.62 | -1.62 | -1.62 |
| 5 | -1.62 | -1.62 | -1.62 | -1.62 | -1.62 | -1.62 | -1.62 | -1.62 | -1.62 | -1.62 |
| 6 | -1.62 | -1.62 | -1.62 | -1.62 | -1.62 | -1.62 | -1.62 | -1.62 | -1.62 | -1.62 |
| 7 | -1.62 | -1.62 | -1.62 | -1.62 | -1.62 | -1.62 | -1.62 | -1.62 | -1.62 | -1.62 |
| 8 | -1.62 | -1.62 | -1.62 | -1.62 | -1.62 | -1.62 | -1.62 | -1.62 | -1.62 | -1.62 |
| 9 | -1.62 | -1.62 | -1.62 | -1.62 | -1.62 | -1.62 | -1.62 | -1.62 | -1.62 | -1.62 |
| 10 | -1.62 | -1.62 | -1.62 | -1.62 | -1.62 | -1.62 | -1.62 | -1.62 | -1.62 | -1.62 |
| 11 | -1.62 | -1.62 | -1.62 | -1.62 | -1.62 | -1.62 | -1.62 | -1.62 | -1.62 | -1.62 |

838

Fig. 8P

| 15 | qb_s | | | | Sample Input PTD Training Data (11x10) | | | | | |
|---|---|---|---|---|---|---|---|---|---|---|
| | | | | | | | | | | |
| 0.19 | 0.19 | 0.19 | 0.19 | 0.19 | 0.19 | 0.19 | 0.19 | 0.19 | 0.19 |
| 0.19 | 0.19 | 0.19 | 0.19 | 0.19 | 0.19 | 0.19 | 0.19 | 0.19 | 0.19 |
| 0.19 | 0.19 | 0.19 | 0.19 | 0.19 | 0.19 | 0.19 | 0.19 | 0.19 | 0.19 |
| 0.19 | 0.19 | 0.19 | 0.19 | 0.19 | 0.19 | 0.19 | 0.19 | 0.19 | 0.19 |
| 0.19 | 0.19 | 0.19 | 0.19 | 0.19 | 0.19 | 0.19 | 0.19 | 0.19 | 0.19 |
| 0.19 | 0.19 | 0.19 | 0.19 | 0.19 | 0.19 | 0.19 | 0.19 | 0.19 | 0.19 |
| 0.19 | 0.19 | 0.19 | 0.19 | 0.19 | 0.19 | 0.19 | 0.19 | 0.19 | 0.19 |
| 0.19 | 0.19 | 0.19 | 0.19 | 0.19 | 0.19 | 0.19 | 0.19 | 0.19 | 0.19 |
| 0.19 | 0.19 | 0.19 | 0.19 | 0.19 | 0.19 | 0.19 | 0.19 | 0.19 | 0.19 |
| 0.19 | 0.19 | 0.19 | 0.19 | 0.19 | 0.19 | 0.19 | 0.19 | 0.19 | 0.19 |
| 0.19 | 0.19 | 0.19 | 0.19 | 0.19 | 0.19 | 0.19 | 0.19 | 0.19 | 0.19 |

840

Fig. 8Q

| 16 | qb_rec_dist | | | | Sample Input PTD Training Data (11x10) | | | | | |
|---|---|---|---|---|---|---|---|---|---|---|
| | | | | | | | | | | |
| 24.70 | 24.70 | 24.70 | 24.70 | 24.70 | 24.70 | 24.70 | 24.70 | 24.70 | 24.70 |
| 24.70 | 24.70 | 24.70 | 24.70 | 24.70 | 24.70 | 24.70 | 24.70 | 24.70 | 24.70 |
| 24.70 | 24.70 | 24.70 | 24.70 | 24.70 | 24.70 | 24.70 | 24.70 | 24.70 | 24.70 |
| 24.70 | 24.70 | 24.70 | 24.70 | 24.70 | 24.70 | 24.70 | 24.70 | 24.70 | 24.70 |
| 24.70 | 24.70 | 24.70 | 24.70 | 24.70 | 24.70 | 24.70 | 24.70 | 24.70 | 24.70 |
| 24.70 | 24.70 | 24.70 | 24.70 | 24.70 | 24.70 | 24.70 | 24.70 | 24.70 | 24.70 |
| 24.70 | 24.70 | 24.70 | 24.70 | 24.70 | 24.70 | 24.70 | 24.70 | 24.70 | 24.70 |
| 24.70 | 24.70 | 24.70 | 24.70 | 24.70 | 24.70 | 24.70 | 24.70 | 24.70 | 24.70 |
| 24.70 | 24.70 | 24.70 | 24.70 | 24.70 | 24.70 | 24.70 | 24.70 | 24.70 | 24.70 |
| 24.70 | 24.70 | 24.70 | 24.70 | 24.70 | 24.70 | 24.70 | 24.70 | 24.70 | 24.70 |
| 24.70 | 24.70 | 24.70 | 24.70 | 24.70 | 24.70 | 24.70 | 24.70 | 24.70 | 24.70 |

Neural Network Model Training Logic

Sports Video Game Application

Recommendation Engine Application

RTM Graphic Display Application

SYSTEM AND METHOD FOR TRACKING SPORTS PLAYERS TO GENERATE AND APPLY RECEIVER TRACKING METRICS

CROSS REFERENCE TO RELATED APPLICATIONS

This application claims priority to U.S. Provisional Patent Application No. 63/585,816, filed Sep. 27, 2023.

BACKGROUND

In sports where players must elude defenders to receive a pass and then advance toward a goal, such as in the sport of American Football, measurement of athlete performance using location sensing technology and time stamps associated therewith has the potential to enable advanced insights into an athlete's performance. Conventional box score statistics data, such as targets, catches, touchdowns, yards or yards per attempt, do not provide sufficient insight into receiver performance.

One technique currently used is called "Completion Percentage Over Expected" (CPOE), which estimates the chance (or probability) of a completion on a given pass, given the locations, directions and speeds of relevant players on the field to generate an expected completion benchmark. If a completion occurs, the passer (e.g., a football quarterback or other thrower) would be credited with all the probability between the prediction and 1. However, CPOE and associated metrics have a flaw when applied to pass-catchers, because the locations, directions, and speeds of the other players are impacted by the catcher's actions. The CPOE "benchmark value", therefore, includes the catching/receiving ability of a given receiver, which inherently includes his ability to create space between himself and his defenders ("get open") to receive the pass. Thus, the better the receiver is at getting open, the higher the benchmark the receiver sets for himself in the metric and the narrower the delta between the benchmark percentage and one. Accordingly, metrics such as CPOE penalize a receiver for being good at his job.

To date, there has not been an analytically rigorous way to measure football pass-catcher success in all facets of his role: getting open, catching the ball, and gaining yards after the catch (YAC).

Accordingly, it would be desirable to have a system and method that overcomes the shortcomings of the prior art and provides an accurate and repeatable approach to measuring receiver performance and does not penalize a receiver for having strong performance.

BRIEF DESCRIPTION OF THE DRAWINGS

FIG. 2B is a top-level block diagram showing components of a system for providing receiver tracking metrics, in accordance with embodiments of the present disclosure.

FIG. 5C is a table showing sub-component calculations and snapshot-times for the Sub-Component Calculation Logic of FIG. 5A, in accordance with embodiments of the present disclosure.

FIG. 5H is a table showing sample aggregate weights grouped by RTM score, in accordance with embodiments of the present disclosure.

FIG. 5*I* and FIG. 5J show tables of sub-component values and weights calculations for WR/TE and RBs, respectively, in accordance with embodiments of the present disclosure

FIG. 6E, FIG. 6F, FIG. 6G, FIG. 6H, and FIG. 6I, show sample RTM scores, rankings and receiver stats for certain receivers, in accordance with embodiments of the present disclosure.

FIG. 6J shows sample RTM year-to-year stability data, in accordance with embodiments of the present disclosure.

FIG. 7A, FIG. 7B, and FIG. 7C show model variables, pass routes, and defensive coverages, respectively, associated with the Random Forest (RF) classifier model of FIG. 2B, in accordance with embodiments of the present disclosure.

FIG. 7D and FIG. 7E shows training data associated with the Random Forest (RF) classifier model of FIG. 2B, in accordance with embodiments of the present disclosure.

FIG. 8A shows model variables associated with the Convolutional Neural Network (CNN) of FIG. 2B, in accordance with embodiments of the present disclosure.

FIG. 8B, FIG. 8C, FIG. 8D, FIG. 8E, FIG. 8F, FIG. 8G, FIG. 8H, FIG. 8I, FIG. 8J, FIG. 8K, FIG. 8L, FIG. 8M, FIG. 8N, FIG. 8O, FIG. 8P, and FIG. 8Q show training data associated with the Convolutional Neural Network (CNN) of FIG. 2B, in accordance with embodiments of the present disclosure.

DETAILED DESCRIPTION

Figure 1:
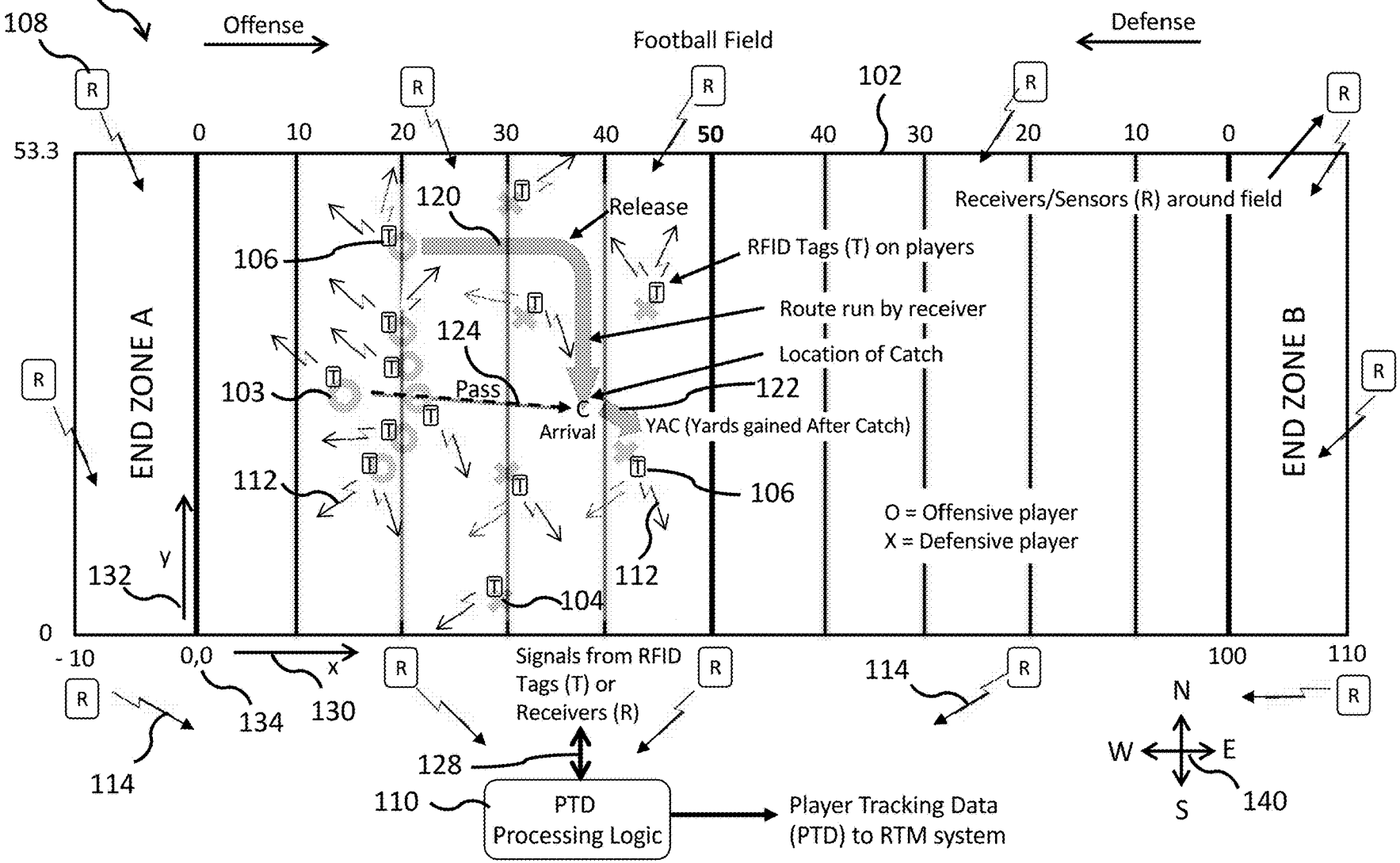
FIG. 1 is an aerial view of a sports playing field showing a sample play and a system for measuring player tracking data and an x,y coordinate system, in accordance with embodiments of the present disclosure.

As discussed in more detail below, in some embodiments, the system and method of the present disclosure includes a system and method for tracking the locations, speed, etc. of sports players to generate player tracking data (PTD), and using this player tracking data to generate Receiver Tracking Metrics (RTM or RTMs), which is a suite or collection of performance metrics for football pass-catchers (e.g., wide receivers (WR), tight ends (TE), and running backs (RB)) based on the player tracking data. This suite of metrics allows for measuring pass-catcher success in all three phases of his role. The RTMs may be used in various end applications, as discussed herein, such as control of video game character performance, recommendation generation such as for fantasy sports or gambling applications, and graphics display in a computer or broadcast system. A key advance of the RTM metrics of the present disclosure is that it defeats the flaws of current metrics like CPOE (Completion Percentage Over Expected), which count (or include) the ability of receivers to get open against them. The system of the present disclosure does so by comparing receiver outcomes to a typical/average receivers' ability to get open, rather than the particular receiver's performance on a particular play. Also, the RTMs of the present disclosure may be provided on demand by request of a user or software application program or continuously in realtime or may be stored in a database or server for later use or access by a user or an application.

As discussed herein, player tracking systems may be used to generate data representing sports players' locations, velocities, and movement in time. Player Tracking Systems such as optical or image-based or camera-based tracking or signal-based (e.g., RFID-based) tracking or a combination of both may be used to generate player tracking data (PTD). In electronic tracking systems, transmitter or receiver devices may be physically placed on players' uniforms or equipment and signal detectors placed in the venue. For example, for signal-based systems, RFID chips or tags may be placed in players' uniforms or equipment and signals emitted, transmitted or reflected by these chips may be used to calculate the locations, velocities, and the like, of the players over time during the game, as described herein. In particular, some embodiments of known PTD signal-based systems may include two RFID chips or tags in each player's shoulder pads as well as a chip or tag in the football, and a sensor array (e.g., receiver devices) around the field of play. Camera-based or image-based or optical systems may use image recognition and image tracking technology to determine similar player data. Hybrid optical/image-based and signal-based systems may also be used, where each type of data supplements the other to provide a robust player tracking system.

The present disclosure utilizes player tracking metrics to measure not just targeted pass routes but all routes run by pass-catchers (or receivers). It is significantly more sophisticated than relying on simple statistics to measure pass-catcher success or even human tracking to determine how open pass-catchers may have seemed or difficult a catch was. Given its ability to analyze all passes, it's also significantly more accurate in assessing the effectiveness of a pass-catcher than other approaches may have been in the past.

The present disclosure provides an analytically rigorous system for measuring pass-catcher success (and thus receiver performance) in all facets of the game by providing metrics for: getting open (or Open score), catching the ball (or Catch score), and gaining yards after the catch (or YAC score), which metrics also allow for measuring overall pass-catcher success (or Overall RTM score), as discussed herein. The term "catch" as used herein, includes receiving and controlling a sports object, such as catching a ball in some sports such as football and the like, or receiving a pass in other sports such as hockey, lacrosse, soccer, and the like.

In particular, RTMs of the present disclosure provide an evaluation of a receiver's ability to become open which can be integrated into or used to drive outcomes in various end applications, such as electronic games, recommendation engines, and graphics display.

Traditionally, player performance is evaluated against some context. For example, shorter passes are easier to complete than longer passes. Likewise, passes to open receivers are easier to complete than closely covered receivers. However, evaluating a receiver's ability to "get open", while accounting for context is self-defeating. The receiver himself is largely responsible for creating the context through his skill and ability. To solve this problem, RTMs evaluates "openness" in two different contexts: a general and a specific context.

For the general context, in some embodiments, the present disclosure uses an RF Classifier model discussed herein, which accounts for factors such as route type, depth, coverage type, and other play-level considerations to provide a typical or average receiver's ability to get open. For the specific context, in some embodiments, the present disclosure uses a neural network discussed herein, which uses player tracking data, which provides the precise array of player locations, speeds, and directions to evaluate openness. The difference in openness between the specific context and the general context is indicative of the individual receiver's contribution to becoming open or the "Open" score.

The present disclosure uses a convolutional neural network (or CNN) along with robust data and deep subject matter knowledge built into the model to accomplish these goals and determine RTMs for a given receiver.

The present disclosure utilizes player tracking data (PTD) or metrics to measure or determine receiver performance not just for targeted passes (i.e., receivers when they are the target of a given pass play or route), but all routes run by receivers (or pass-catchers). Such an approach is significantly more sophisticated than relying on simple statistics to measure pass-catcher success or even human tracking to determine how open pass-catchers may have seemed or how difficult a catch was. Given its ability to analyze all passes, the RTMs of the present disclosure are also significantly more accurate in assessing the effectiveness of a pass-catcher than other approaches may have been in the past.

Beyond the comparison to simple statistic approaches to measuring pass-catcher success, as well as simple prior art models that determined individual parts of the metrics (such as YAC), there have been no previous solutions that provide all the receiver performance insights that the RTMs of the present disclosure does.

The present disclosure determines the probability of a catch of a typical/average receiver, given the contextual details of the pass route (including route type, depth, coverage, and other variables described herein), and sets a "benchmark" of expected "openness" without regard to (or agnostic to) the ability of the receiver to get open. Then, it compares the typical expected openness for an typical/average receiver (i.e., the "benchmark") to the actual openness of a receiver given the specific route, coverage and depth using PTD, rather than solely a raw assessment of the receiver.

Thus, the present disclosure estimates a probability of success (e.g., making a catch in this case) given a very specific level of context for the specific receiver being analyzed using the player tracking data (PTD). It also estimates a probability (or estimation) of success given a much more general level of context for an average receiver, independent of the specific positions and velocities, using more general information (e.g., depth, route type, etc.). The difference between these two estimates (or probabilities) is indicative of an individual player's contribution to the potential success of a play.

All four metrics of the present disclosure are a per-play rate metric, rather than a counting or cumulative stat. Each score is on a 0-99 scale, where 50 is roughly league average. Other scales or averages may be used for the score if desired. The purpose of the RTM metrics is not solely to rank receivers from best to worst, but also to describe and explain how a receiver is, or is not, able to produce yards. All three components of the RTMs, Open, Catch, and YAC, generally work the same way. For each, a "benchmark" is set based on the context and dynamic inner workings of the play. The metrics measure the degree to which the receiver exceeds or falls short of that benchmark. For example, YAC score looks at the tracking data at the time of catch and makes a prediction of how many additional yards a receiver will typically make, based on the locations, directions and speeds of all 22 players. The receiver is credited (or debited) for the yardage beyond (or below) that benchmark, rather than the raw yards after catch gained. Some plays and situations lend themselves to a lot or a little YAC, so YAC score does not measure mere yards but rather the yards the receiver was able to generate beyond the expected amount.

In general, there are several factors considered in establishing the "benchmark" or "expected" or likelihood of a typical/average receiver catch on each route. These include route type, depth of route, coverage type (Cover 3, Man 2 and so on), position at snap (wide, slot, tight, backfield), distance from sideline, time after snap, down/distance/yard line and whether or not the play featured play-action, as discussed herein.

Regarding the Open score, for every route run, the Open score assesses the likelihood a receiver would be able to complete a catch, conditional on if he were targeted. The assessment takes place a moment before pass release (e.g., 0.2 seconds prior), because defenders read the shoulders of the quarterback at release and break on (or start to move toward) the targeted receiver. Otherwise, if pass release time were used for the assessment time, actual targeted receivers would appear to be less likely to complete a catch. The RTMs of the present disclosure account for route type & depth, coverage type, down, distance, the quarterback, and extra attention from defenses (e.g., double teams and the like). Regarding the effect of double teams and the like on certain receivers, some receivers attract more attention from defenses than others, which allows other pass-catchers to get less defensive attention (or coverage). To account for this effect, Open score is adjusted for the number of defenders exclusively "assigned" to a receiver using a double team adjustment sub-component of the Open score as discussed herein (FIG. 5D). For example, if there is a cornerback covering a receiver and a safety deep above him who matches the receiver's pattern much more than any other receiver, that receiver is credited with extra attention (i.e., the receiver is being covered my more than a typical or expected number of defenders). The DTA sub-component not only accounts for dedicated double teams, but for coverage methods such as bracketing.

Regarding the Catch score, the assessment to catch (or catch and contest) works in a similar way to openness or the open score. Given the array of all 22 players' positions, directions and speeds, the model estimates the probability of a completion. In general, if a completion occurs, the receiver is credited with the marginal difference. For example, if the player tracking data (PTD) indicates a pass will be completed 75% of the time and the receiver actually catches the pass, he is credited with plus 0.25. If he does not catch the pass, he is debited at minus 0.75. There are also some modifications or adjustments to this calculation which are described herein.

Thus, these metrics help explain how pass-catchers perform, rather than simply ranking them from best to worst. Gaining insight into how they either excel or underperform provides metrics on which receivers are ready to break out, if they were just targeted more often, and which receivers are making their quarterback look better than they actually are.

The system and method of the present disclosure performs machine learning-based analysis of a large number of plays having the positions and velocities of all the players on the field during each play, and uses a convolutional neural network (CNN) model to make a prediction of completion probability for a given pass play. In addition, there is a training phase/stage where the CNN model is provided with a large volume of player tracking data and pass outcomes or results for a plurality of plays to allow for such a prediction.

In particular, the CNN model is trained on data from thousands of actual pass attempts going back several years (e.g., about 5 years). The system and method of the present disclosure uses supervised machine learning to train the CNN, where past examples and outcomes are used to train a model to make future predictions. After training, the model comes to learn what an open receiver "looks like." The inputs to the model are the relative positions and velocities of all 22 players to each other, along with certain additional information, such as distance to the QB, and speed of travel (or velocity) of the QB at pass release and raw location of each player on the field and location of the football, as discussed further herein.

The variable of interest (or target variable) to be estimated during the CNN model training is a 1 or 0 representing whether the pass was completed (1) or not completed (0) (comp_pass variable). The CNN model learns which pattern of the inputs are associated with pass completions (comp_pass=1) and which are associated with incompletions (comp_pass=0). During the "prediction" or "run time" phase, the CNN model is provided the inputs from a given pass play or pass route that the CNN model has not been trained on, and the CNN model provides an estimate of the probability of completion for a given receiver or player, referred to herein as the "predicted" or "predicted openness" or "catch/no-catch prediction".

The input data to the CNN is spatiotemporal (or spatial temporal) data, which includes time, x position, and y position of the players or sports objects. In some embodiments, the data may be adjusted, such as flipping the direction of play for certain plays to always be relative to the offense rather than relative to the entire field. For example, teams play east-west along the football field (see FIG. 1), depending on who possesses the ball, and direction of play swaps at each quarter break. To make the data consistent, in some embodiments, the data may be "flipped" so the offense is always moving in the same direction, e.g., west to east, regardless of which team has the ball.

In some embodiments, the system of the present disclosure may mark or identify a start time such as the time of snap, and all time measurements are relative to that moment rather than the general time of day, Greenwich Mean Time (GMT) or other time frame of reference. Other time references may be used if desired, provided it provides the same function and performance described herein. Also, in some embodiments, the data inputs to the CNN may be normalized so they are all on equal scales, which helps the CNN model training converge on a set of optimum parameters.

Also, in some embodiments, known data augmentation may be performed on the data, in which case the size of the data is doubled by making a mirror image of each play. For example, consider two plays that look identical except one was executed to the right and one to the left, and it is assumed that the two plays would have the same chance of completion. Such data augmentation enhances the CNN model's ability to generalize to unseen data.

The present invention determines eight (8) sub-components of the overall metric by various comparisons of 'predicted' to 'expected' probability of catch, along with YAC above predicted and an adjustment for double-teams. These sub-components are combined to create the final overall metric. Each of the eight sub-components are naturally associated with the three main functions of a pass-catcher: getting open, catching a pass, and gaining YAC. The sub-components are combined within their associated primary components (open, catch, YAC) to produce those component scores. For example, the openness (or Open) score may have five sub-components (or sub-attributes), such as: openness at release, openness at arrival, openness vs man-to-man ("man") defense configurations (or Openness to Man-only) at release and at arrival, and double team adjustments. For example, the Catch score may have two sub-attributes or sub-components, such as: catch over expected and catch over predicted. For example, the YAC score may have one sub-attribute or sub-component, such as: YAC over predicted. Other number and type of sub-components may be used provided they provide a similar performance and function to that described herein.

Also, certain of the above sub-components may be adjusted for QB throw accuracy. In particular, any metrics that involve target selection and completion may be adjusted for the QB, such as Openness over expected at pass arrival, Open vs. Man at pass arrival, Catch over expected, Catch over predicted, and Yards After Catch (YAC). Such adjustments may be done by: (1) an adjusted plus-minus model of receivers and QBs across multiple seasons; and (2) video analysis tracking (VAT) accuracy, data provided by people (sports analysts) or intelligent machines, which may be stored in a database or server or data provided in realtime, which document for a given play the quality of the QB throw, e.g., high, low, in front receiver, behind receiver, for which an adjustment is made based on quality of the throw, and throw-aways, in which a pass is obviously intended to be thrown out of bounds or otherwise incomplete (throw-aways), which are ignored and not included in the assessment. The QB adjustments may be similar to a known adjusted plus-minus approach done in hockey and basketball, which estimates each individual contribution to the overall effectiveness, accounting for the presence or absence of other players around them. In that case, the adjustment may be a simple adjusted plus-minus among the QB and his receivers.

Also, in some embodiments, the system of the present disclosure filters the data to improve accuracy of the RTMs (or reduce inaccuracies caused by irrelevant or misleading data), such as excluding non-targeted routes on screen plays and push passes for open score (where non-targeted receivers are typically blocking rather than trying to get open) and excluding passes which are determined to be intentional throwaways by the quarterback. Only the Catch and YAC scores are counted for (or include) targeted screen routes because openness on those routes is due to play design far more than receiver ability. Also, for the Man-Only Defense sub-components (discussed herein), certain defensive coverages (e.g., zone coverage and the like) are excluded or filtered out.

The RTM sub-components (or sub-attributes) are combined using a weighted sum method. Weights W1-W8 for each sub-component are calculated based on how well the sub-component or overall metric matches real-world production at the receiver level. RTMs defines real-world production as a predetermined proportioned combination or "mix" of yards per route run (YPRR), yards per target (YPT), and total yards (Tot Yds) for a given receiver group, discussed more herein. Thus, the sub-components are weighted based on how well the overall RTM score metric matches a predetermined mix of real-world production stats or metrics, e.g., combination of YPRR, YPT, Tot Yds. Specifically, the sub-component weights for a given receiver group or type (e.g., WR/TE or RB) may be determined using a multi-variate correlation or optimization/regression model of the mix of real-world production stats (YPRR, YPT, Tot Yds) for that receiver group upon the sub-components for that receiver group, discussed more hereinafter. How well each receiver's sub-component scores, predicts that receiver's real-world production. Those sub-component weights may be then rolled up or aggregated to determine their primary component weights. For Wide Receivers (WRs) and Tight Ends (TEs), the resultant or aggregated weights may be: openness (or Open score)=about 50%, catching (or Catch score)=about 26% and YAC=about 24%, discussed more hereinafter. Also, for Running Backs (RBs), YAC creation becomes progressively more important to actual production, and therefore weighted heavier for the RB receiver group.

In particular, for wide receivers (WR) and tight ends (TE), Open score accounts for roughly half of the overall score, while Catch score accounts for a little over a quarter, and YAC score accounts for the remainder. These weights make logical sense, in that a receiver has to get open to have the chance to make a catch. The receiver then has to catch the ball to gain additional yards. Without success in the early part of the sequence, the receiver wouldn't have many opportunities through the remainder of the process. For running backs (RBs), YAC score accounts for about half of the overall score, with Catch score the second largest component, followed by Open score. This allocation also makes sense. Running backs (RBs) typically run swing routes, check downs and screens, which don't require excellent route-running skills but do rely on yards after catch (YAC) for success.

In general, the RTMs of the present disclosure track well to themselves year over year, i.e., the RTM metrics positively correlate year-to-year confirming it is capturing real, systemic qualities in receivers, indicating that RTMs are tracking inherent attributes of the individual receiver, as discussed more herein.

It should be understood that for small sample sizes and receiver production the results may be relatively volatile. However, receiver openness and the like may often be beyond the receiver's control; but in the aggregate, over time, as more data is collected and analyzed, the better receivers will rise to the top.

Also, in some embodiments, as discussed herein, the tabular pass route data provided to the random forest classifier model, such as route type and coverage type, may be determined by classifying route type and coverage type using existing tracking data or by any other technique.

The present disclosure approach is capable of working with any sport or field of play or playing courts. In particular, any sport that involves generating space or shot opportunities could benefit from the RTMs of the present disclosure, such as basketball, soccer, hockey, lacrosse, or any other sport that involves generating space or shot opportunities or catching or receiving a pass. For example, basketball uses tracking data to estimate a probability a shot is made or missed. A player who makes more shots than expected would typically be credited with the marginal shot percentage above expected given the tracking information. But the same 'self-defeating' problem exists as described herein for football. Good players generate more shooting space, which makes their shots appear easy. Consequently, such players would not be credited as much. The present disclosure would resolve that problem. A similar analogy can be made for other sports that involve generating space or shot opportunities or catching or receiving a pass.

As discussed herein above, the present disclosure may be integrated into or used in various hardware or software end applications, such as electronic games, recommendation engines, and applied across various different use areas or applications. Regarding media applications, RTMs may be used in decomposing receiver player skills into open/catch/YAC to better understand player abilities. RTMs may also be used for player comparisons for awards, rankings, analysis of trades, free-agent signings, releases, and the like. RTMs may also be used for narratives and explanations of improvement or declines of receiver performance over time. RTMs may also be used for fantasy and betting/gambling projections. Regarding team, manager, player, or agent applications, RTMs may be used for professional and amateur player evaluations or recommendations for roster selection (signings, releases, drafting), pro signings, pro selection from college, and college recruitment from high school/junior college, as well as for team-player-agent contract negotiations. RTMs may also be used in a coaching situation to decide or recommend which player to use for a given play or which route to run, based on the RTM data for a given receiver or group of receivers. Also, the RTMs of the present disclosure may be provided on demand by request of a user or software application program or continuously in realtime or may be stored in a database or server for later use or access by a user or an application.

Referring to FIG. 1, an aerial view 100 of a football field 102 is shown, having a sample pass play route run by a receiver and an x,y coordinate system 130,132 and a north-south-east-west directional indicator 140, and a known player tracking system for measuring player (or sports object) tracking data, e.g., a player tracking system made by Zebra MotionWorks®, or the like, which may include RF transmitters or RFID tags (T) (or other tags or sensors or transmitters) 106 disposed on the players' uniforms or equipment and a sensor array (e.g., receiver (R) devices) 108 disposed or positioned around the field of play, which provide signals to known PTD processing logic 110, such as that described in commonly owned U.S. Pat. No. 7,671,802, to Walsh et al (hereinafter, the '802 patent), which is incorporated herein by reference to the extent necessary to understand the present disclosure. The PTD processing logic 110 provides the player tracking data (PTD) to the RTM System either in realtime or stored in a database or server for later use or retrieval or access, which is used to determine RTMs of the present disclosure, as discussed herein.

The tags (T) 106 may have a shape and size similar to that of conventional radio frequency (RF) identification (RFID) tags, e.g., two tags per player located in their shoulder pads (other number of tags may be used), allowing them to be conveniently and unobtrusively attached to or carried in a sports object, such as a player's uniform, helmet, or other personal equipment. Sports objects can also include mobile sports equipment such as balls, pucks, bicycles, skateboards, and the like. A reference herein to a tag attached to a sports object is intended to include within its scope of meaning a tag attached to, mounted on, embedded in, carried in, formed on or in, or otherwise disposed on or associated with the sports object. As described in the aforementioned '802 patent to Walsh, the received signals are used to estimate the location and track the realtime movement of sports objects with an associated timestamp. For example, numerous players on a field can each have one or more attached tags, and the tracking system provides data indicative of the location and movement of each individual player. In the football example shown in FIG. 1, there may be RFID tags on the players as well as on the football.

Such a player tracking system is also discussed in the article: "DeepQB: Deep Learning with Player Tracking to Quantify Quarterback Decision-Making & Performance", by B. Burke, March 2019, MIT Sloan Sports Analytics Conference, which discusses a deep learning approach to evaluate quarterback decision-making and performance, and in the article: "Finding the Open Receiver: A Quantitative Geospatial Analysis of Quarterback Decision-Making", by J. Hochstedler, March 2016, MIT Sloan Sports Analytics Conference.

Other systems may be used to provide player tracking data of players or sports objects, such as systems using video processing through computer vision models, such as that described in the article: "A Comprehensive Review of Computer Vision in Sports: Open Issues, Future Trends and Research Directions", by B. Naik et al., Appl. Sci. 2022, 12 (9), 4429, and that described in "Computer Vision in Sports-Use Case in 2023" at https://viso.ai/applications/visual-ai-in-sports/, which are each incorporated herein by reference to the extent necessary to understand the present disclosure. In that case, various cameras may be distributed around the field of play to obtain the desired information needed to determine the player tracking data (PTD).

The tags (T) 106 and receivers (R) 108 may provide signals 112,114, respectively, indicative of player or sports object position (or velocity or acceleration) over time, to known PTD Processing Logic 110, which conditions or adjusts the received signals and provides data indicative of players or sports objects position at a given time, such as is described in the aforementioned '802 patent to Walsh. The player's position (x,y) can then be converted into, velocity, acceleration, and the like, if desired, by the PTD Processing Logic 110.

Thus, the present disclosure uses player tracking data (PTD), received from one or more known player tracking systems which provide data indicative of sports players' locations, velocities, and movement in time on the field (or court) of play (or playing area). The PTD may be provided in realtime to the system of the present disclosure or stored in a database or server for access at a later time.

In addition, the football field 102 of FIG. 1 is shown with players 102,104 on the field, such as offensive football players 102 (shown as "O"s), defensive football players 104 (shown as "X"s), a dashed arrow 128 showing the path of a thrown football, a curved arrow 120 showing the route run by the receiver, a straight arrow 122 indicating the yards gained by the receiver after the catch (YAC).

Figure 2A:
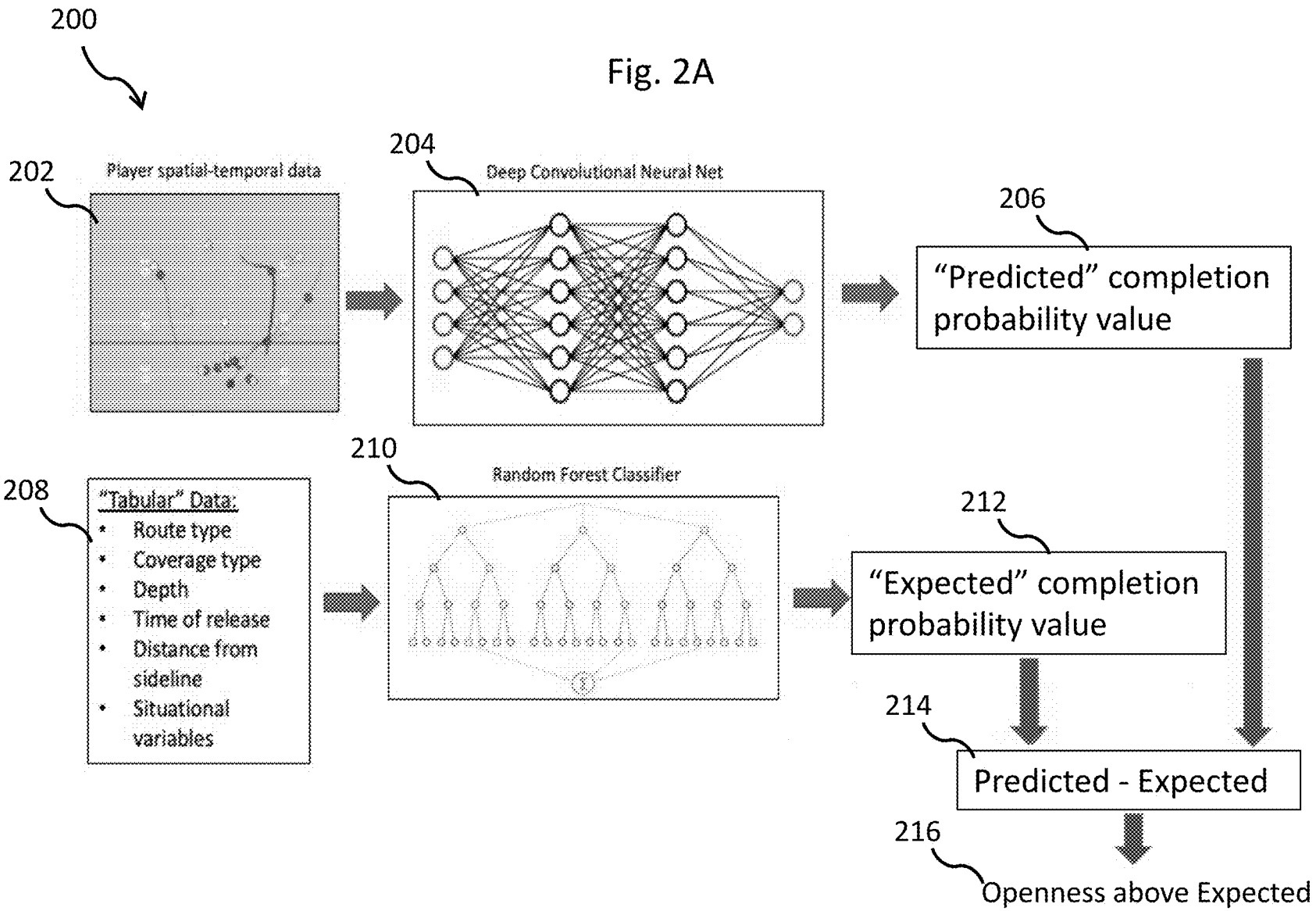
FIG. 2A is a top-level diagram showing two machine learning models used to provide parameters used for providing receiver tracking metrics, in accordance with embodiments of the present disclosure

Referring to FIG. 2A, a top-level diagram shows the two machine learning models, e.g., a Convolutional Neural Network (CNN) and a Random Forest (RF) Classifier used to provide parameters for providing receiver tracking metrics, in accordance with embodiments of the present disclosure. In particular, the CNN uses spatial-temporal data 202 in the form of Player Tracking Data (PTD) (x,y location and time, and may include velocity and acceleration) which may be used to provide a "predicted" completion probability 206, using PTD given the relative player positions and velocities of all the players on the field, applied to all routes, whether targeted or not. The RF Classifier 201 uses tabular pass route data 208 (as opposed to 3D tensor data used with the CNN) 212 to provide an "expected" estimate for completion probability for a "typical" receiver, given the pass route data, such as route type, depth, coverage, situation, and the like, as described herein. "Openness" or "openness over expected" 216 is then determined by calculating the difference between the predicted and expected probabilities (openness-expected) as shown by box 214, which is indicative of the degree to which the individual receiver performed better than the typical receiver. Negative values for this parameter indicate that the actual receiver did worse that a typical receiver.

Referring to FIG. 2B, a top-level block diagram shows components of a system 220 for providing receiver tracking metrics, in accordance with embodiments of the present disclosure. In particular, an upper portion 221 of the diagram shows the CNN or prediction portion, and a lower portion 223 shows the Random Forest (or RF) Classifier or expected (or benchmark) portion.

Regarding the Neural Network Model 224, during training, the Neural Network Model (or CNN) 224 receives training data 230 on a line 232, such as the training data shown in FIGS. 8A-8Q which may be stored on a server, and provides the Neural Network Parameters or CNN Model Parameters on a line 240 to the Neural Network Parameters Server 238. Training of the CNN model may be performed by CNN Training Logic 224A (discussed with FIG. 9A), which may be part of the CNN model 224 or separate from it. During run time (or prediction time), the CNN model 224 receives actual or live player tracking data (PTD) from PTD Sources 234, such as the PTD system shown in FIG. 1, and provides a CNN Catch/No-Catch Prediction on a line 244 to the CNN Catch/No-Catch Prediction Server 242 and to the RTM Calculation Logic 228. Run-time prediction for CNN model 224 may be performed by CNN Prediction Logic 224B (discussed with FIG. 9B), which may be part of the CNN model 224 or separate from it.

Figure 3A:
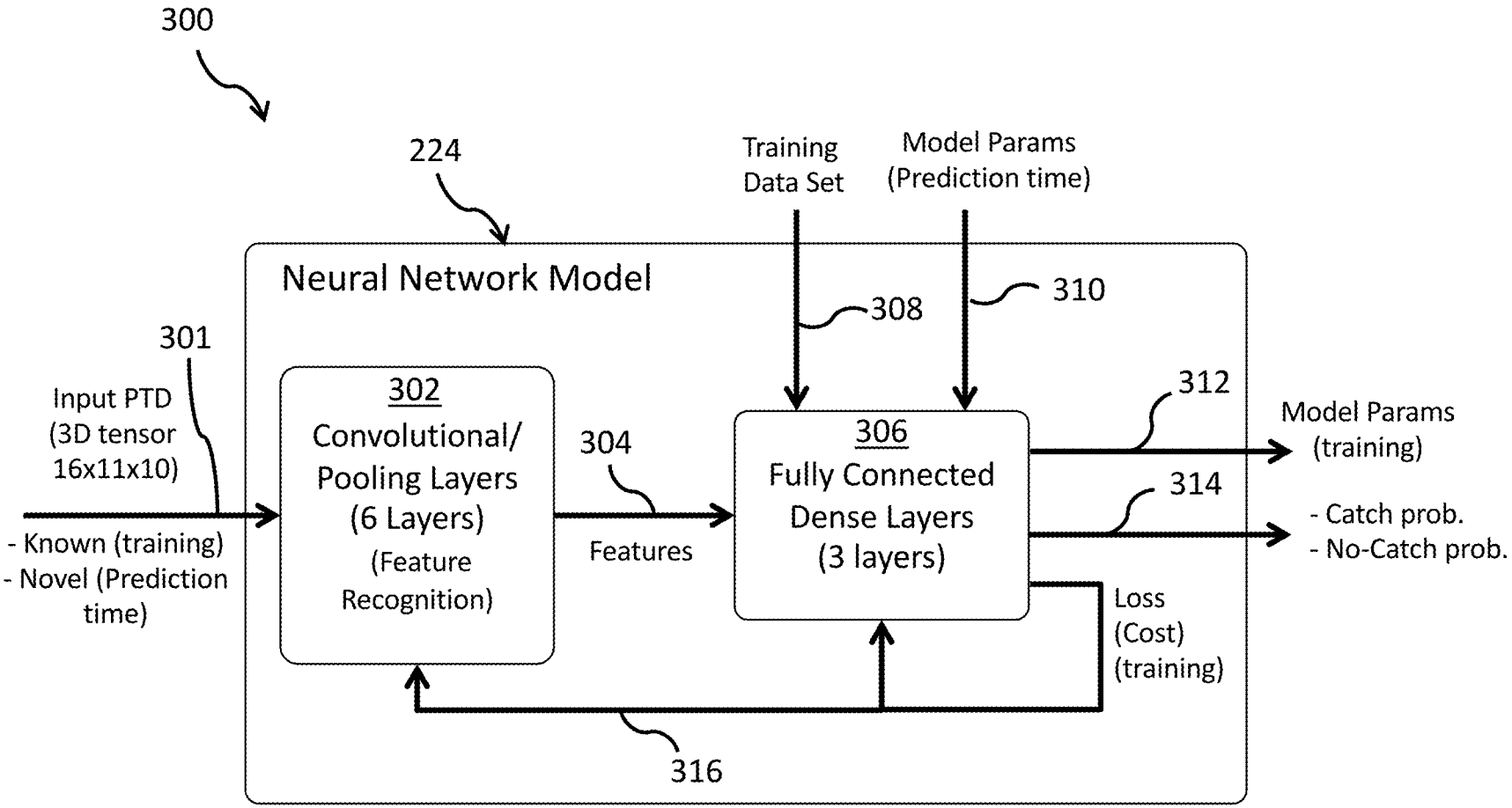
FIG. 3A is a top-level block diagram showing components of a Neural Network Model of FIG. 2B, in accordance with embodiments of the present disclosure.
Figure 3B:
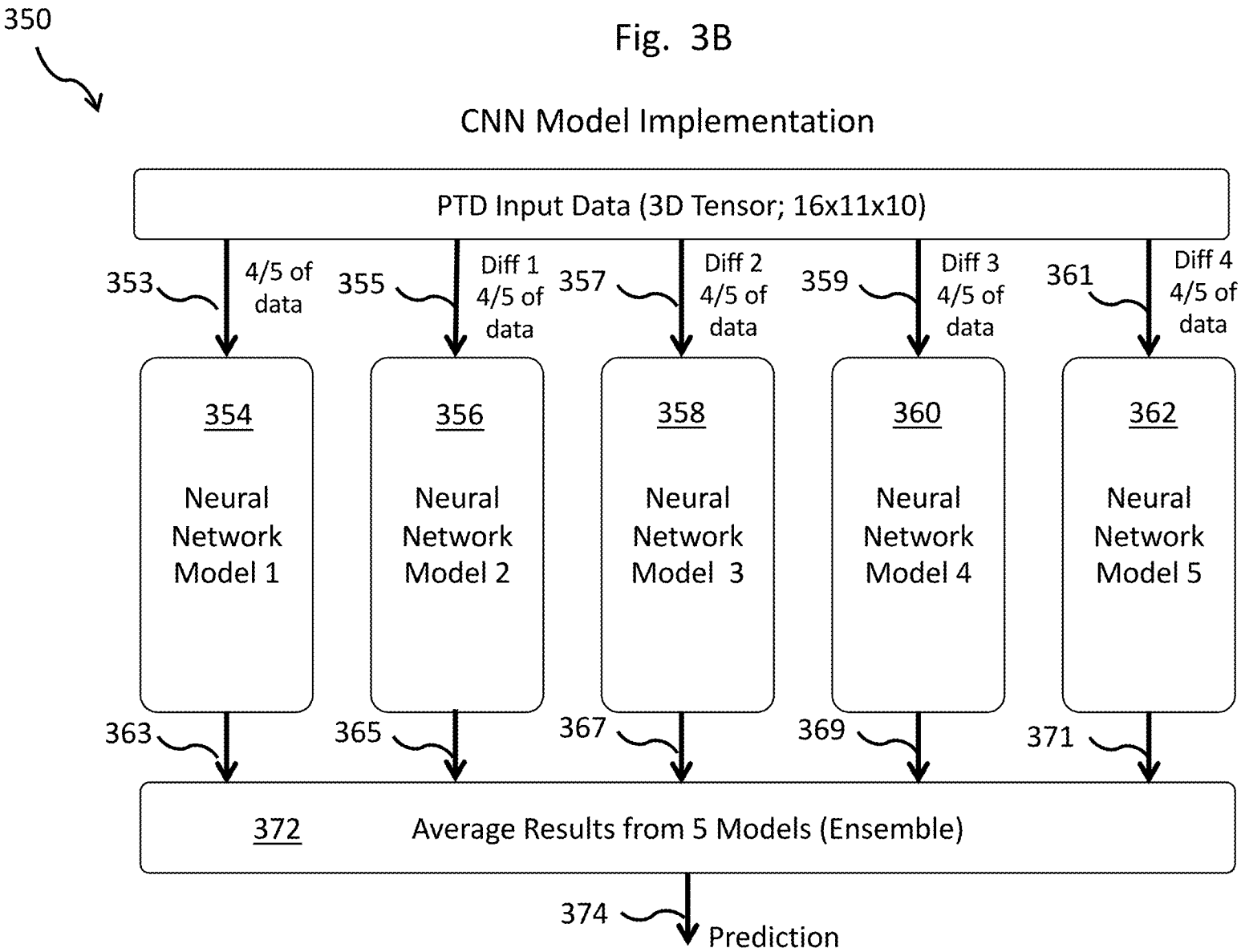
FIG. 3B is a block diagram showing one embodiment for implementing the Neural Network Model of FIG. 3A using five (5) models each using a different 4/5 of the data, in accordance with embodiments of the present disclosure.

The CNN model 224 consists of 6 (six), 1-dimensional, convolutional layers and 3 (three) fully-connected dense layers, discussed more herein and also discussed with FIGS. 3A and 3B. Other numbers of dimensions and layers may be used if desired. In this case, the CNN model 224 was coded using a known deep learning library called Tensor-Flow/Keras, and it is based on an extension of a common CNN architecture. Other deep learning libraries may be used if desired. Another form or type of machine learning model may be used for the convolutional neural network (CNN) model, such as any other type of neural network or other model, provided that it is order invariant or permutation invariant layers (the order of the players does not matter), to provide the best results for the present disclosure. One example of a convolutional neural network model is that shown in the paper "Learning Feature Representations from Football Tracking", by Michael Horton, Sports Analytics Conference, March 2020. In some embodiments, the present disclosure may use a CNN model that is both a simplification and extension of the architecture shown in the Horton paper cited herein above.

Regarding the RF Classifier 228, during training, the RF Classifier receives training data 250 on a line 252, such as the training data shown in FIGS. 7A-8D, which may be stored on a server, and provides the RF Classifier Parameters or RF Classifier Model Parameters on a line 270 to the RF Classifier Parameters Server 268. Training of the RF Classifier Model 226 may be performed by RF Classifier Training Logic 226A (discussed with FIG. 9C), which may be part of the RF Classifier Model 226 or separate from it. During run time (or estimation time), the RF Classifier model 226 receives an Estimation Time Data Set 254 on a line 256 and actual values of predictor variables 250 on a line 260, and provides a Catch/No-Catch Expected (Benchmark) on a line 264 to the RFC Catch/Np-Catch Expected Server 262 and to the RTM Calculation Logic 228. Run-time estimation for RF Classifier Model 226 may be performed by RF Classification Estimation Logic 226B (discussed with FIG. 9D), which may be part of the RF Classifier Model 226 or separate from it.

The RF Classifier software application tools that may be used to perform the present disclosure include: "randomForest", which may be found at https://cran.r-project.org/web/packages/randomForest/index.html; "ranger", which may be found at https://cran.r-project.org/web/packages/ranger/ranger.pdf; and "cForest", which may be found at https://www.rdocumentation.org/packages/partykit/versions/1.2-20/topics/cforest. Other RF Classifier software packages may be used if desired. Also, another form or type of machine learning model may be used for the RF Classifier if desired, such as gradient-boosted trees, logistic regression, support vector machines, or K-nearest neighbors, or any other machine learning model that accounts for non-linearities and interactions between variables to provide best results.

The RTM Calculation Logic 228 receives the CNN Catch/No-Catch Prediction and the Catch/No-Catch Expected (Benchmark) as well as player tracking data and data from the RF Classifier Estimation Time data set and Actual values of predictor variables and provides the RTMs to the RTM server 272 on a line 274. In some embodiments, the RTM Calculation Logic 228 initiates the predicted and expected calculations and provides filtering commands or instructions on lines 229, 231 to the CNN and RF Classifier models 224,226, respectively, which may be used for certain RTM calculations where the data is filtered, as discussed herein. Also, in some embodiments, the CNN model 224, RF Classifier model 226 and RTM Calculation Logic 228 may be part of an overall RTM Processing Logic 222.

In some embodiments, the RTM Calculation Logic 228 or the RTM Processing Logic 222 may also receive commands or requests from and provide RTM scores data to a User Device 276, e.g., a smart phone, computer, laptop, tablet, or other computer-based device, which may receive instructions from a user 277. The user device 276 may have an RTM software application 280, or RTM App, which may interact with the user 277 via a display 278 on the user device 276. The RTM App 280 may display the parameters discussed herein in various formats desired by the user. The user device 276 may also request the RTM Calculation Logic 228 to determine certain RTMs for a given application, such as the end applications discussed herein. In some embodiments, the user device 276 may access the RTM Server 282 directly to retrieve the desired RTMs for a given application, e.g., the RTM App 280. Also, the RTM score data of the present disclosure may be provided to the RTM App (or other application) on demand by request of a user or software application program or continuously in realtime as player tracking data is received during a sporting event or may be stored in a database or server for later use or access by a user or an application.

Figure 4A:
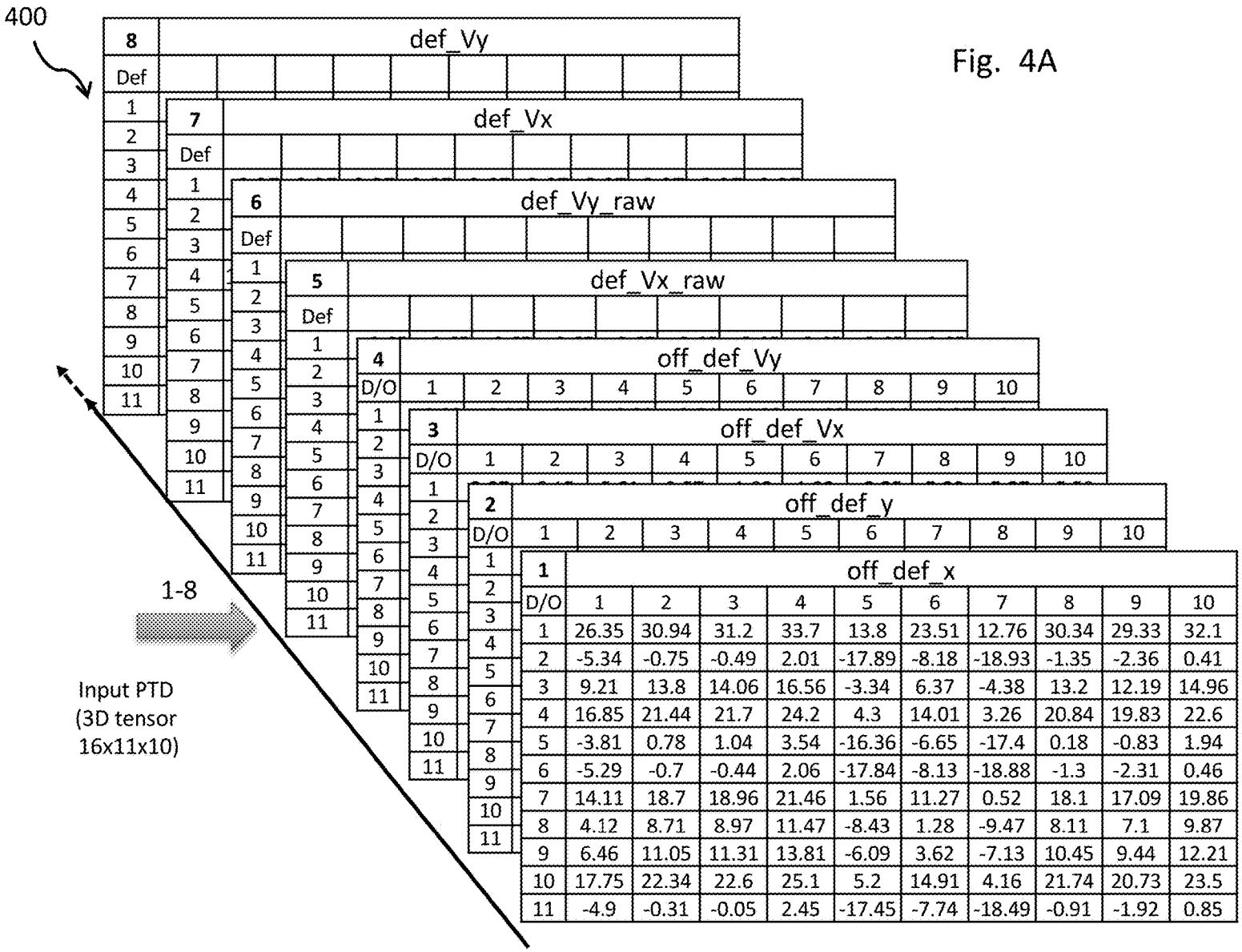
FIG. 4A and FIG. 4B shows sample input player tracking data tables for a 3D tensor matrix format, in accordance with embodiments of the present disclosure.
Figure 4B:
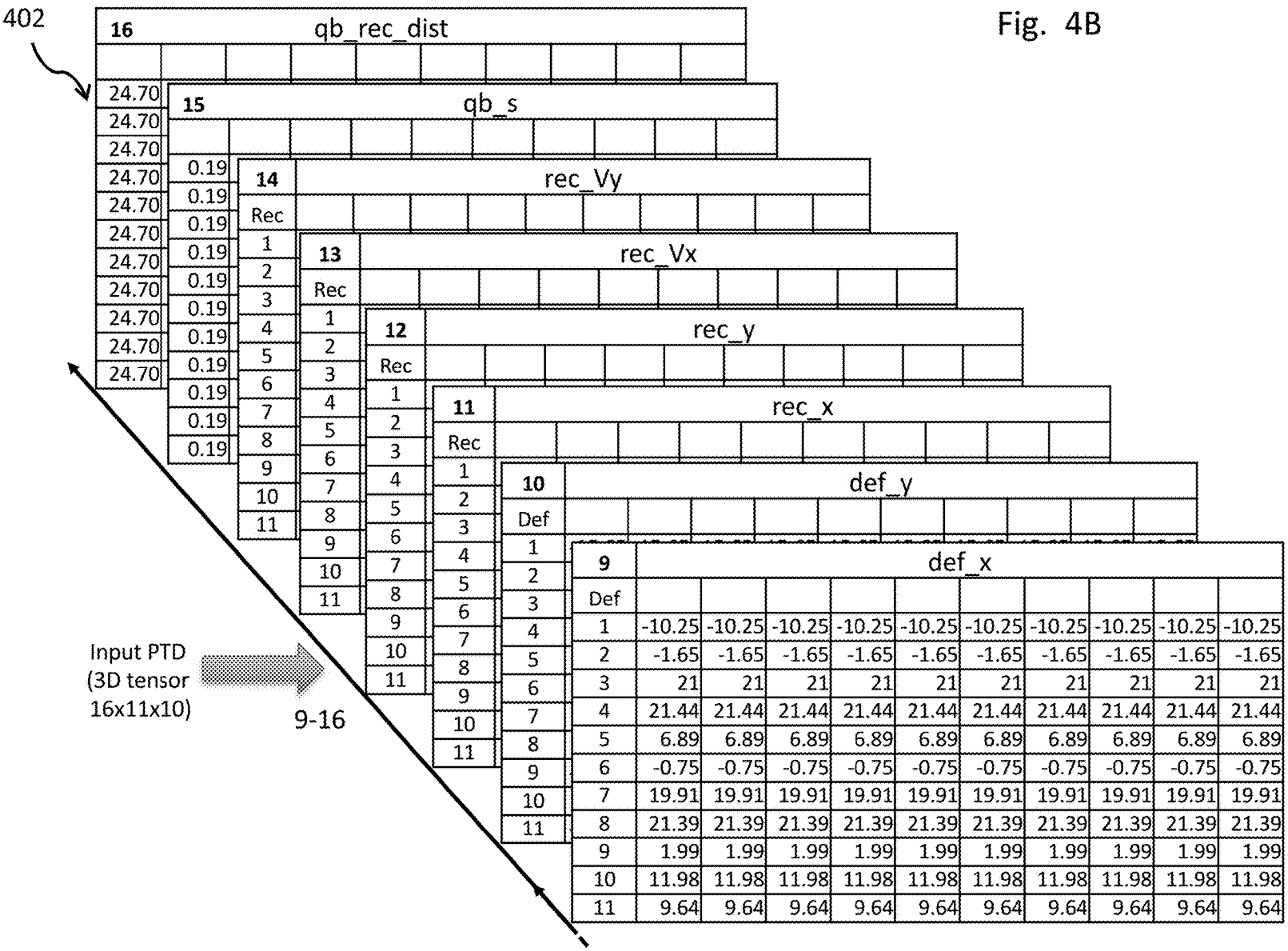

Referring to FIG. 3A, a top-level block diagram 300 shows components of a Neural Network Model (or Convolutional Neural Network or CNN) 224 of FIG. 2B, in accordance with embodiments of the present disclosure, which includes 6, 1-dimensional convolutional/pooling layers for feature recognition and 3 fully connected dense layers, as discussed hereinabove. It also provides a loss or cost function during training to drive the CNN model error to an acceptably low level as shown by the line 316. The CNN model receives input data on a line 302 structured as a 3D tensor or matrix of dimensions 16×11×10 (number of input variables (16)× defenders (11), × offensive players (10) (11 minus the receiver, since the variables are relative to the receiver's own variables). For input variables that are not an 11×10 matrix (e.g., vectors or single value variables), values are repeated in an appropriate way to conform to the 3D matrix format, as shown in more detail with the sample training data shown in FIGS. 8A-8Q. FIGS. 4A and 4B shows a sample set of input player tracking data tables illustrating a 3D tensor matrix format, in accordance with embodiments of the present disclosure.

More specifically, as is known, Convolutional/Pooling Layers (or Feature Detector or Feature Recognition) 302 comprise a convolutional layer paired with a pooling layer, which may repeat in series several times. The convolutional layers act like a filter over the data, scanning a few pieces of data at a time and creating a feature map that predicts the class to which each feature belongs, and the pooling layers (or down-sampling or sub-sampling) reduce the amount of information in each feature map from the prior convolutional layer while maintaining the most important information. There are typically several rounds of convolution and pooling that occurs to provide the desired output size for the Detected or Recognized Features. The recognized features are provided to the fully connected dense layers 306, which receive the training data set (during training) on a line 308 and the CNN model parameters (during run time) on a line 310.

Referring to FIG. 3B, a block diagram 350 shows one embodiment for implementing the Neural Network Model 224 of FIG. 3A, using five (5) CNN models, in accordance with embodiments of the present disclosure. In particular, in some embodiments, the CNN model 224 may be broken into five separate CNN models 354, 356, 358, 360, 362, each CNN model using a different 4/5 of the data 352 as separate model inputs on lines 353, 355, 357, 359, 361, respectively, and the results from each of the five models 354, 356, 358, 360, 362 are fed to a box 372 on lines 363, 365, 367, 369, 371 where the results are averaged (ensembled) to provide the resulting output prediction probability on a line 374. The five CNN models 354, 356, 358, 360, 362 are independently trained and validated using a known "cross-validation" technique. Other training and validation techniques and number of CNN models may be used for implementing the CNN model 224 if desired.

Figure 5A:
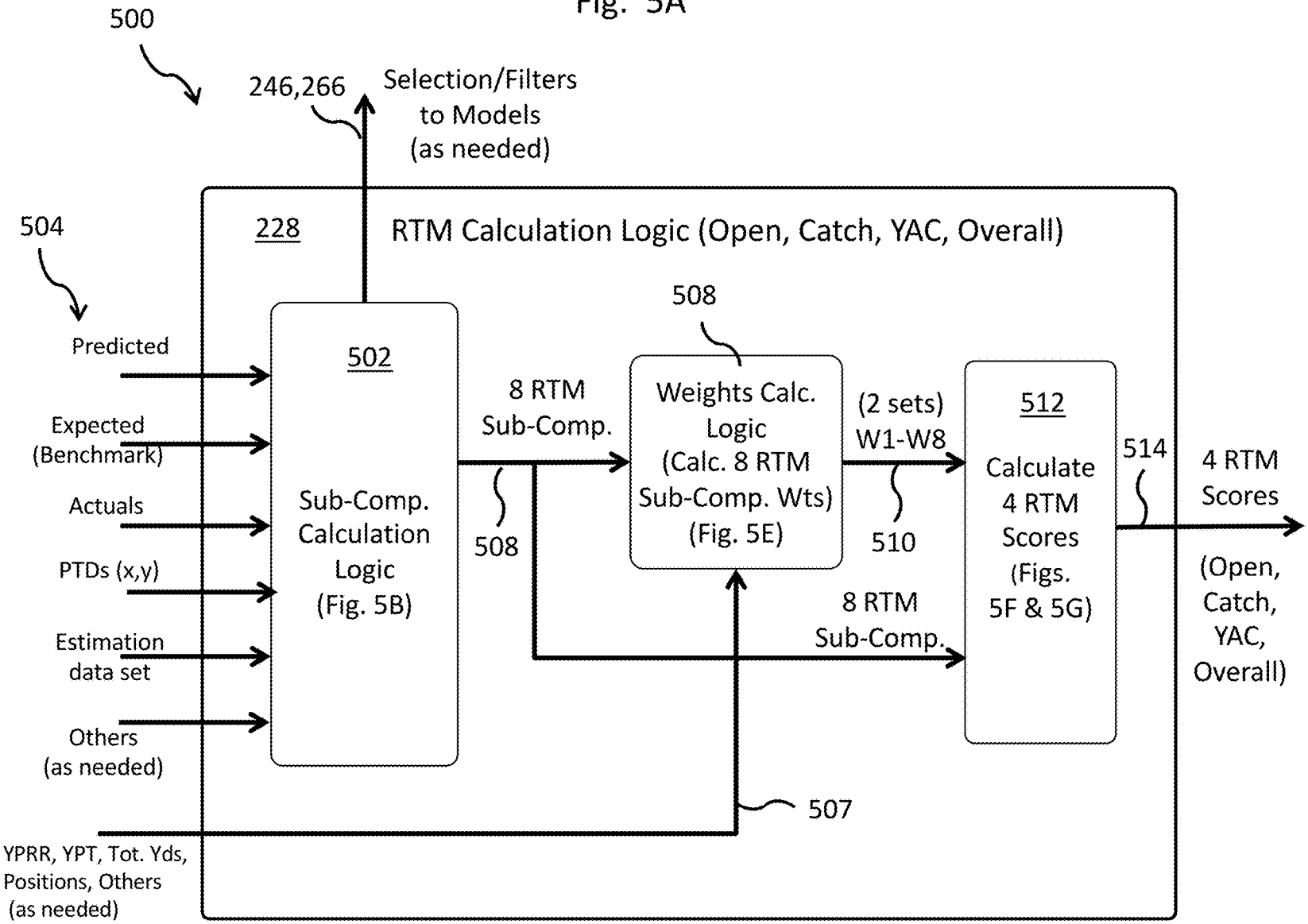
FIG. 5A is a block diagram showing components of an RTM Calculation Logic of FIG. 2B, in accordance with embodiments of the present disclosure.
Figure 5B:
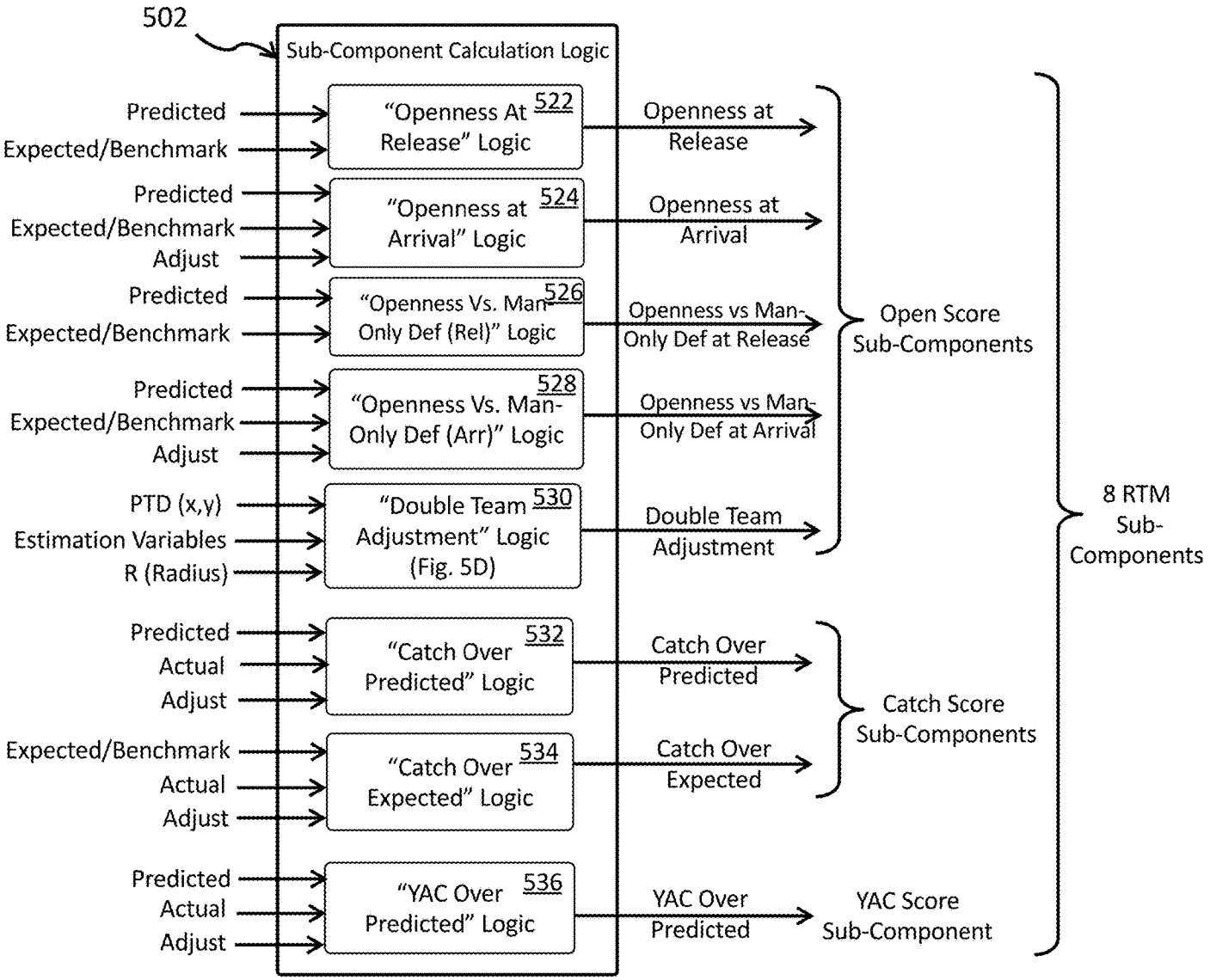
FIG. 5B is a block diagram showing components of a Sub-Component Calculation Logic of FIG. 5A, in accordance with embodiments of the present disclosure.
Figure 5D:
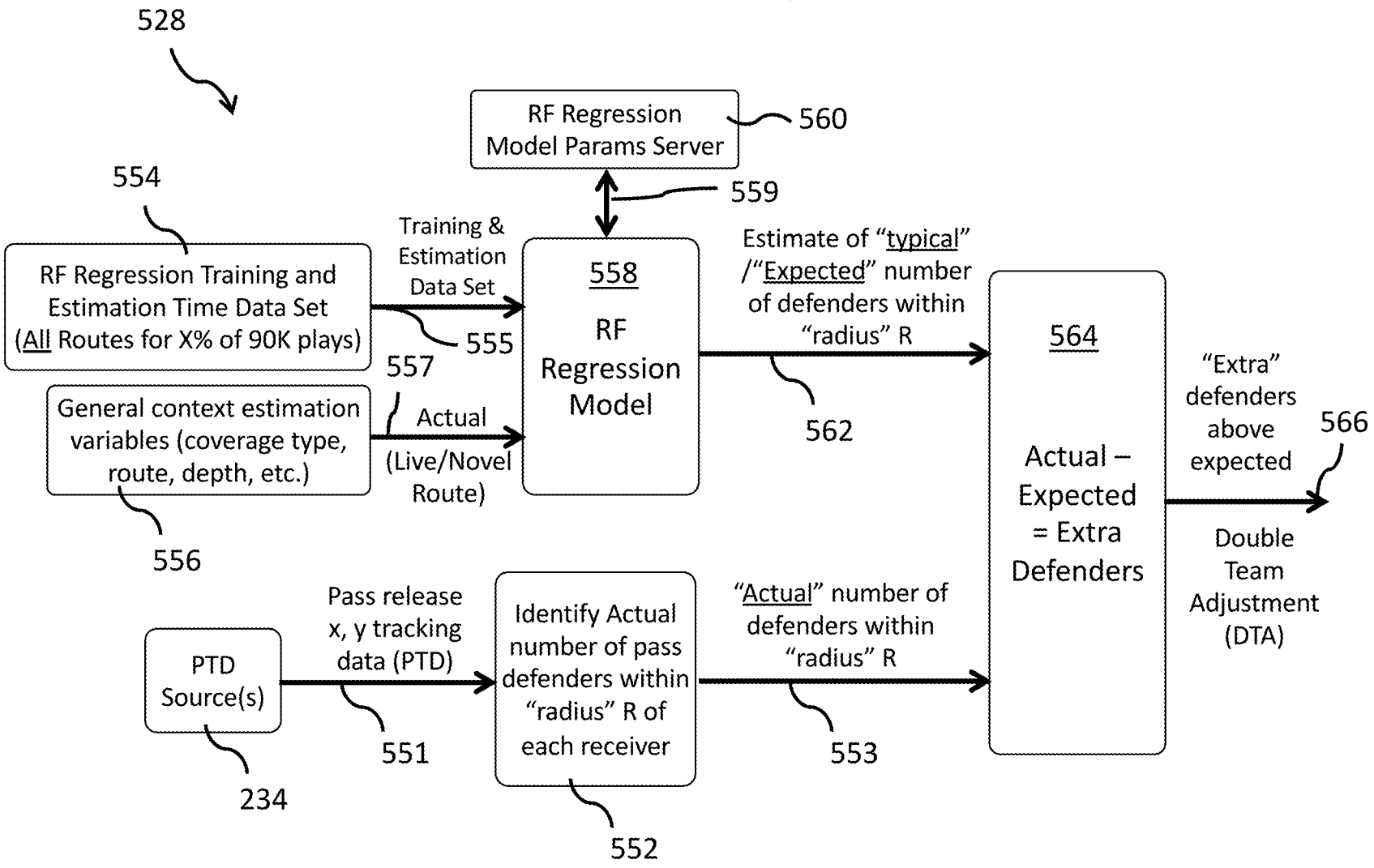
FIG. 5D is a block diagram showing components of a Double Team Adjustment Logic of FIG. 5B, in accordance with embodiments of the present disclosure.

Referring to FIGS. 5A-5H, block diagrams and tables associated with the RTM calculation logic 228 of FIG. 2B are shown. Referring to FIG. 5A, a top-level block diagram 500 is shown with components of the RTM Calculation Logic 228 of FIG. 2B, for calculating the four (4) RTM scores, in accordance with embodiments of the present disclosure. In particular, a Calculate RTM Sub-components Logic 502 receives input data 504, such as predicted, expected (benchmark), actuals, PTDs (Player Tracking Data), estimation variables, and any other needed data to determine or calculate the eight (8) RTM sub-components, as discussed herein with FIGS. 5B and 5C, and provides selection/filter commands or requests to the CNN model 224 and RF Classifier Model 226 on lines 246, 266 (shown as a single line). The Logic 502 provides the eight (8) RTM sub-components on a line 506 to a Weights Calculation Logic 508, which calculates the eight (8) sub-component weights W1-W8, as discussed herein with FIG. 5E, e.g., two sets of weights W1-W8 (WR/TE) and W1-W8 (RB). The eight (8) sub-component weights W1-W8 are provided to logic 512 which calculates the four (4) RTM scores, as discussed herein with FIGS. 5F and 5G, and provides the RTM scores (Open, Catch, YAC, Overall) on a line 514, which may be provided to the RTM Server 272 (FIG. 2B) or the user device 276, as discussed herein.

Referring to FIGS. 5B and 5C, a block diagram (FIG. 5B) and table (FIG. 5C), respectively, are shown for the Calculate RTM Sub-Component Logic 502 (FIG. 5A), for calculating the eight (8) sub-components for the RTMs, as described herein. In particular, there are eight (8) separate logics 522, 524, 526, 528, 530, 532, 534, 536, one for each of the sub-components. FIG. 5C is a table 540 providing the calculations used for each component or sub-component of the RTM and the PTD data snapshot time and associated pass play routes used (targeted or all) for the calculation.

Regarding the openness vs man-only defense coverage (at release and arrival) (OVMR, OVMA) sub-components, man-only defense plays are used to emphasize a premium skill in football receivers. Getting open vs man coverage defense is difficult and requires individual attributes independent of offensive or defensive scheme. Openness on man defense plays averages openness-over-expected metrics on man-coverage plays only (usually about 40%) of plays, determined at pass release (OVMR) and at arrival (OVMA). Instead of averaging over all pass plays for each receiver, the plays are filtered to only man-coverage plays (e.g., exclude plays having zone defense coverage), and then the average is computed. Also, for Openness vs Man-Only at arrival (OVMA), the result is adjusted for the QB and throw accuracy, similar to that done for the Openness at Arrival sub-component, as discussed herein.

Referring to FIG. 5D, a block diagram is shown of the Double Team Adjustment Logic 528 (FIG. 5B), which provides the Double Team Adjustment (DTA) sub-component. In particular, top performing receivers are often given extra attention by defenses in pass coverage i.e., the receiver is being covered my more than a typical or expected number of defenders. This is typically known as "double-teaming," but in practice is more complex than a 2-on-1 coverage assignment. If this effect were not accounted for, top receivers would be penalized in the receiver metrics, because they would appear less "open" than otherwise. In addition, the extra attention from defenders on a given receiver allows teammate receivers extra space to be more open. To account for this effect, the system receives pass release X, Y player tracking data (PTD) on a line 551 from PTD sources 234 (FIG. 2B) discussed herein, and logic 552 calculates the number of defenders within a chosen "radius" R of the receiver at pass release time using the PTD and provides that value of the actual number of defenders with "radius" R on a line 553 to logic 56.

In parallel, a Random Forest (RF) Regression model 558 using data 554, 556, on lines 555, 557, respectively, which is the same subset of data used to for the RF Classifier Model 226 (FIG. 2B) for the general "expected" (benchmark) openness model, calculates the "typical" number of defenders within radius R on a line 562. Next, for each pass route, a comparison of the "actual" number of defenders with the "typical" number of defenders is performed by Extra Defenders calculation logic 564, by taking the difference of Actual-Expected, which indicates how much extra attention a receiver is getting. Next, the logic 564 averages the Actual-Expected value over each route run, by receiver, to provide the Double Team Adjustment (DTA) parameter on a line 566, which is one of the sub-components of the overall system, and is grouped within the "openness" component.

More specifically, the RF Regression Model 558, performs the calculation for estimating the "typical" number of defenders within a chosen "radius" R value, where R may be a physical distance or a combination of physical distance and velocity (direction and speed similarity). The RF Regression model 558 for the DTA sub-component uses the same estimation input data as the RF Classifier model 226 (FIG. 2B), but instead of being a "classifier" model for catch/not catch, it's a "regression" model estimating a numeric value, in this case the "radius" R value. In some embodiments, the radius R value may be a combination of distance and velocity with a value of R=12; however, other R values may be used if desired. Also, the RF Regression model 558 is trained using RF Regression Training data which includes all routes run, which is different from RF Classifier model 226 (FIG. 2B), which uses only targeted routes, where a catch/no-catch result is provided for training the RF Classifier 226. Also, during training, the RF Regression model 558 provides the RF Regression Models Parameters on a line 559 to an RF Regression Models Parameters Server 560 for use during RF Regression model estimation time.

In some embodiments, the value of the "radius" R may be a predetermined physical distance between the receiver and defenders in yards, e.g., 10 yards. Any other number of yards determined to be close enough to be considered defensive coverage may be used, e.g., 5 yards, 10 yards, 15 yards, 20 yards, or any other number of yards. In some embodiments, the "radius" R may be a combination of physical distance and velocity as described herein above, e.g., the number of defenders who best match the receiver's location, speed and direction within a predetermined desired threshold, and excluding those that better match a different receiver, and, in some embodiments, may also be subject to a further constraint that each receiver be assigned to at least one defender. In that case, the calculation may be performed using an Integer Programming tool, which is a mathematical optimization tool where the results must be an integer, in this case 0 or 1 (as each defender is an integer number). This may be solved by various algorithms such as the known Simplex algorithm or the known Hungarian algorithm, and may be referred to as a mathematical "assignment" problem. Ultimately, the comparison of how many defenders are "typically" matching a given receiver, given the route, depth, coverage type, and the like, with how many are "actually" matching him identifies when, and to what degree, a receiver is getting extra attention from the defensive secondary on a given play.

Figure 5E:
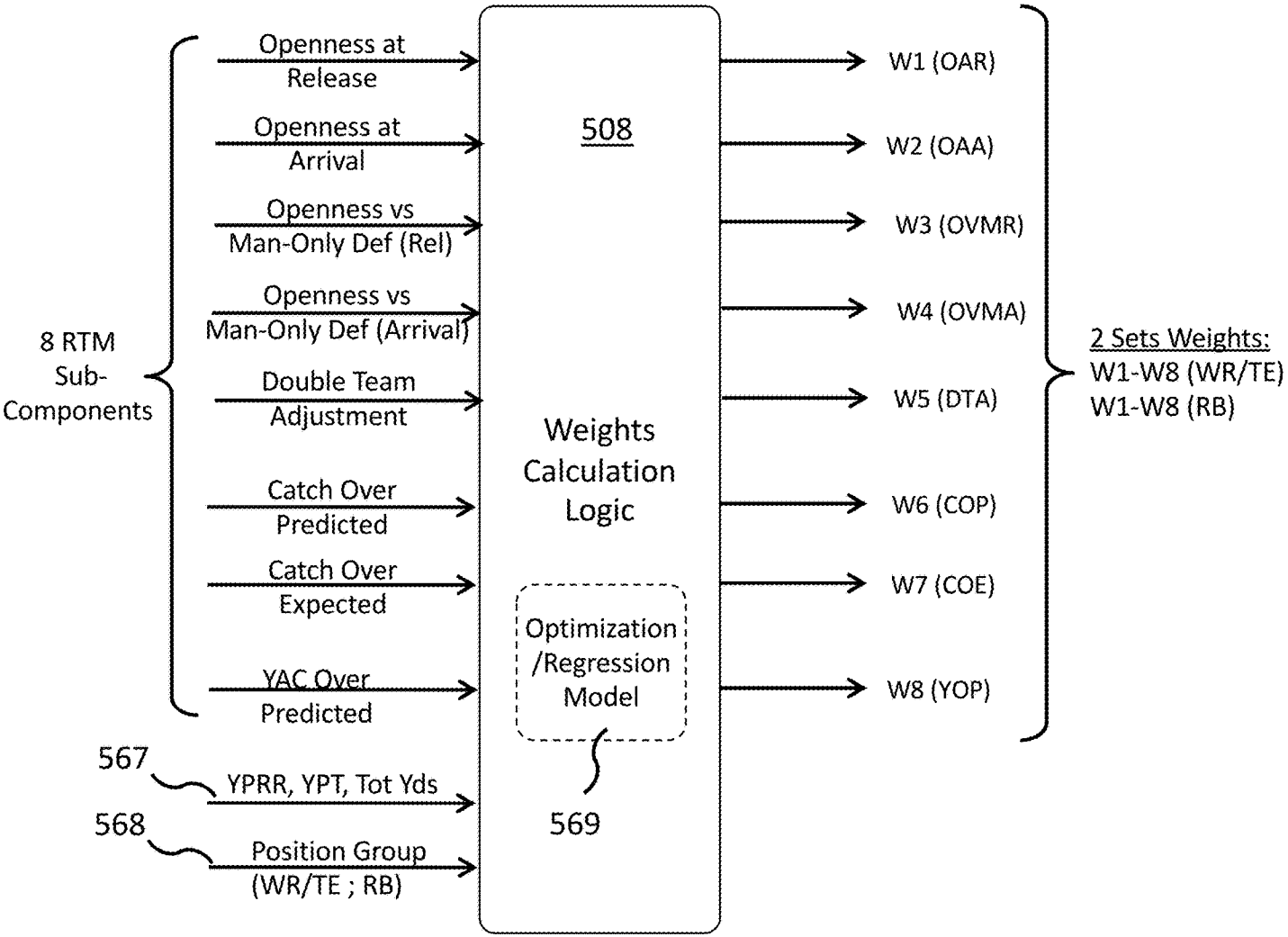
FIG. 5E is a top-level block diagram a Weights Calculation Logic of FIG. 5A, in accordance with embodiments of the present disclosure.

Referring to FIG. 5E, the Weights Calculation Logic 508 (FIG. 5A) is shown, which receives the 8 RTM Sub-Components, known real-world production metrics for receivers YPTT, YPT, and Tot Yds, on a line 567, and a receiver position group, e.g., WR/TE group and RB group, on a line 568, and which determines two sets of the weights W1-W8 associated with each of the sub-components, one set for WR/TEs and the other set for RBs. In particular, weights W1-W8 may be determined by an optimization/regression model 569 which uses the input parameters and determines values for the weights W1-W8 that correlates the RTM sub-components with real-world "production" metrics or stats at the receiver level. Real-world "Production" for a receiver is defined as a predetermined combination (or mix) of the known receiver production data or metrics or stats, such as YPRR (yards per route run), YPT (yards per target or average yards the receiver gets when thrown to (targeted) including both air and ground yards) and Tot Yds (or total yards per game or YPG). Other receiver parameters or stats or metrics may be used if desired for determining the mix of receiver real-world "production" metrics or stats. Thus, the weights W1-W8 may be determined using an optimization/regression model on standardized variables, and, in some embodiments, each RTM sub-category score may be transformed to mean=0 and std dev=1 prior to regressing.

In particular, referring to FIGS. 5I, a table 586 is shown for determining the weights W1-W8 for the WR/TE receiver group, where row 587 shows how each metric YPG 587A, YPRR 587B, and YPT 587C correlates with RTM total (or Overall RTM score) 587E, cell 587D shows the real-world "mix" result of the equation in row 585 for the predetermined mix (or blend or proportion) of the receiver 'real-word' production stats or metrics, row 590 shows values for the weights W1-W8, as shown by corresponding W1-W8 labels in row 589, and row 588 shows the column headings for the eight (8) RTM sub-components, followed by three (3) receiver "real world" production stats (Total Yds_per_game (ypg), YPRR, YPT), followed by player Position (WR or TE for this table), and RTM Total (or Overall RTM score) 587E. Each row under row 588 represents the season average for that player for the respective column headings shown in row 588.

Regarding "mix" of real-world production stats used to determine the weights, cell 585 shows the equation for the Mix of YPRR (yards per route run), YPT (yards per target), and Tot Yds (total yards per game or ypg or YPG) to approximate receiver real-world production for determining the weights W1-W8, e.g., Mix=(0*YPG+3*YPRR+1*YPT). In this example, the YPG factor value was set to zero (no influence), YPRR had the largest factor value of 3, followed by YPT with a factor value of 1. Thus, in this example, YPRR has three times the weight of YPT for the WR/TE receiving group. Other values or factors may be used if desired for the proportions or mix of the receiver real-world production metrics. Also, the values for YPG, YPRR, YPT used in the Mix equation are shown in cells 587A, 587B, 587C, respectively, and were determined by performing individual correlations of the YPG, YPRR, YPT values with the RTM total 587E, i.e., correlations of YPG with the RTM Total, YPRR with RTM Total, and YPT with RTM Total, across all the players listed in the WR/TE receiver group. In some embodiments, the values for YPRR excludes non-targeted receivers on screen routes, as screen plays are typically designed for a specific receiver and thus is not indicative of the non-targeted receiver's ability. Also, in some embodiments, passes that are deemed uncatchable (e.g., too high for receiver to catch), are excluded from the YPT stat, as uncatchable passes are not indicative a targeted receiver's ability.

The weights W1-W8 in row 590 for each sub-component shown were determined by a known optimization or regression model or algorithm (or the like) which may be constructed within Excel® spreadsheet software application using the known Excel Solver tool, which may be configured to determine and optimize the weights W1-W8 as follows. Calculate the optimum set of weights W1-W8 which maximize the RTM total score's 587E correlation with the predetermined mix (or blend) of 'real-word' production stats 587D for that receiver group, subject to the following constraints: (1) each weight must be positive; (2) the weights are capped at a certain value to prevent one from dominating (e.g., 0.18); and (3) the sum of the weights=1 (i.e., W1+W2+W3+W4+W5+W6+W7+W8=1) to make them easier to understand as a proportion. Other optimization programs or algorithms and other constraints may be used if desired provided it provides similar function and performance to that described herein. The weights W1-W8 shown in FIG. 5I are the same for each player in the WRs and TEs receiver group.

Referring to FIG. 5J, the process for determining W1-W8 is done separately for RBs (including full backs and any other back that receives the ball) as a receiver group, as shown in table 592, which is similar to the table 586 of FIG. 5I. The separate set of weights W1-W8 for the RBs receiver group is due to the very different nature of their roles in the passing game, as discussed herein. The weights W1-W8 are the same for each player within each receiver group (WR/TE, RB).

In particular, a table 592 is shown for determining the weightings W1-W8 for the RB receiver group, where row 597 shows how each metric YPG 597A, YPRR 597B, and YPT 597C correlates with RTM total (or Overall RTM score) 597E, cell 597D shows the real-world "mix" result of the equation in row 595 for the predetermined mix (or blend) of the 'real-word' production stats for that receiver group, row 593 shows values for the weights W1-W8, as shown by corresponding W1-W8 labels in row 596, and row 594 shows the column headings for the eight (8) sub-components, followed by three (3) components for the real world production stats (Total Yds_per_game (YPG), YPRR, YPT), followed by player Position (RB for this table) and RTM Total. Each row under the row 594 represents the season average for that player for the respective column heading sub-component shown in row 594.

Regarding the "mix" of real-world production stats or metrics used to determine the weights for RBs, cell 595 shows the equation for the Mix of YPRR (yards per route run), YPT (yards per target), and Tot Yds (total yards per game or ypg or YPG) to approximate real world production for determining the weights, e.g., Mix=(0*YPG+1*YPRR+2*YPT). In this example, the YPG factor value was set to zero (no influence), YPT had the largest factor value of 2, followed by YPRR with a factor value of 1. Thus, in this example, YPT has twice the weight of YPRR for the RB receiving group. Other values or factors may be used if desired for the proportions or mix of the real-world production metrics. Also, the values for YPG, YPRR, YPT used in the Mix equation are shown in cells 597A, 597B, 597C, respectively, and were determined by performing individual correlations of YPG with the RTM Total, YPRR with RTM Total, and YPT with RTM Total, across all the players listed in the RB receiver group. In some embodiments, the values for YPRR excludes non-targeted receivers on screen routes, as screen plays are typically designed for a specific receiver and thus is not indicative of the non-targeted receiver's ability. Also, in some embodiments, passes that are deemed uncatchable (e.g., too high for receiver to catch), are excluded from the YPT stat, as uncatchable passes are not indicative a targeted receiver's ability.

Similar to FIG. 5I, the weights W1-W8 in row 593 for each sub-component shown were determined by an optimization or regression model or algorithm constructed within Excel spreadsheet software application using the known Excel Solver tool, which was configured to determine and optimize weights W1-W8 as follows. Calculate the optimum set of weights W1-W8 that maximize the RTM total score's correlation with that predetermined mix (or blend) of 'real-word' production stats, subject to the following constraints: (1) each weight must be positive; (2) the weights are capped at a certain value to prevent one from dominating (e.g., 0.18); and (3) the sum of the weights=about 1 (i.e., W1+W2+W3+W4+W5+W6+W7+W8=1) to make them easier to understand as a proportion. The weights W1-W8 shown in FIG. 5J are the same for each player in the RB receiver group.

Figure 5F:
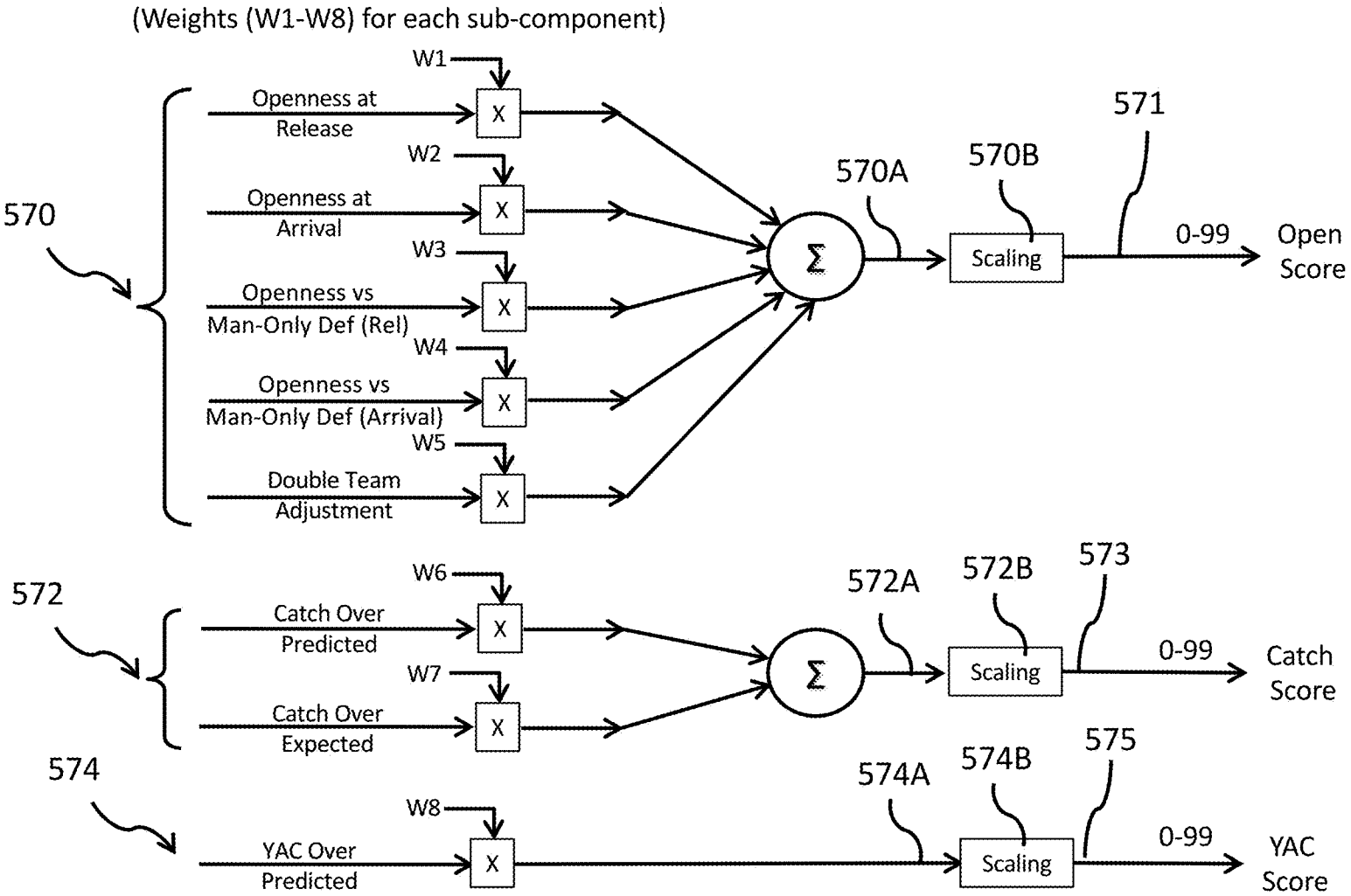
FIG. 5F is a diagram showing the calculation from FIG. 5A of three RTM scores, in accordance with embodiments of the present disclosure.

Referring to FIG. 5F, which shows the calculations for the three major RTM scores (Open, Catch, YAC). In particular, once the weights (W1-W8) for each sub-component are determined as described herein with FIG. 5B, the sub-components are grouped by area. More specifically, the inputs 570 are each of the sub-components associated with the Open score, which are each multiplied by the corresponding weight W1-W5 for that sub-component and then summed together to provide an unscaled Open score on a line 570A. Similarly, the inputs 572 are each of the sub-components associated with the Catch score, which are each multiplied by the corresponding weight W6-W7 for that sub-component and then summed together to provide an unscaled Catch score on a line 572A. Similarly, the input 574 is the sub-component associated with the YAC score, which are is multiplied by the corresponding weight W8 for that sub-component to provide an unscaled YAC score on a line 574A. Thus, for each receiver, the corresponding weights W1-W8 are applied and summed (as appropriate) for the three major components or scores (Open, Catch, YAC) as shown. YAC has only one sub-component, so technically no sum necessary. The results are three RTM scores for each receiver: 1 for Openness sub-components, 1 for Catch sub-components, and 1 for YAC. These three RTM scores (Open, Catch, YAC) may be unitless and on arbitrary or normalized scales; thus, in some embodiments, the RTM scores Open, Catch, YAC on lines 570A, 572A, 574A may be transformed (or re-scaled) by the scaling blocks 570B, 572B, 574B to provide the final scaled RTM scores for Open, Catch, YAC on lines 571, 573, 575, respectively, each having a scale of 0-99, where 50 is average. 99 and 0 roughly equate to three standard deviations from the mean or average, which is also similar to how the Overall RTM score is transformed (discussed below). Other score ranges may be used if desired, e.g., 0-99.99 or 0-100.

Figure 5G:
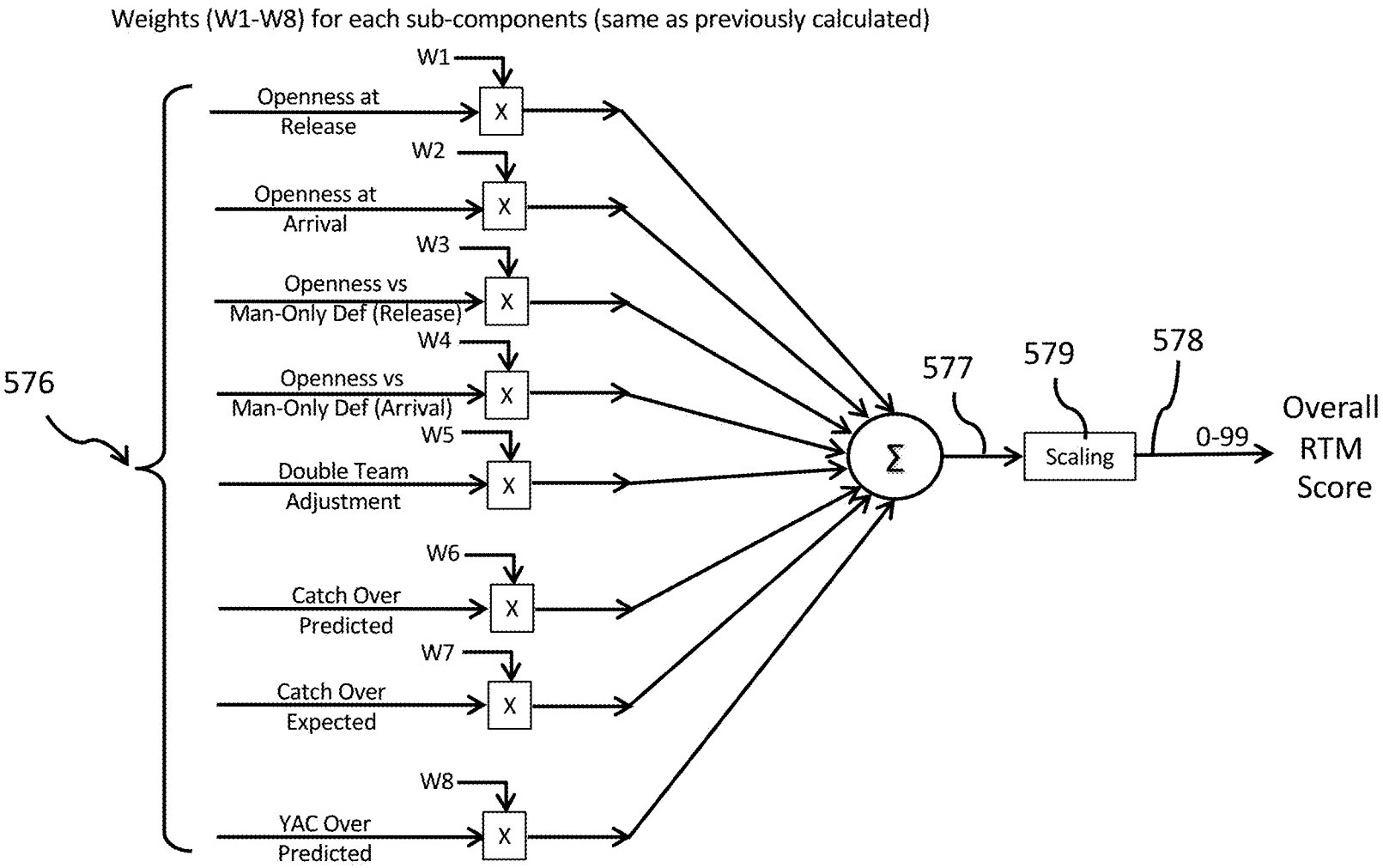
FIG. 5G is a diagram showing the calculation from FIG. 5A of an Overall RTM score, in accordance with embodiments of the present disclosure.

Referring to FIG. 5G, which shows the calculations for the Overall RTM score. In particular, the Overall RTM score is calculated as the weighted sum of each standardized sub-component score. More specifically, the inputs 576 are each of the 8 sub-components calculated as discussed herein with FIG. 5B, each sub-component is multiplied by the corresponding weight W1-W8 for that sub-component and then summed together to provide an unscaled Overall RTM score on a line 577. The result is unitless and on an arbitrary scale. weights (W1-W8) are associated with each sub-component. The Overall RTM score is then transformed (or re-scaled) by the scaling block 579 to provide the final scaled Overall RTM score on a line 578 having a scale of 0-99, where 50 is average. 99 and 0 roughly equate to three standard deviations from the mean or average. Other score ranges and averages may be used if desired, e.g., 0-99.99 or 0-100. The Overall RTM score may be viewed as a best estimate of receiver real-world production, based on a predetermined proportioned combination or Mix of real-world performance metrics (as discussed herein with FIGS. 5I and 5J) of YPRR, YPT, TOT YDS, e.g., 90% YPRR, 5% YPT, 5% Tot Yds (or Total Yds per game or YPG), or 75% YPRR, 25% YPT, 0% Tot Yds, where YPRR was selected as the dominant stat (e.g., YPRR having 3 times the weight of YPT) indicative of real-world receiver performance for the WR/TE receiving group. Also, for the RB receiver group, the dominant stat may be YPT, having a Mix of real-world production metrics YPRR, YPT, TOT YDS of, e.g., 33% YPRR, 67% YPT, 0% Tot Yds (e.g., YPT having 2 times the weight of YPRR). Any other Mix of real-world performance metrics may be used if desired for a given receiver group. In some embodiments, the proportions may be determined such that the better receivers are near the top and the lesser receivers are toward the bottom, based on the general reputation of how productive the receivers were in recent seasons (e.g., 2017-2021). Other values for the predetermined proportions or Mix of real-world performance metrics of YPRR, YPT, and Tot Yds or just YPRR, YPT (where Tot Yds is set to zero or is otherwise considered not to be a contributing metric for both receiver groups) may be used if desired.

Referring to FIG. 5H, a table 580 show some sample aggregate weights having columns grouped by RTM score (Open, Catch, YAC) and rows grouped by receiver group, where the row for WR &TE (Wide Receivers) and Tight Ends) receiver group have a set of weights W1-W8, and where the row for RB (Running Backs) receiver group, have another set of weights W1-W8.

Figure 6A:
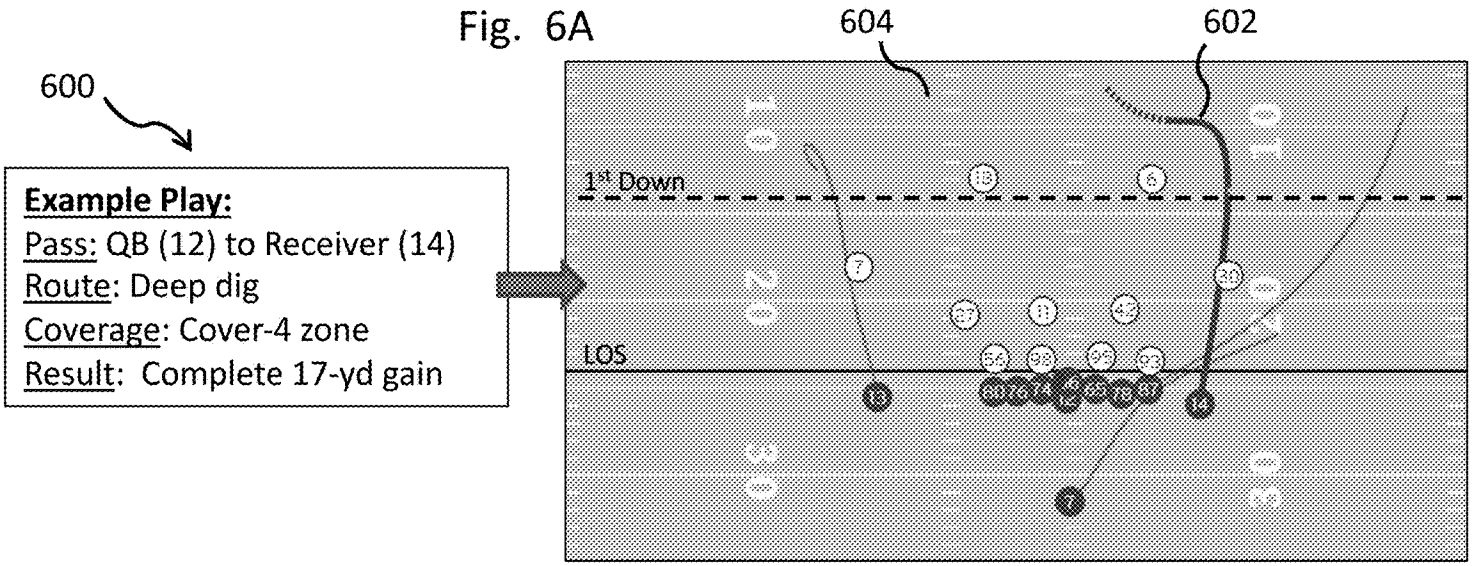
FIG. 6A, shows an example football pass play and defensive coverage and result, in accordance with embodiments of the present disclosure.

Referring to FIGS. 6A, 6B, 6C, and 6D, an example football pass play is shown as well as how certain RTMs components or sub-components would be determined, in accordance with embodiments of the present disclosure. Referring to FIG. 6A, an example football pass play is shown by a box 600 and play diagram 614 where the numbers of each of the players is shown within circles, and the offense is shown as black circles with white numbers inside and the defense is shown as white circles with black numbers inside. In this example, the quarterback (QB) 12, is passing the football to the receiver 14 who is running a pass route shown by a curved line 602. The defense is using a "Cover-4" zone defense (see FIG. 7C for explanation of defensive coverages), and the result of the play is a 17 yard gain from the line of scrimmage (LOS).

Figure 6B:
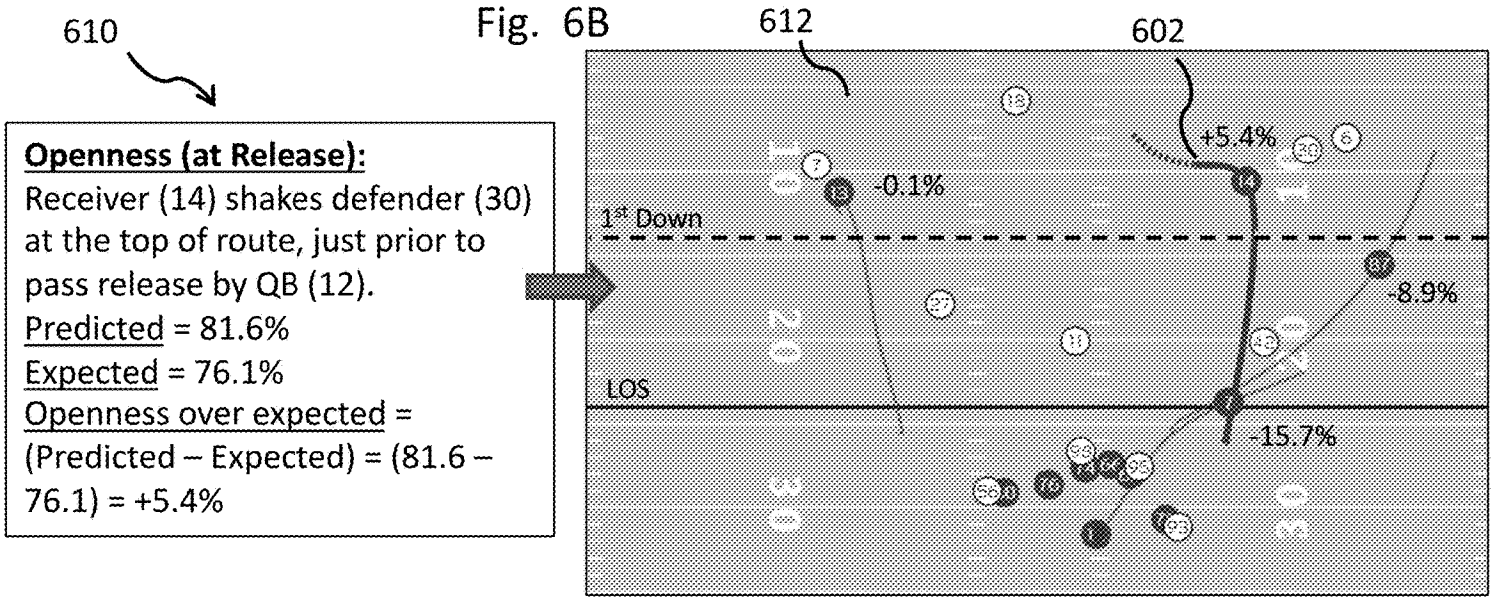
FIG. 6B, FIG. 6C, and FIG. 6D show how certain RTMs would be determined for the play in FIG. 6A, in accordance with embodiments of the present disclosure

Referring to FIG. 6B, the calculated openness at release (OAR) sub-component of RTM is shown by a box 610 and play diagram 612. In particular, the receiver 14 shakes free from the defender 30 at the top of the pass route 602 just prior to pass release by the QB 12. The "predicted" probability of completion using the CNN model 224 (FIG. 2B) and player tracking data (PTD) is calculated by the system of the present disclosure to be 81.6%. Also, the "expected" or estimated probability of completion for a typical/average receiver using the RF Classifier model 226 (FIG. 2B) is calculated by the system of the present disclosure to be 76.1%. Accordingly, the value of Predicted-Expected for the Openness at Release (OAR) sub-component is 81.6%-76.1%=5.4%, which shows for this play, the receiver performed better than an average receiver by 5.4%. The play diagram 612 also shows the calculated Openness at Release for the other receivers 7, 87, 13, during the same play, which had values of −15.7%, −8.9%, and −0.1%, respectively, showing that the receiver 14 had the greatest amount of "openness" at the time of release of the pass and that the receiver 14 performed better than a typical/average receiver. It also shows that the other receivers 7, 87, 13, performed worse than a typical/average receiver, as their numbers were negative, with receiver 7 performing the worst, followed by receiver 87, and finally by receiver 13, who performed slightly below a typical/average receiver (with a value of −0.1%).

Figure 6C:
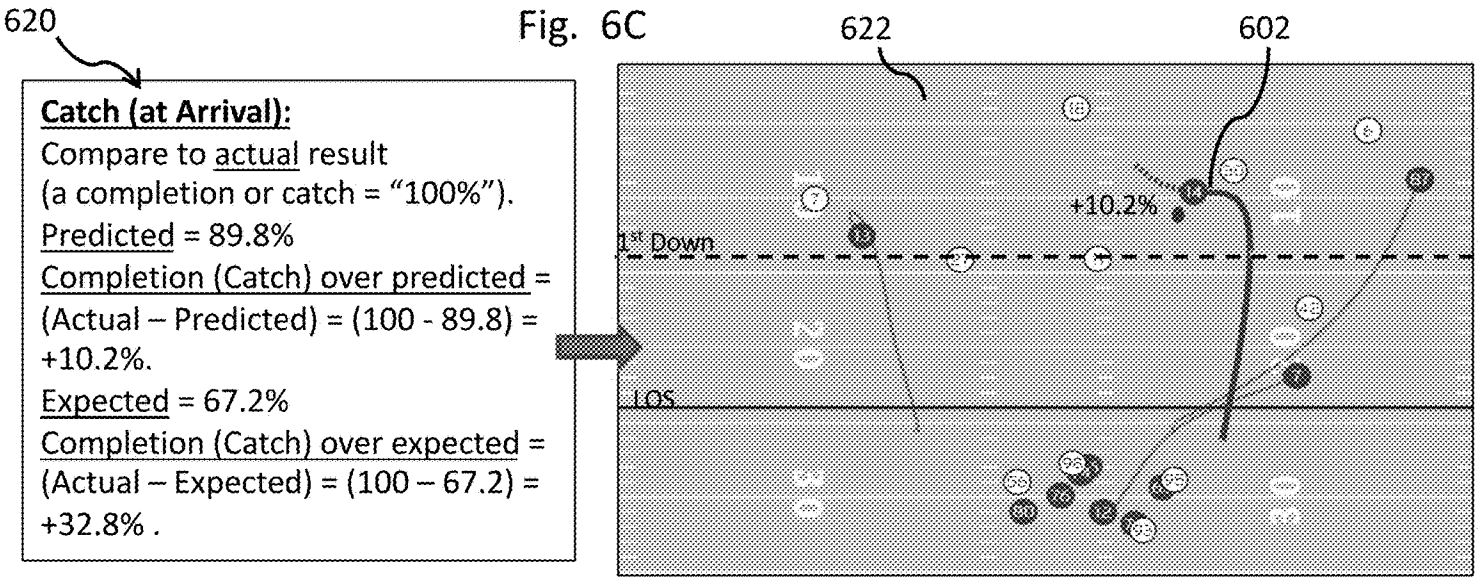

Referring to FIG. 6C, the Catch component of RTM is shown for the play of FIG. 6A by a box 620 and play diagram 622. In this case, for the Catch component of RTM, the "predicted" probability of completion and the "expected" probability of completion are each compared to the actual result, which is a completion or catch, which is 100%. In this case, the "predicted" probability of completion using the CNN model 224 (FIG. 2B) and player tracking data (PTD) is calculated by the system of the present disclosure to be 89.8%. Thus, the completion (catch) over predicted is calculated to be 100%-89.8%=10.2%. Also, the "expected" or estimated probability of completion for a typical/average receiver using the RF Classifier model 226 (FIG. 2B) is calculated by the system of the present disclosure to be 67.2%. Thus, the completion (catch) over expected is calculated to be 100%-67.2%=32.8%. This shows for this play, the receiver performed better than an average receiver by 32.8% and better than the predicted completion using PTD by 10.2%.

Figure 6D:
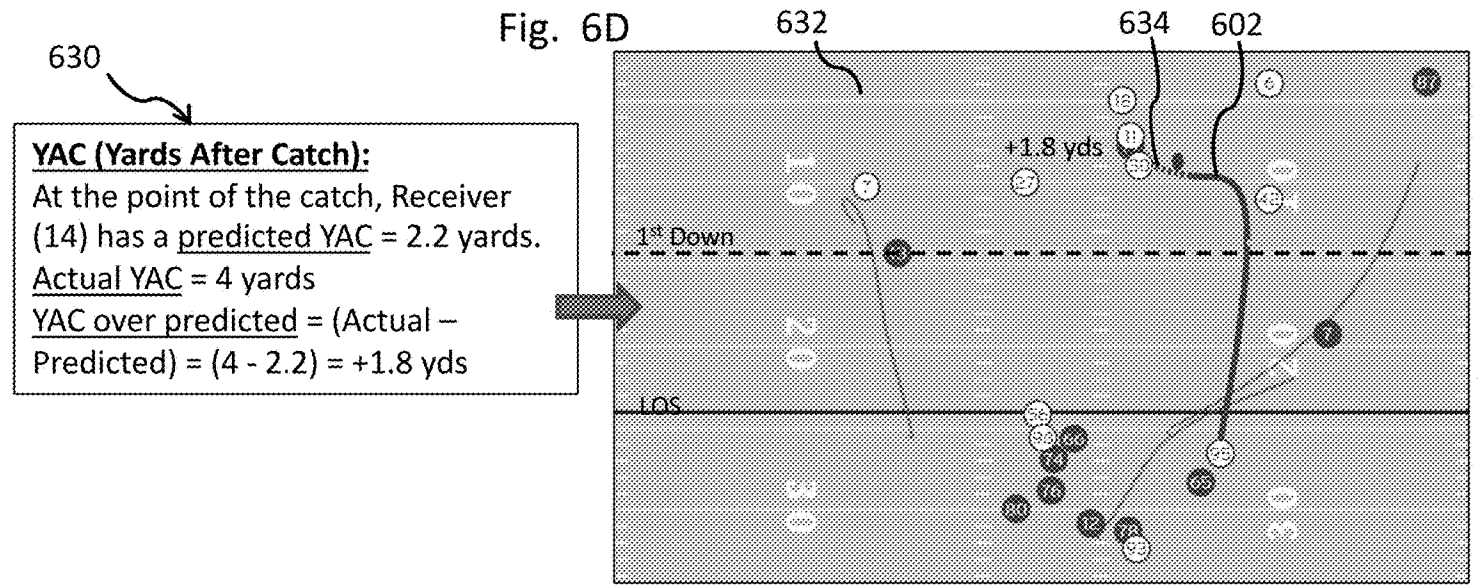

Referring to FIG. 6D, the YAC (Yards after Catch) component is shown for the play of FIG. 6A by a box 630 and play diagram 632. In particular, at the point of the catch, the receiver 14 has a "predicted" YAC of 2.2 yards using the CNN model 224 (FIG. 2B) and player tracking data (PTD) by the system of the present disclosure. In this case, the "actual" YAC (yards after catch) was 4 yards, as shown by the dashed line 634 after the pass route line 602. Thus, the YAC over predicted (Actual-Predicted) is calculated to be 4-2.2=+1.8 yards. This result shows that, for this play, the receiver performed better than predicted by 1.8 yards.

Referring to FIGS. 6E, 6F, 6G, 6H, and 6I, which show sample RTMs, receiver stats, and RTM rankings for various seasons, in accordance with embodiments of the present disclosure. The players listed herein may be indicated generically for illustration purposes as Player 1, Player 2, etc. and teams may be indicated generically as Team A, Team B, etc., and players or teams listed in one table are not necessarily related to or correspond to players or teams with the same numbers in another table herein.

In particular, FIG. 6E shows a table 640 showing receiving stats and RTM scores and top 12 RTM ranking, for WRs and TEs for 2022 season, with a minimum of 48 targets. FIG. 6F shows a table 650 showing receiving stats and RTM raw scores and top 20 RTM rankings, for WRs over 2017 to 2021 seasons, with a minimum of 250 targets. The dashed circles 652 indicate where the RTM scores are negative meaning that the receiver performed worse than a typical/average receiver. FIG. 6G shows a set of tables 660 showing best RTM scores for Overall, Open, Catch, and YAC from 2017 to 2021, as shown in tables 660A, 660B, 660C, 660D, respectively. FIG. 6H shows a table 670 with three columns showing top 10 Open score, Catch score, and YAC scores, for WR and TEs for the 2021-2022 season, having a minimum of 80 targets, 70 targets, and 80 targets. FIG. 6*I* shows a set of tables 680 showing top 10 Overall RTM scores for various seasons. In particular, table 682 shows top 10 WRs and TEs in overall score for 2021-2022, including postseason with a minimum of 80 targets, table 684 shows top 10 WRs and TEs in Overall RTM score from 2017-2022, including postseason with a minimum of 100 targets, table 686 shows top 10 RBs in overall score for 2021-2022, including postseason with a minimum of 45 targets, and table 688 shows top 10 WRs and TEs in overall score for 2022 season, with a minimum of 12 targets.

More specifically, referring to FIG. 6F, a table 650 is shown having wide receiver (WR) metrics for the 2017-2021 football seasons having a minimum of 250 targets and showing receiver stats on the left side of table and RTMs on the right side of the table. The RTMs (Overall, Open, Catch, YAC) are shown as "raw" scores, after the weightings (W1-W8) are applied and the summations are done (see FIGS. 5F and 5G) but before the scaling to 0-99 is performed. A negative number for the RTMs raw score means the receiver performed below how a typical receiver would perform, i.e., Predicted−Expected=negative number, as shown in dashed circles in the table of FIG. 6F.

In general, each metric is designed to isolate receiver's play as much as possible. For example, openness is calculated on all routes (targeted or not) factoring in the route the receiver is running, coverage, leverage, and defender positioning. Catch and YAC score are reflections on the players ability to catch the ball and achieve yards after the catch relative to expectation on the play based on the positioning of players on the field. As also discussed herein, the skill of the quarterback is factored into the metrics as well. As discussed herein, the four metrics are on a 0-99 scale with 50 being the approximate average. The overall RTM score is based on a combination of the three component (or attribute) scores, Open, Catch, YAC, as discussed herein. There may be some variance in the RTM metrics, thus, in some embodiments, it may be desirable to calculate RTMs on a season level as opposed to a game-by-game level, to reduce the effects of such variance.

Referring to FIG. 6J, the RTM tracks well to itself year-over-year, i.e., the RTM metric positively correlate year-to-year confirming it is capturing real, systemic qualities in receivers. In particular, a table 690 shows the stability/correlation of the RTM scores: Open (or Getting_Open), Catch (or Catch/Contest), YAC (or YAC Creation), and Overall RTM Metric (or Overall), which exhibit a Stability/Correlation of: 0.61, 0.38, 0.35, 0.52, respectively. In particular, for RTMs to measure an intrinsic quality or attribute associated with each individual receiver, the receivers should carry these qualities or attribute from year to year. For qualifying receivers, Open score has a correlation coefficient of 0.61, where 1.0 would be perfect consistency and 0.0 would be no consistency at all. This indicates that at 0.61 there is reasonable consistency for the Open score metric as a strictly objective measure of receiver performance. Catch score correlates at 0.38, and YAC score correlates at 0.35. The overall score correlates at 0.52.

RTMs also match up well with existing public benchmarks of receiver performance. In particular, since 2017, the overall RTM score correlates with Pro Football Reference's Approximate Value stat at 0.68, with EA Sports® Madden player rating at 0.59 and Pro Football Focus PFF® receiving grade at 0.76. For qualifying wide receivers (WRs), the overall score correlates at 0.76 with the statistic Yards Per Route Run (YPRR), and some experts believe that YPRR is the best conventional statistic to measure receiver production. Accordingly, a 0.76 correlation provides a strong correlation with real-world production and, thus, a strong indication that RTMs are effective at subtracting the influences of context, as in routes, depths, coverages, double teams, quarterback skill and so on. Also, the three components of RTM (Open, Catch, YAC) generally do not correlate with each other, which indicates that the Open, Catch, and YAC RTMs are isolating three independent skills that comprise receiver ability.

Referring to FIGS. 7A, 7B, 7D, and 7E, which show variables, definitions and training data associated with the Random Forest (RF) classifier model of FIG. 2B, in accordance with embodiments of the present disclosure. In particular, referring to FIG. 7A, a table 700 shows the Predictor Variables (route_max_depth, t_release, dist_to_boundary, route_class, coverage, pa (play action), los (line of scrimmage), down, togo (yards to go for 1str down), position), Results ("y" or "pass_comp"), and Other Labels in the training data (Game ID, Play ID, Player ID, Target ID, jersey no.) of FIGS. 7D and 7E. FIG. 7B shows a table 710 having pass route names and descriptions used in the training data of FIGS. 7D and 7E, and FIG. 7C shows a table 720 having defensive coverage names and descriptions used in the training data of FIGS. 7D and 7E.

Referring to FIGS. 7D and 7E, sample training data for the RF Classifier 226 is shown. In particular, FIG. 7D shows a table 730 having the tabular pass route input data for the RF Classifier model for targeted routes, which is used for training the RF Classifier. FIG. 7E shows a table 740 having tabular pass route input data for the RF Classifier model for ALL routes, which is used during run or estimation time for the RF Classifier 226. The dashed ovals in tables 730, 740 of FIGS. 7D and 7E indicate the same player in both tables, and in FIG. 7E, the ovals show when that player was targeted on a given play. For example, a given play e.g., Play ID 94, may be run multiple times in a given game, but a given receiver, e.g., Player ID 253265, may be targeted only once, e.g., when the Player ID is the same as the Target ID.

The RF Classifier model 226 (FIG. 2B) is trained in a conventional supervised learning method. The predictors come from conventional tabular pass route data, where each row is an observed pass route run and each column represents a predictor variable. In particular, tabular pass route data as used herein means each row is one 'observation' (in our case a pass attempt), and each column represents one of the predictor variables. Also, the factor-type (categorical) variables are converted into multiple binary columns, one for each possible value. Training on the RF Classifier Model was conducted using a randomly selected fraction of about 40% of 90,017 actual targeted pass plays from the 2017-2021 seasons. Other fractions of the pass plays may be used if desired.

Referring to FIGS. 8A, 8B, 8C, 8D, 8E, 8F, 8G, 8H, 8I, 8J, 8L, 8M, 8N, 8O, 8P and 8Q, which shows variables, definitions and training data associated with the Convolutional Neural Network (CNN) of FIG. 2B, in accordance with embodiments of the present disclosure. In particular, referring to FIG. 8A, the CNN variables and outcome or result ("y" or "pass_comp") are shown. In general, the CNN estimates the probability that a pass is completed or not completed.

Referring to FIGS. 8B, 8C, 8D, 8E, 8F, 8G, 8H, 8I, 8J, 8L, 8M, 8N, 8O, 8P and 8Q, which shows example training data for the open score CNN model. As discussed herein above with FIGS. 3A, 4A and 4B, the inputs to the CNN were constructed as a 3D tensor of dimensions 16×11×10 (number of input variables (16), 11 defenders, and 10 offensive players (11 minus the receiver), since the variables are relative to the receiver's own variables). For variables that are not a 11×10 matrix, values are repeated in an appropriate way to conform to the matrix format. A similar or related set of training data exists for the Catch score and YAC score components for the CNN model (not shown).

Figure 9A:
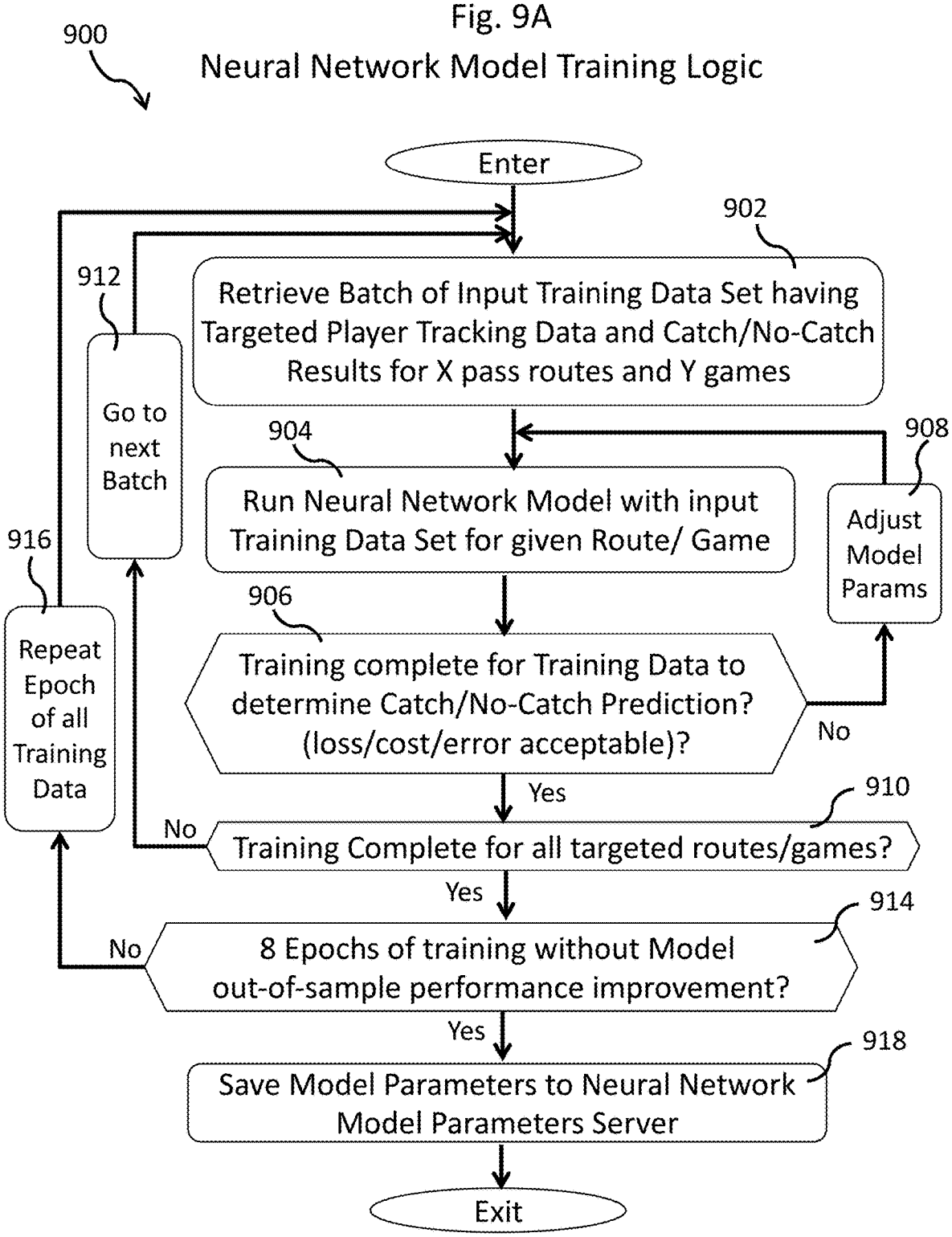
FIG. 9A shows a flow diagram for the Neural Network Model Training Logic for the CNN model of FIG. 2B at training time, in accordance with embodiments of the present disclosure.
Figure 9B:
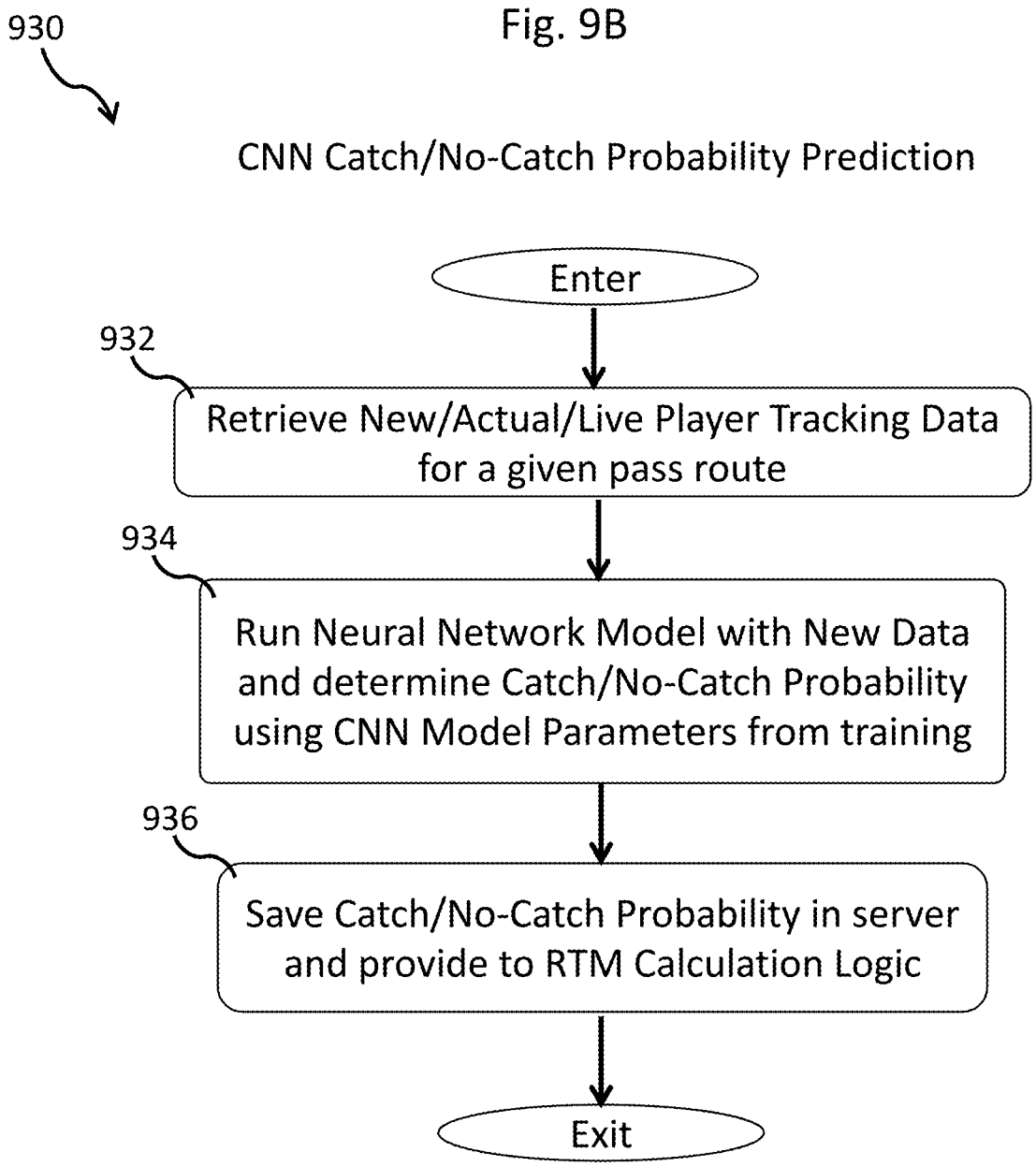
FIG. 9B shows a flow diagram for the Neural Network Model Prediction Logic for the CNN model of FIG. 2B at run or prediction time, in accordance with embodiments of the present disclosure

FIGS. 9A and 9B show flow diagrams for the CNN model of FIG. 2B and FIG. 3A at training (FIG. 9A) and at run/prediction time (FIG. 9B), in accordance with embodiments of the present disclosure.

Training of the CNN model may be conducted using traditional supervised learning. In some embodiments, the CNN models of the present disclosure may be trained in in "batches" of 64 plays at a time via adaptive stochastic gradient descent with momentum. Other batch sizes may be used. In particular, a set of 64 plays may be used at each step of the training to update the CNN model parameters. Also, the training process will do this across several passes over all the data, which are called 'epochs'. Also, in some embodiments, a technique called "early stopping" may be used, which performs another epoch until there are 8 consecutive epochs for which the model performance no longer improves. The training loss (or cost) function is binary cross-entropy. Other loss (or cost) functions may be used if desired.

Referring to FIG. 9A, a flow diagram 900 illustrates one embodiment of a process or logic for performing Neural Network Model Training Logic 224A (FIG. 2B) during model training for the Neural Network Model 224. The process 900 begins at block 902 which retrieves a batch of input training data having targeted player tracking data and Catch/No-Catch results for a predetermined number of pass routes and a predetermined number of games. Next, block 904 runs the Neural Network Model with the input training data set for a given route/game. Next, block 906 determines whether the training is complete for the training data to determine Catch/No-Catch prediction, including determining if the loss (or cost or error) function is at an acceptable level. If not, block 908 adjusts the model parameters and the logic proceeds back to block 904 to run the model again with the new parameters. If the result of block 906 is Yes, block 910 determines if the training ins completed for all the targeted routes/games. If not, block 912 goes to the next batch and the logic proceeds back to block 902 to retrieve the next batch of data. If the result of lock 910 is Yes, block 914 determines if eight (8) Epochs of training have occurred without model performance improvement. If the result of block 914 is No, the logic proceeds to block 916 which repeats the Epoch of all training data by going back to block 902. If the result of block 914 is Yes, block 918 saves the model parameters to the Neural Network Model parameters server 238 (FIG. 2B) and the logic exits.

Referring to FIG. 9B, a flow diagram 930 illustrates one embodiment of a process or logic for performing Neural Network Model Probability Prediction Logic 224B (FIG. 2B) during the prediction or run time for the Neural Network Model 224. The process 930 begins at block 932 which retrieves new (or actual or live) Player Tracking Data (PTD) for a given pass route. Next, block 934 runs the Neural Network Model with the new Player Tracking Data for a given pass route. Next, block 936 saves Catch/No-Catch Probability output value in the Catch/No-Catch Prediction Server 242 (FIG. 2B) and the logic exits.

As discussed herein with FIG. 3B, for implementation of the CNN Model, five CNN models were created, each with a different one-fifth of the data held out for validation.

Other types of machine learning models or Neural Network models may be used if desired for the "prediction" value portion of the present disclosure, provided they provide similar function and performance as described herein.

Figure 9C:
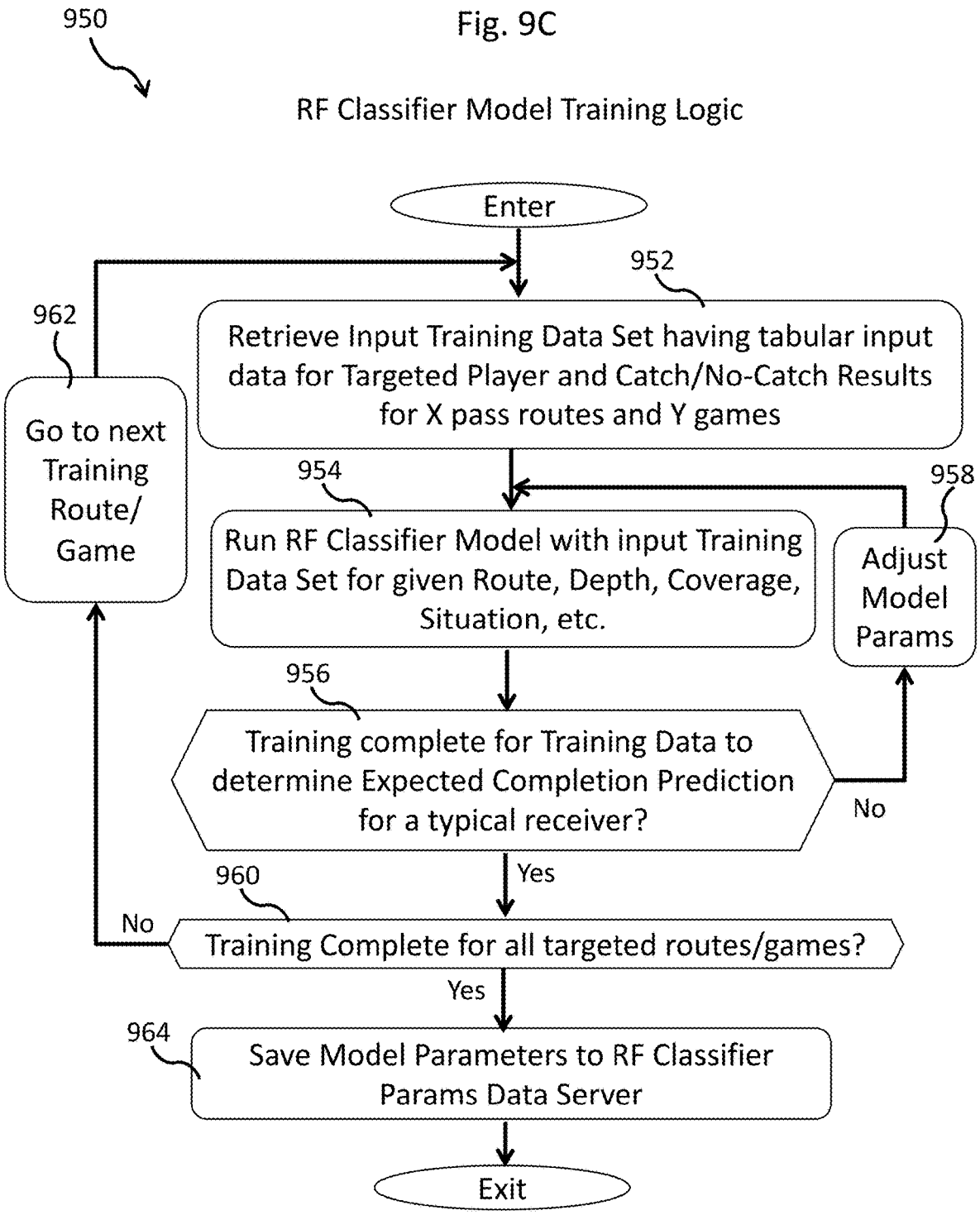
FIG. 9C shows a flow diagram for the RF Classifier Model Training Logic for the RF Classifier of FIG. 2B at training time, in accordance with embodiments of the present disclosure
Figure 9D:
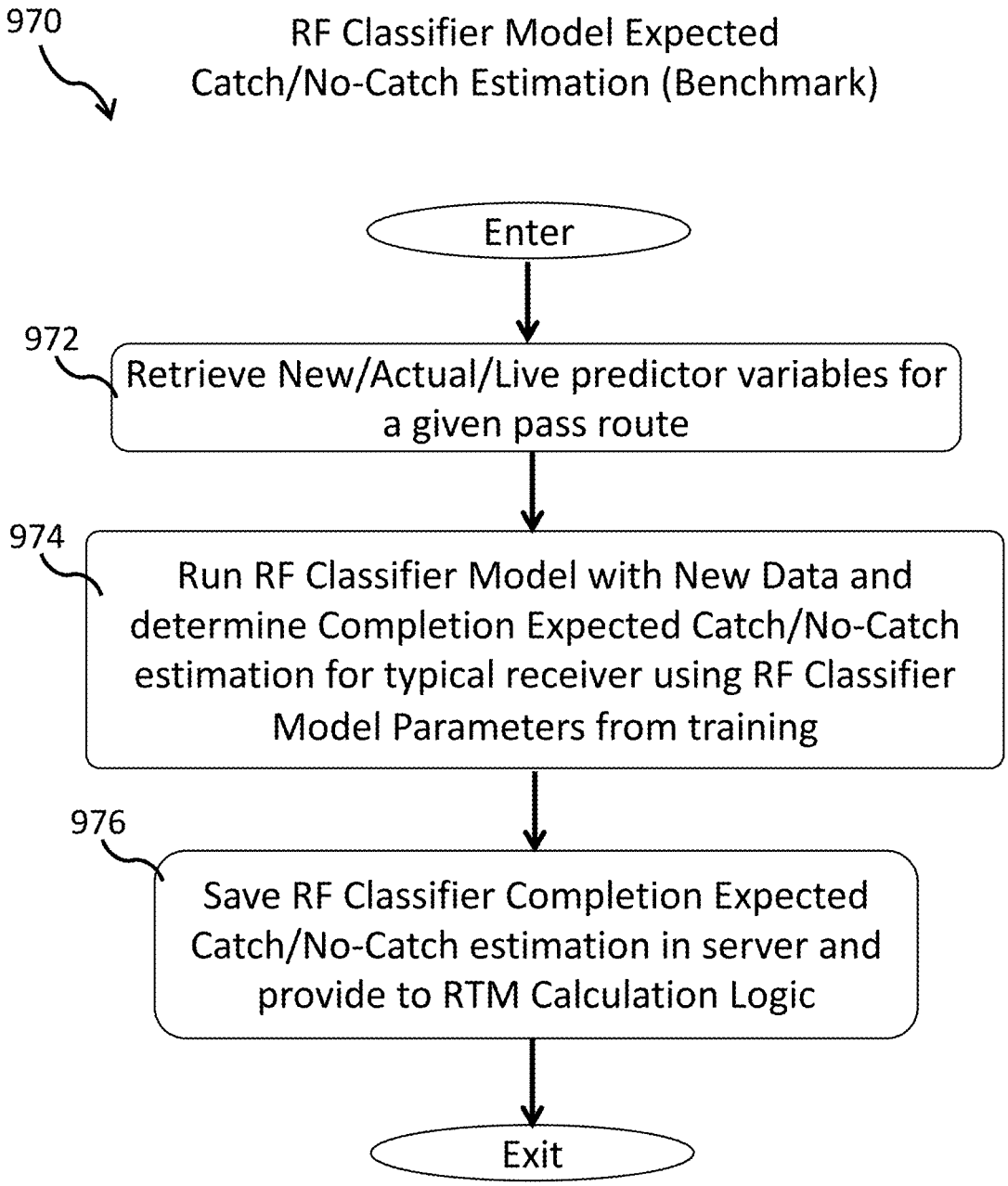
FIG. 9D shows a flow diagram for the RF Classifier Model Expected Logic for the RF Classifier model of FIG. 2B at run/estimation time, in accordance with embodiments of the present disclosure.

Referring to FIGS. 9C and 9D, which show flow diagrams for the RF Classifier model of FIG. 2B at training (FIG. 9C) and at run/prediction time (FIG. 9D), in accordance with embodiments of the present disclosure. Other types of machine learning models or classifier models may be used for providing the estimated "expected" value (for a typical receiver) portion of the present disclosure if desired, provided they provide similar function and performance as described herein.

Referring to FIG. 9C, a flow diagram 950 illustrates one embodiment of a process or logic for performing RF Classifier Model Training Logic 226A (FIG. 2B) during model training for the RF Classifier Model 226. The process 950 begins at block 952, which retrieves input training data having targeted player tracking data comprising tabular pass route input data for targeted players and including Catch/No-Catch results for a predetermined number of pass routes and a predetermined number of games, such as that shown in FIG. 7D. Next, block 954 runs the RF Classifier Model with the input training data set for a given route, depth, coverage, situation, and the like. Next, block 956 determines whether the training is complete for the training data to determine an Expected Completion prediction for a typical receiver. If not, block 958 adjusts the RF Classifier model parameters and the logic proceeds back to block 954 to run the RF Classifier model again with the new model parameters. If the result of block 956 is Yes, block 960 determines if the training is completed for all the targeted routes/games. If not, the logic proceeds to block 962 which goes to the next training route/game and the logic proceeds back to block 902 to determine model parameters with training data for next route or game. If the result of block 960 is Yes, block 964 saves the model parameters to RF Classifier Parameters Data Server 268 (FIG. 2B).

Referring to FIG. 9D, a flow diagram 970 illustrates one embodiment of a process or logic for performing RF Classifier Model Estimation Logic 226B (FIG. 2B) during the expected (or benchmark) or run time for the RF Classifier Model 226. The process 970 begins at block 972 which retrieves new (or actual or live) predictor variables for a given pass route. Next, block 974 runs the RF Classifier Model with the new (or actual or live) predictor variables for a given pass route. Next, block 976 saves the RF Classifier Completion Expected Catch/No-Catch Estimation output value in the Catch/No-Catch Expected Server 262 (FIG. 2B) and the logic exits.

Other types of machine learning models may be used if desired for the "expected" (or benchmark) value portion of the present disclosure, provided they provide similar function and performance as described herein.

Figure 9E:
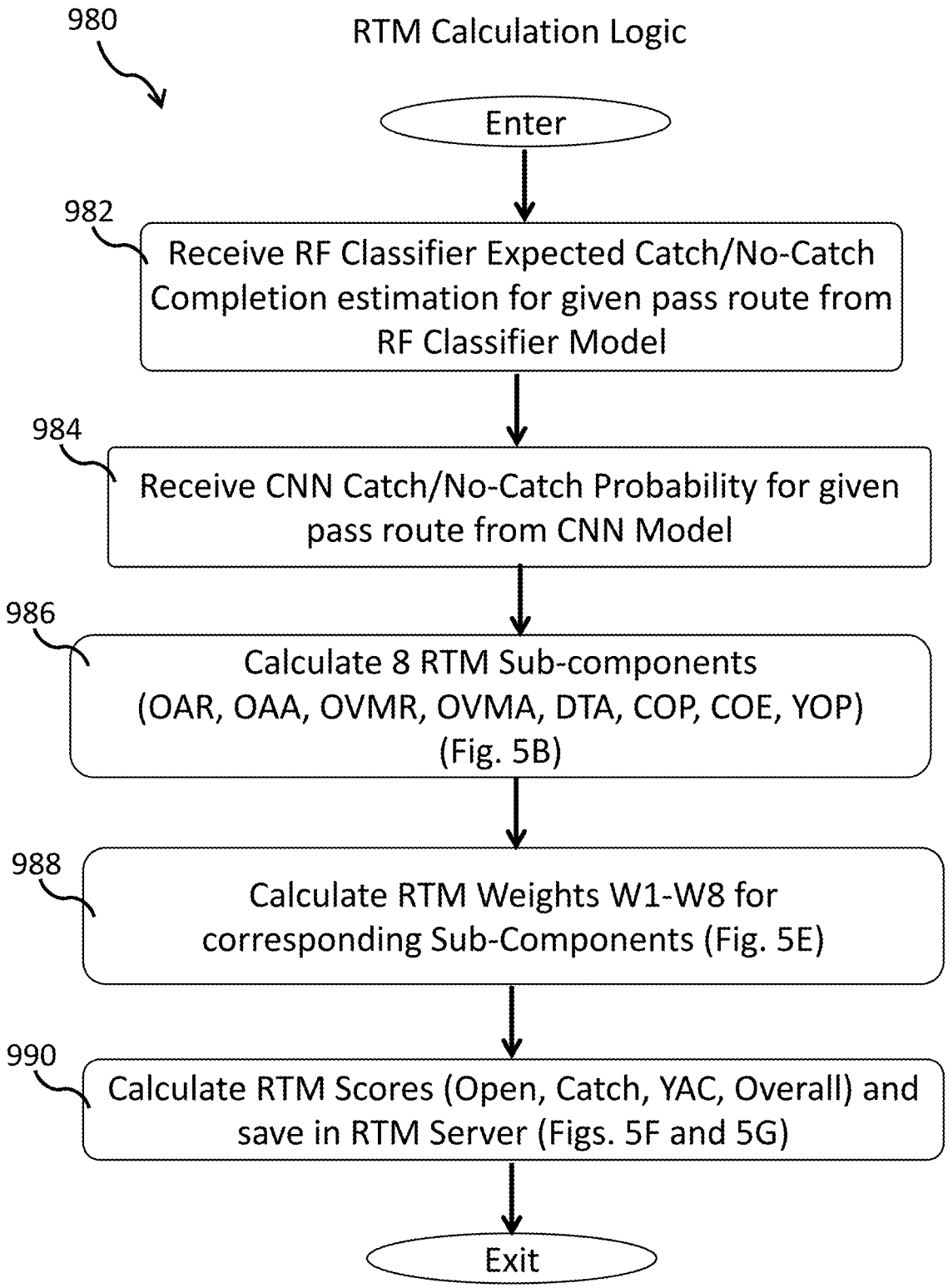
FIG. 9E shows a flow diagram for the RTM Calculation Logic of FIG. 2B, in accordance with embodiments of the present disclosure.

Referring to FIG. 9E, a flow diagram 980 illustrates one embodiment of a process or logic for performing the RTM Calculation Logic 228 (FIG. 2B). The process 980 begins at block 982, which receives expected catch/no-catch completion estimation from the RF Classifier 226 for a given pass route. Next, block 984 receives catch/no-catch probability for a given pass route from the CNN Model. Next, block 986 calculates eight (8) RTM components and sub-components (OAR, OAA, OVMR, OVMA, DTA, COP, COE, YOP) as shown in FIG. 5B and FIG. 5C. Next, block 988 calculates the RTM weights (W1-W8) for the corresponding sub-components, as shown in FIG. 5E. Next, block 990 calculates the RTM scores (Open, Catch, YAC, Overall) as shown in FIGS. 5F and 5G and saves the results in the RTM Server 272 (FIG. 2B), and then the logic exits.

As discussed herein, the RTM may be used in various end applications, such as control of video game character performance, recommendation generation such as for fantasy sports or gambling applications, and graphics display in a computer or broadcast system. Also, RTMs may be used for decomposing receiver player skills into Open, Catch, YAC, and Overall RTM scores to better understand receiver player abilities. RTMs may also be used for player comparisons for awards, rankings, analysis of trades, free-agent signings, releases, and the like. They may also be used for narratives and explanations of improvement or declines of receiver performance over time. Regarding team, manager, player, coach, recruiter, or agent applications, RTMs may be used for professional and amateur player evaluations for roster selection (signings, releases, drafting), pro signings, pro selection from college, and college recruitment from high school/junior college, as well as for team-player-agent contract negotiations. RTMs may also be used in a coaching situation to decide which player to use for a given play or which route to run, based on the RTM data for a given receiver or group of receivers. In each of these cases there may be a software application or RTM App which provides a graphic user interface that displays and ranks players by RTMs and enables a user (e.g., manager, coach, recruiter, or other user) to select from the list, or to determine how the information is displayed or filtered for selection purposes, or may display a side-by-side comparison of selected players in a draft showing their respective RTM scores, or may provide recommendations based on the users selected criteria, e.g., provide the top 5 players in a side-by-side comparison of certain selected RTMs.

In some embodiments, the RTMs of the present disclosure can be used to drive outcomes in electronic games, recommendation engines, and graphics display. In particular, for fantasy sports, the RTMs of the present may be used to provide recommendations as part of a fantasy sports recommendations engine, such as that described in commonly owned U.S. Pat. Nos. 8,670,847B2, 10,398,988B2, 10,744,415B2, 10,940,395B2, each to Sloan et al, each of which is incorporated herein by reference to the extent needed to understand the present disclosure. In that case, the RTMs of the present disclosure may be used as part of a recommendation engine to recommend certain receivers based on their RTM scores and certain user criteria or to provide a list of top receivers based on their RTM scores that the user may choose from for a fantasy player draft.

Also, the RTMs of the present invention may be used as part of a football video game or other electronic sports game The RTMs of the present disclosure may be used to recommend certain receivers to put into play based on their RTM scores or may be used to calculate the likelihood a given player will make a catch or use RTMs to decide whether a given player or receiver actually makes a catch in the game on a given play based on the RTMs. For example, if a given receiver has a high RTM catch score (e.g., >70) for a given route with the players on the field at the time, the game logic may determine that the player should make the catch in the game, and may also determine how many extra yards the player will get after the catch, e.g., based in part on the YAC score for that receiver.

Figure 10A:
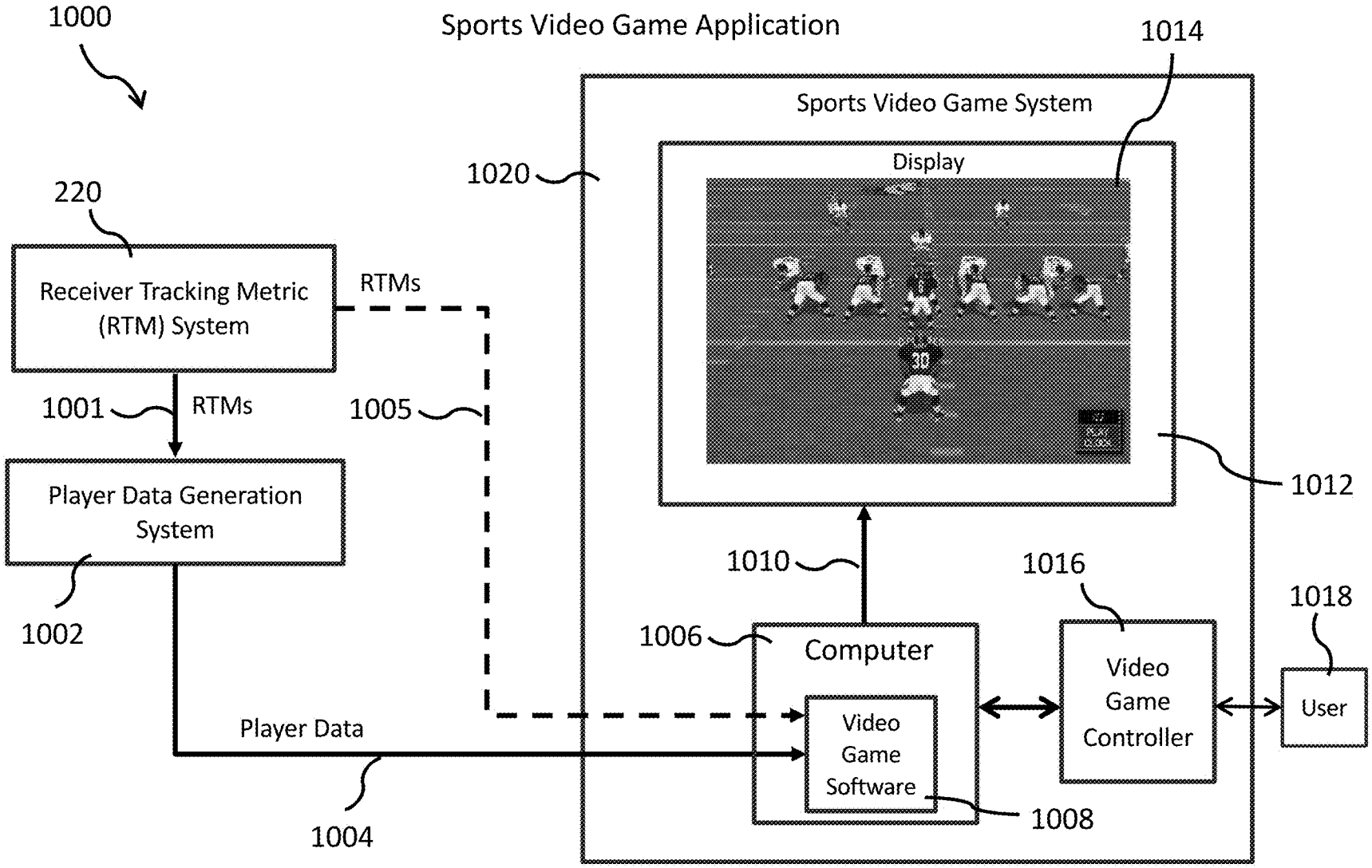
FIG. 10A shows a block diagram for using the RTMs with a sports video game system, in accordance with embodiments of the present disclosure.

In particular, referring to FIG. 10A, shown is a block diagram 1000 for using the RTMs with a sports video game system, in accordance with embodiments of the present disclosure. In particular, the RTM system 220 of the present disclosure (FIG. 2B) may be used with a sports video game system 1020 such that the RTMs generated may be provided on a line 1001 to a player data generation system 1002 which provides player data that is provided on a line 1004 to the sports video game software 1008, which may be installed on a computer 1006 which provides output signals on a line 1010 for display on the display screen 1012. The computer 1006 may receive inputs from a game controller 1016 which may receive inputs from a game user 1018. In some embodiments, the RTMs may be provided directly to sports video game software on a line 1005. The delivery of the data to the video game system could be done over the internet in real time or over the internet periodically (e.g., when there is a software update), or it could be incorporated into the software before it is purchased/downloaded by the customer. An example of how player tracking data (PTD) may be used incertain sports video games is described in the article: "How Madden 22's AI makes better use of NFL Next Gen Stats", by J. Wilson, Jun. 17, 2021, at https://venturebeat.com/games/how-madden-21s-ai-makes-better-use-of-nfl-next-gen-stats/, and a description of one approach to providing player tracking data (PTD) is described in the article: "Next Gen Stats: Introduction to Completion Probability", by The Next Gen Stats Analytics Team, Sep. 21, 2018, at https://www.nfl.com/news/next-gen-stats-introduction-to-completion-probability-0ap3000000964655.

Figure 10B:
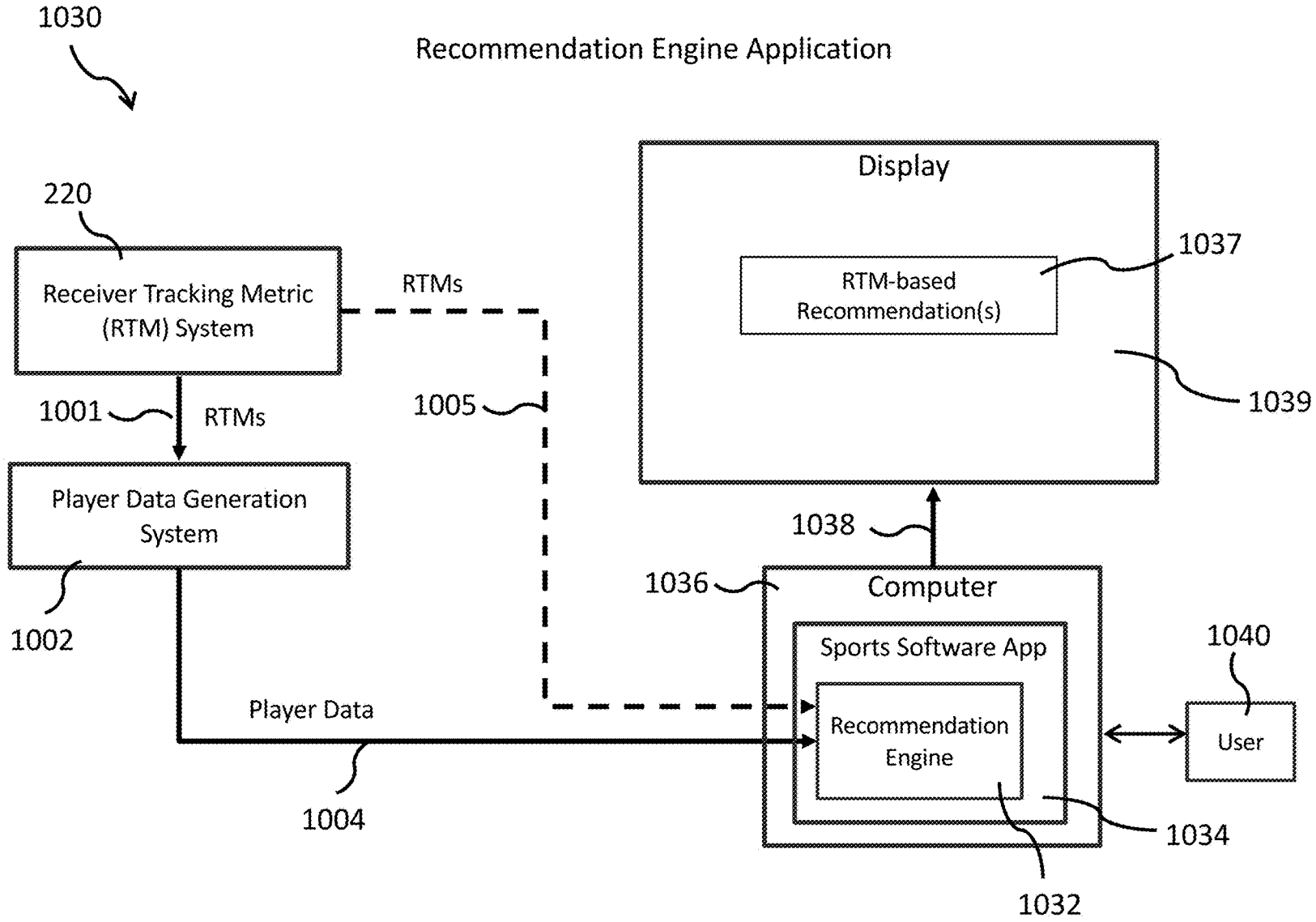
FIG. 10B shows a block diagram for using the RTMs with a recommendation engine application, in accordance with embodiments of the present disclosure.

Referring to FIG. 10B, shown is a block diagram 1030 for using the RTMs with a recommendation engine application, in accordance with embodiments of the present disclosure. In particular, the RTM system 220 of the present disclosure (FIG. 2B) may be used with a recommendation engine 1032 which may be part of sports software application 1034 (e.g., fantasy sports, sports betting/gambling, player draft selection, or any other sports related software application that could benefit from RTMs about players) such that the RTMs generated may be provided on a line 1001 to a player data generation system 1002 (like in FIG. 10A), which provides player data that is provided on a line 1004 to the recommendation engine 1032 within the software sports APP 1034, which may be installed on a computer 1036 which provides audio/video signals on a line 1038 for display of an RTM-based recommendation 1037 on the display screen 1039. In some embodiments, the RTMs may be provided directly to the recommendation engine on a line 1005 (or the associated software app for use by the recommendation engine) for display of the RTM-based recommendation 1037 on the display screen 1039. In some embodiments, the recommendation engine 1032 may include a comparison feature that compares various players (which may be selected by the user).

Figure 10C:
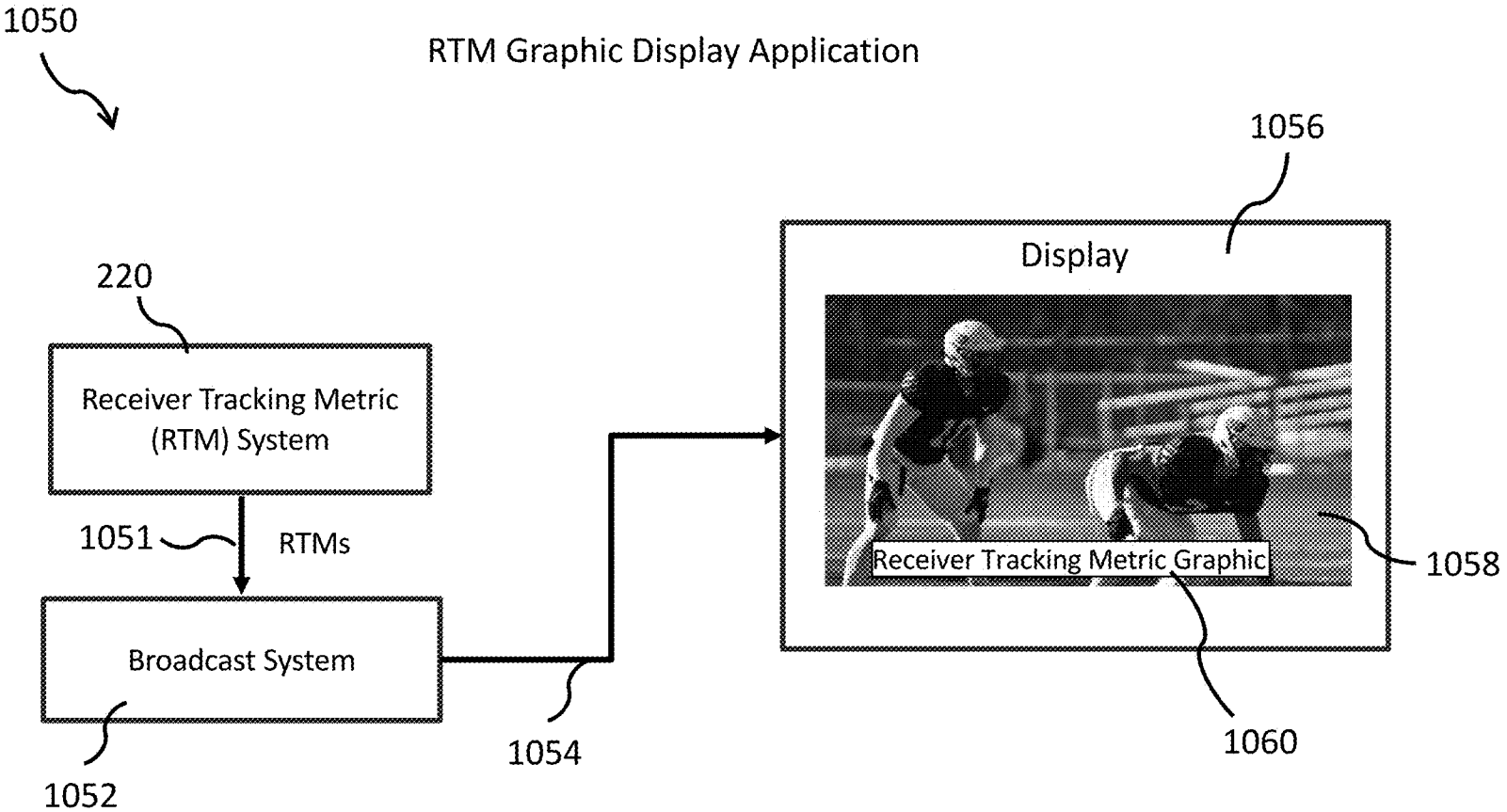
FIG. 10C shows a block diagram for using the RTMs with a broadcast graphic display system, in accordance with embodiments of the present disclosure.

Referring to FIG. 10C, shown is a block diagram 1050 for using the RTMs with a broadcast graphic display application, in accordance with embodiments of the present disclosure. In particular, the RTM system 220 of the present disclosure (FIG. 2B) may be used with a broadcast graphic display application system 1052 which provides video signals on a line 1054 to a display 1056 such that it displays the RTMs graphics 1060 overlaid on a broadcast image 1058 displayed on the display screen 1056, e.g., RTM-related graphics showing RTM values associated with players in a football game or other sports game shown on the display screen 1056.

In some embodiments, a computer-based system for generating player tracking data for a plurality of players playing a sport and using the player tracking data to provide a receiver tracking metrics (RTM) score for at least one player of the plurality of players comprises a player tracking system configured to generate player tracking data indicative of at least the position of each of the plurality of players and a corresponding time, a processor configured to receive the player tracking data from the player tracking system and configured to determine a catch/no-catch probability for a given pass route for the at least one player using the player tracking data and a neural network model, the processor further configured to receive pass route data related to the given pass route and defensive coverage and configured to determine a completion expected catch/no-catch estimation for the given pass route for a typical receiver using a classifier model, the processor further configured to determine at least one RTM sub-component of the receiver tracking metrics for the at least one player, based on the catch/no-catch probability and the completion expected catch/no-catch estimation for the given pass route, the processor further configured to receive receiver production data and configured to determine weightings corresponding to each of the RTM sub-components based on the values of the RTM sub-components, the real-world receiver production data, and the type of receiver group for the at least one player, the processor further configured to combine the RTM sub-components and the corresponding weightings to determine the RTM scores for the at least one player, the RTM scores comprising at least one of: open score, catch score, YAC score, and overall RTM score. In some embodiments, the processor is configured to determine the difference between the catch/no-catch probability from the neural network model and the catch/no-catch estimation from the classifier model to generate the at least one RTM sub-component.

In some embodiments, a method for using player tracking data to provide receiver tracking metrics (RTM) scores, comprises receiving the player tracking data from a player tracking system indicative of at least the position of each player on a field and a corresponding time, determining a catch/no-catch probability for a given pass route for a specific receiver using the player tracking data using a neural network model, determining a completion expected catch/no-catch estimation for a given pass route for a typical receiver using a classifier model, determining RTM sub-components of the receiver tracking metrics, calculating corresponding weightings for each of the RTM sub-components, and determining RTM scores by combining the RTM sub-components and weightings, the RTM scores including at least one of: open score, catch score, YAC score, and overall RTM score. In some embodiments, the neural network model comprises a convolutional neural network and the classifier model comprises a random forest classifier. In some embodiments, the calculating RTM scores comprises calculating at least one RTM component score by combining sub-components associated with the component after applying the associated weighting factor associated with each sub-component. In some embodiments, the at least one RTM component comprises at least one of open score, catch score and YAC score. In some embodiments, the RTM sub-components associated with the open score comprises openness at release, openness at arrival, openness vs man-only defense, and double team adjustment. In some embodiments, the sub-components associated with the catch score comprises catch over predicted and catch over expected, the RTM sub-components associated with the YAC score comprises YAC over predicted, and the sub-components associated with the Overall RTM score comprises openness at release, openness at arrival, openness vs man-only defense, double team adjustment, catch over predicted, catch over expected and YAC over predicted. In some embodiments, the classifier model uses tabular pass route input data, comprising at least one of: route type, coverage type, depth, time of release, distance from sideline, and situational variables. In some embodiments, the player tracking data comprises relative positions and velocities of the players relative to the specific receiver being analyzed for RTMs. In some embodiments, the neural network model uses the player tracking data for all routes run whether targeted or not. In some embodiments, the RTM score is used to provide a recommendation for an end software application or the RTM score is embedded in a software application which improves the performance of the software application. In some embodiments, the end software application comprises at least one of: sports player drafting app, electronic sports games, gambling apps, and fantasy apps. In some embodiments, the determining the at least one RTM sub-component comprises determining the difference between the catch/no-catch probability from the neural network model and the catch/no-catch estimation from the classifier model.

In some embodiments, a method for tracking sports players to generate receiver tracking metrics using player tracking data, comprises receiving player tracking data from a player tracking system indicative of the position of a plurality of players on a sports field and a corresponding time identifying a specific receiver player to be analyzed for performance from the plurality of players on the sports field, determining a catch/no-catch probability for a given pass route for the specific receiver player using the player tracking data using a neural network model, determining a completion expected catch/no-catch estimation for a given pass route for a typical receiver using a classifier model, calculating RTM sub-components of the receiver tracking metrics, calculating corresponding weightings for each of the RTM sub-components, and calculating RTM scores by performing a weighted sum of corresponding RTM sub-components and weightings, the RTM scores including at least one of: open score, catch score, YAC score, and Overall RTM score.

The system, computers, servers, devices, logic and the like described herein have the necessary electronics, computer processing power, interfaces, memory, hardware, software, firmware, logic/state machines, databases, microprocessors, communication links (wired or wireless), displays or other visual or audio user interfaces, printing devices, and any other input/output interfaces, to provide the functions or achieve the results described herein. Except as otherwise explicitly or implicitly indicated herein, process or method steps described herein may be implemented within software modules (or computer programs) executed on one or more general-purpose computers. Specially designed hardware may alternatively be used to perform certain operations. Accordingly, any of the methods described herein may be performed by hardware, software, or any combination of these approaches. In addition, a computer-readable storage medium may store thereon instructions that when executed by a machine (such as a computer) result in performance according to any of the embodiments described herein.

In addition, computers or computer-based devices described herein may include any number of computing devices capable of performing the functions described herein, including but not limited to: tablets, laptop computers, desktop computers, smartphones, mobile communication devices, smart TVs, set-top boxes, e-readers/players, and the like.

Although the disclosure has been described herein using exemplary techniques, algorithms, or processes for implementing the present disclosure, it should be understood by those skilled in the art that other techniques, algorithms and processes or other combinations and sequences of the techniques, algorithms and processes described herein may be used or performed that achieve the same function(s) and result(s) described herein and which are included within the scope of the present disclosure.

Any process descriptions, steps, or blocks in process or logic flow diagrams provided herein indicate one potential implementation, do not imply a fixed order, and alternate implementations are included within the scope of the preferred embodiments of the systems and methods described herein in which functions or steps may be deleted or performed out of order from that shown or discussed, including substantially concurrently or in reverse order, depending on the functionality involved, as would be understood by those reasonably skilled in the art.

It should be understood that, unless otherwise explicitly or implicitly indicated herein, any of the features, functions, characteristics, alternatives or modifications described regarding a particular embodiment herein may also be applied, used, or incorporated with any other embodiment described herein. Also, the drawings herein are not drawn to scale, unless indicated otherwise.

Conditional language, such as, among others, "can," "could," "might," or "may," unless specifically stated otherwise, or otherwise understood within the context as used, is generally intended to convey that certain embodiments could include, but do not require, certain features, elements, or steps. Thus, such conditional language is not generally intended to imply that features, elements, or steps are in any way required for one or more embodiments or that one or more embodiments necessarily include logic for deciding, with or without user input or prompting, whether these features, elements, or steps are included or are to be performed in any particular embodiment.

Although the invention has been described and illustrated with respect to exemplary embodiments thereof, the foregoing and various other additions and omissions may be made therein and thereto without departing from the spirit and scope of the present disclosure.

What is claimed is:

1. A computer-based system for generating player tracking data for a plurality of players playing a sport and using the player tracking data to provide a receiver tracking metrics (RTM) score for at least one player of the plurality of players, comprising:

a player tracking system configured to generate player tracking data indicative of at least a position of each of the plurality of players and a corresponding time;

a processor configured to receive the player tracking data from the player tracking system and configured to determine a catch/no-catch probability for a given pass route for the at least one player using the player tracking data and a neural network model, the neural network comprising a convolutional neural network (CNN), which receives the player tracking data as 3D tensor data comprising number of input variables, number of defensive players, and number of offensive players;

the processor further configured to receive pass route data related to the given pass route and defensive coverage and configured to determine a completion expected catch/no-catch estimation for the given pass route for a typical receiver using a classifier model, the classifier model being trained using tabular pass route data for actual targeted routes for given players, and during run time, the classifier model uses tabular pass route data for targeted and untargeted routes;

the processor further configured to determine at least one RTM sub-component of the receiver tracking metrics for the at least one player, based on the catch/no-catch probability and the completion expected catch/no-catch estimation for the given pass route;

the processor further configured to receive receiver production data and configured to determine weightings corresponding to each of the RTM sub-components based on values of the RTM sub-components, real-world receiver production data, and type of receiver group for the at least one player; and the processor further configured to combine the RTM sub-components and the corresponding weightings to determine the RTM scores for the at least one player, the RTM scores comprising at least one of: open score, catch score, YAC score, and overall RTM score.

2. The system of claim 1 wherein the neural network model comprises a convolutional neural network.

3. The system of claim 1 wherein the classifier model comprises a random forest classifier.

4. The system of claim 1 wherein the processor is configured to combine corresponding ones of the RTM sub-components associated with the corresponding one of the RTM scores after applying the associated weighting factor to determine at least one of the RTM scores.

5. The system of claim 1 wherein the RTM sub-components associated with the open score comprises at least one of openness at release, openness at arrival, openness vs man-only defense at release, openness vs man-only defense at arrival, and double team adjustment.

6. The system of claim 5 wherein the processor is configured to determine the difference between an expected number of defenders and an actual number of defenders guarding a receiver to generate the double team adjustment.

7. The system of claim 1 wherein the RTM sub-components associated with the catch score comprises at least one of catch over predicted and catch over expected and the RTM sub-components associated with the YAC score comprises YAC over predicted.

8. The system of claim 1 wherein the RTM sub-components associated with the Overall RTM score comprises at least one of openness at release, openness at arrival, openness vs man-only defense at release, openness vs man-only defense at arrival, double team adjustment, catch over predicted, catch over expected and YAC over predicted.

9. The system of claim 1 wherein the pass route data, comprises at least one of: route type, coverage type, depth, time of release, distance from sideline, and situational variables.

10. The system of claim 1 wherein the player tracking data comprises relative positions and velocities of the sports-players relative to the at least one player.

11. The system of claim 1 wherein the neural network model uses the player tracking data for all routes run whether targeted or not.

12. The system of claim 1 wherein the RTM score is used to provide a recommendation for an end software application.

13. The system of claim 1 wherein the RTM score is used to provide an RTM graphic indicative of the RTM score overlayed on a broadcast display of a sporting event.

14. The system of claim 1 wherein the RTM score is used in an end software application comprising at least one of: sports player drafting app, electronic sports games, gambling apps, and fantasy apps.

15. The system of claim 1 wherein the classifier model comprises at least one of: Random Forest Classifier, gradient-boosted trees, logistic regression, support vector machines, and K-nearest neighbors.

16. The system of claim 1 wherein the classifier model is trained using targeted routes only.

17. The system of claim 1 wherein the weights have different values based on a type of receiver group.

18. The system of claim 1 wherein the processor is configured to determine the difference between the catch/no-catch probability from the neural network model and the completion expected catch/no-catch estimation from the classifier model to generate the at least one RTM sub-component.

19. The system of claim 1 wherein the player tracking system comprises at least one of a signal-based system and an image-based system.

20. A computer-based method for using player tracking data of a plurality of players playing a sport to provide receiver tracking metrics (RTM) scores for at least one player of the plurality of players, comprising:

receiving the player tracking data from a player tracking system indicative of at least a position of each of the plurality of players and a corresponding time;

determining a catch/no-catch probability for a given pass route for the at least one player using the player tracking data and a neural network model, the neural network comprising a convolutional neural network (CNN), which receives the player tracking data as 3D tensor data comprising number of input variables, number of defensive players, and number of offensive players;

determining a completion expected catch/no-catch estimation for the given pass route for a typical receiver using a classifier model, the classifier model being trained using tabular pass route data for actual targeted routes for given players, and during run time, the classifier model uses tabular pass route data for targeted and untargeted routes;

calculating RTM sub-components of the receiver tracking metrics for the at least one player;

calculating corresponding weightings for each of the RTM sub-components; and calculating RTM scores for the at least one player by combining the RTM sub-components and weightings, the RTM scores comprising at least one of: open score, catch score, YAC score, and overall RTM score.

21. The method of claim 20 wherein the neural network model comprises a convolutional neural network.

22. The method of claim 20 wherein the classifier model comprises a random forest classifier.

23. The method of claim 20 wherein the calculating RTM scores comprises calculating at least one of the RTM scores by combining corresponding ones of the RTM sub-components associated with one of the RTM scores after applying the associated weighting factor.

24. The method of claim 20 wherein the RTM sub-components associated with the open score comprises at least one of openness at release, openness at arrival, openness vs man-only defense at release, openness vs man-only defense at arrival, and double team adjustment.

25. The method of claim 24 wherein the double team adjustment comprises determining the difference between an expected number of defenders and an actual number of defenders guarding a receiver.

26. The method of claim 20 wherein the RTM sub-components associated with the catch score comprises at least one of catch over predicted and catch over expected, the RTM sub-components associated with the YAC score comprises YAC over predicted, and the RTM sub-components associated with the Overall RTM score comprises at least one of openness at release, openness at arrival, openness vs man-only defense at release, openness vs man-only defense at arrival, double team adjustment, catch over predicted, catch over expected and YAC over predicted.

27. The method of claim 20 wherein the classifier model uses pass route data, comprising at least one of: route type, coverage type, depth, time of release, distance from sideline, and situational variables.

28. The method of claim 20 wherein the player tracking data comprises relative positions and velocities of the sports-players relative to each other.

29. The method of claim 20 wherein the neural network model uses the player tracking data for all routes run whether targeted or not.

30. The method of claim 20 wherein the RTM score is used to provide a recommendation for an end software application.

31. The method of claim 20 wherein the RTM score is used to provide an RTM graphic indicative of the RTM score overlayed on a broadcast display of a sporting event.

32. The method of claim 20 wherein the RTM score is used in an end software application comprising at least one of: sports player drafting app, electronic sports games, gambling apps, and fantasy apps.

33. The method of claim 20 wherein the classifier model comprises at least one of: Random Forest Classifier, gradient-boosted trees, logistic regression, support vector machines, and K-nearest neighbors.

34. The method of claim 20 wherein the classifier model is trained using targeted routes only.

35. The method of claim 20 wherein the weights have different values based on a type of receiver group.

36. The method of claim 20 wherein the determining the at least one RTM sub-component comprises determining the difference between the catch/no-catch probability from the neural network model and the completion expected catch/no-catch estimation from the classifier model.

37. The method of claim 20 wherein the player tracking system comprises at least one of a signal-based system and an image-based system.

38. A computer-based method for providing receiver tracking metrics (RTM) scores for at least one player of a plurality of players playing a sport using player tracking data of the plurality of players, comprising:

receiving the player tracking data from a player tracking system indicative of relative position and velocity of the plurality of players relative to the at least one player;

determining a catch/no-catch probability for a given pass route for the at least one player using the player tracking data and a neural network model, the neural network comprising a convolutional neural network (CNN), which receives the player tracking data as 3D tensor data comprising number of input variables, number of defensive players, and number of offensive players;

determining a completion expected catch/no-catch estimation for the given pass route for a typical receiver using a classifier model, the classifier model being trained using tabular pass route data for actual targeted routes for given players, and during run time, the classifier model uses tabular pass route data for targeted and untargeted routes;

calculating RTM sub-components of the receiver tracking metrics for the at least one player;

obtaining corresponding weightings for each of the RTM sub-components;

determining RTM scores for the at least one player by performing a weighted sum of the RTM sub-components and weightings to determine the RTM scores for the at least one player, the RTM scores comprising at least one of an open score, catch score, YAC score, and overall RTM score; and wherein the calculating the RTM sub-components comprises determining the difference between the catch/no-catch probability from the neural network model and the completion expected catch/no-catch estimation from the classifier model.

* * * * *